US011272813B2

(12) United States Patent
Szemetylo et al.

(10) Patent No.: US 11,272,813 B2
(45) Date of Patent: Mar. 15, 2022

(54) BATHROOM FIXTURES AND COMPONENTS

(71) Applicant: Kohler Co., Kohler, WI (US)

(72) Inventors: Stephanie Szemetylo, Sheboygan, WI (US); Erich D. Slothower, Mill Valley, CA (US); Gregory de Swarte, Sheboygan, WI (US); Margaret C. Mazz, Sheboygan, WI (US); Terrence K. Mahon, Whitefish Bay, WI (US); Nona J. Beining, Howards Grove, WI (US)

(73) Assignee: Kohler Co., Kohler, WI (US)

( * ) Notice: Subject to any disclaimer, the term of this patent is extended or adjusted under 35 U.S.C. 154(b) by 59 days.

(21) Appl. No.: 16/800,657

(22) Filed: Feb. 25, 2020

(65) Prior Publication Data

US 2020/0187723 A1 Jun. 18, 2020

Related U.S. Application Data

(62) Division of application No. 15/797,165, filed on Oct. 30, 2017, now Pat. No. 10,575,685.
(Continued)

(51) Int. Cl.
*A47K 4/00* (2006.01)
*E03B 1/04* (2006.01)
(Continued)

(52) U.S. Cl.
CPC ..... *A47K 4/00* (2013.01); *A47K 3/281* (2013.01); *A47K 3/282* (2013.01); *A47K 17/022* (2013.01);
(Continued)

(58) Field of Classification Search
CPC ..... A47K 4/00; A47K 3/281; A47K 3/282; A47K 17/022; E03B 1/04; E03C 1/0408; E03C 1/20
(Continued)

(56) References Cited

U.S. PATENT DOCUMENTS 2,198,605 A 4/1940 Alfred
2003/0140571 A1* 7/2003 Muha ..... E04H 1/1266 52/79.1
2005/0108957 A1 5/2005 Quesada

FOREIGN PATENT DOCUMENTS

CN 1667219 A 9/2005
CN 2746062 Y 12/2005
(Continued)

OTHER PUBLICATIONS

Tao, "The principle of interior design", 2nd Version, 3 pages, Hunan University Press (Aug. 31, 2010).
(Continued)

*Primary Examiner* — Christine J Skubinna
(74) *Attorney, Agent, or Firm* — Foley & Lardner LLP

(57) ABSTRACT

A bathroom module includes a shower area that includes a shower head, a control valve assembly, and a drain. The module also includes a toilet area including a toilet assembly and a transition area disposed between the shower area and the toilet area. The module also includes a shower area front wall and a shower area side wall, the shower area disposed along a first side of the shower area front wall and a first side of the shower area side wall. The module also includes a toilet area front wall and a toilet area side wall, the toilet area disposed along a first side of the toilet area front wall and a first side of the toilet area side wall. A grooming area includes a sink assembly that comprises a faucet, and the grooming area is disposed along a second side of at least one of the shower area front wall, the shower area side wall, the toilet area front wall, and the toilet area side wall.

20 Claims, 62 Drawing Sheets

Related U.S. Application Data

(60) Provisional application No. 62/415,911, filed on Nov. 1, 2016.

(51) Int. Cl.

| | |
|---|---|
| ***E03C 1/20*** | (2006.01) |
| ***A47K 3/28*** | (2006.01) |
| ***A47K 17/02*** | (2006.01) |
| ***E03C 1/04*** | (2006.01) |
| ***E04H 1/12*** | (2006.01) |
| ***E03C 1/122*** | (2006.01) |
| ***E03C 1/182*** | (2006.01) |
| ***E03D 5/02*** | (2006.01) |
| ***E03C 1/02*** | (2006.01) |

(52) U.S. Cl.
CPC ..... *E03B 1/04* (2013.01); *E03C 1/0408* (2013.01); *E03C 1/20* (2013.01); *A47K 3/283* (2013.01); *E03C 1/023* (2013.01); *E03C 1/1222* (2013.01); *E03C 1/182* (2013.01); *E03D 5/02* (2013.01); *E04H 1/1266* (2013.01)

(58) Field of Classification Search
USPC ..... 52/143; 4/663
See application file for complete search history.

(56) References Cited

FOREIGN PATENT DOCUMENTS

| | | | |
|---|---|---|---|
| CN | 201165761 | Y | 12/2008 |
| CN | 201972419 | U | 9/2011 |
| CN | 102463203 | A | 5/2012 |
| CN | 203420358 | U | 2/2014 |
| CN | 203499286 | U | 3/2014 |
| CN | 205296898 | U | 6/2016 |
| JP | 2000080797 | A | 3/2000 |
| KR | 20070076362 | A | 7/2007 |

OTHER PUBLICATIONS

Chinese Office Action, App. No. 201711044080.0, KOHLER CO., 10 pages (dated Mar. 2, 2020).

* cited by examiner

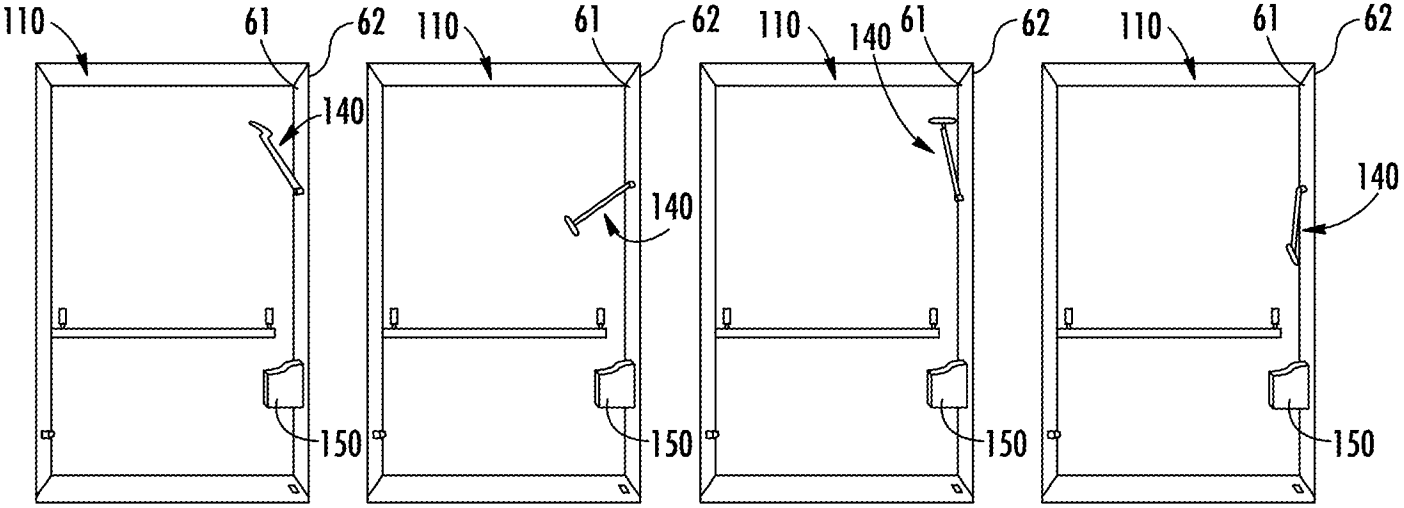
FIG. 9A
FIG. 9B
FIG. 9C
FIG. 9D
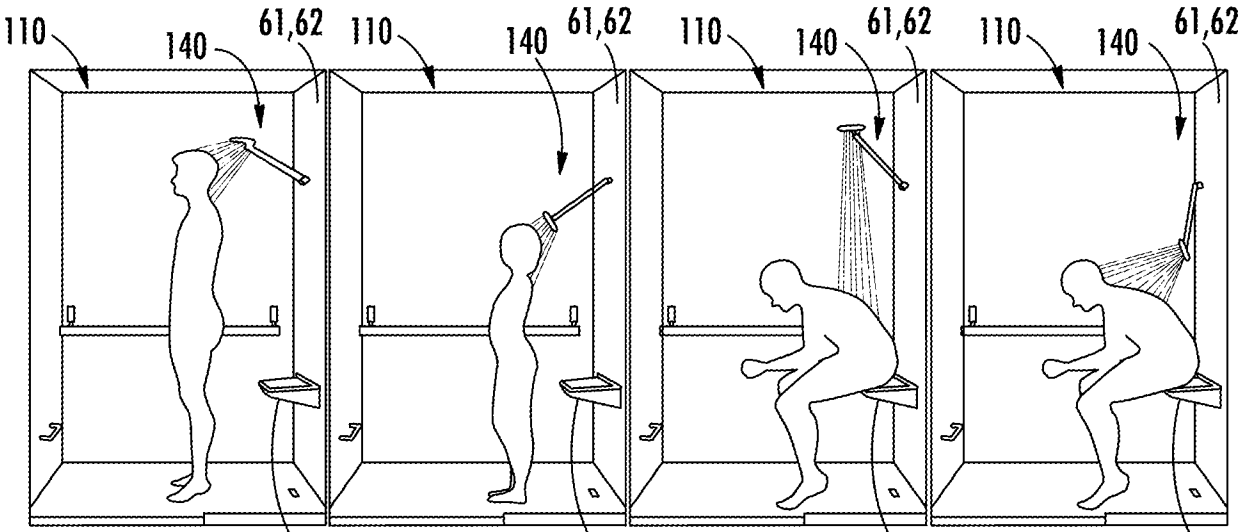
FIG. 10A
FIG. 10B
FIG. 10C
FIG. 10D

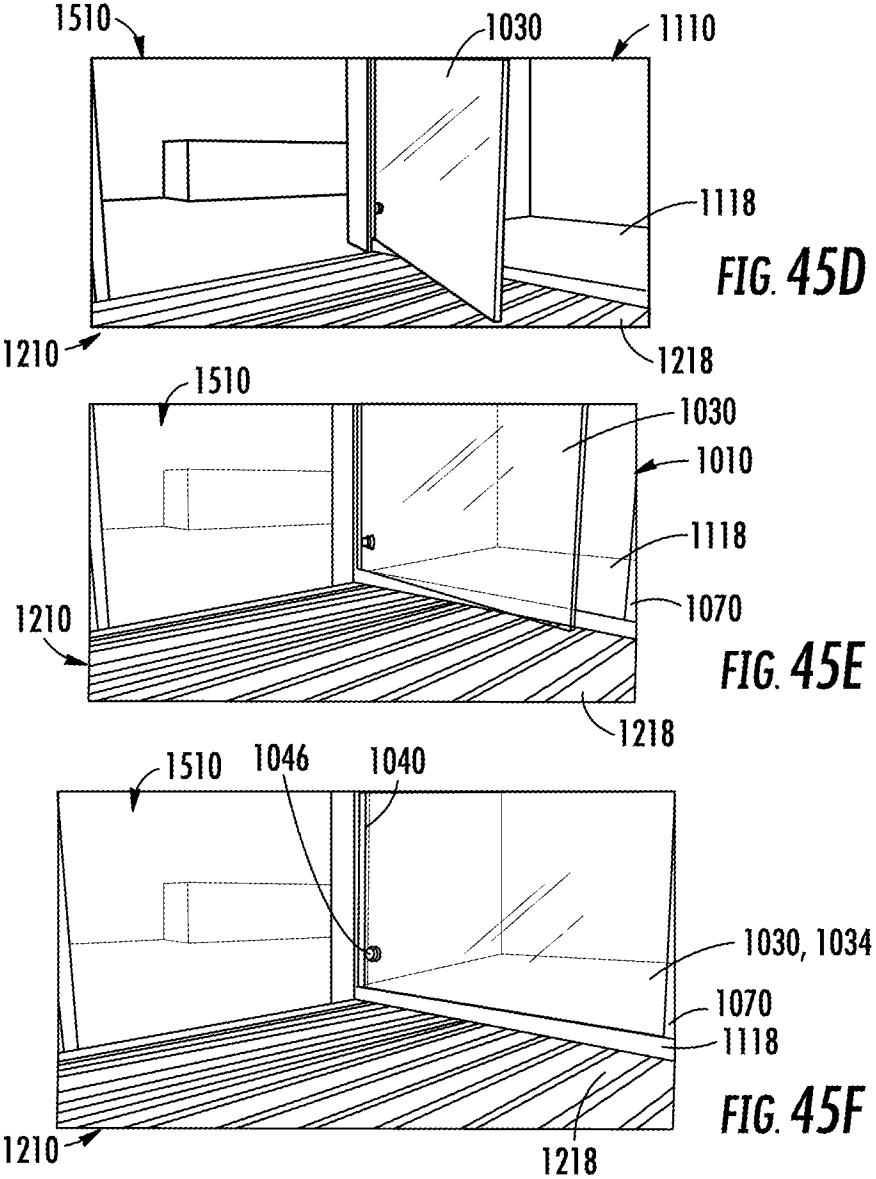
FIG. 45D
FIG. 45E
FIG. 45F
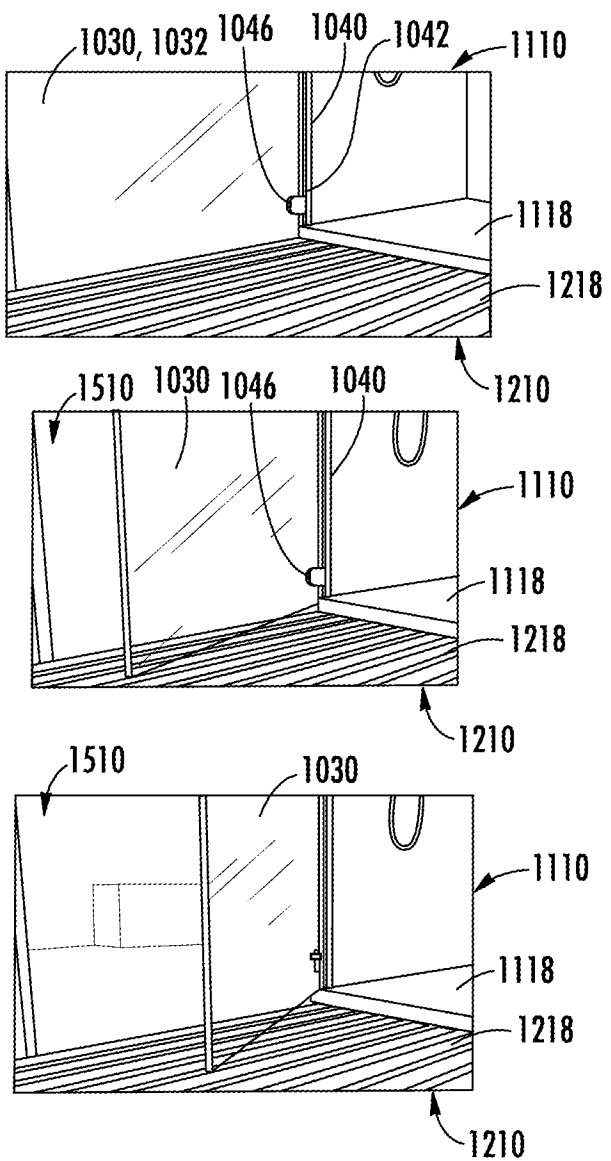
FIG. 45A
FIG. 45B
FIG. 45C

BATHROOM FIXTURES AND COMPONENTS

CROSS REFERENCE TO RELATED PATENT APPLICATIONS

The present application in a Divisional of U.S. patent application Ser. No. 15/797,165, filed Oct. 30, 2017 (now U.S. Pat. No. 10,575,685), which claims the benefit of and priority to U.S. Provisional Patent Application No. 62/415,911, filed Nov. 1, 2016. The entire disclosures of U.S. patent application Ser. No. 15/797,165 and U.S. Provisional Patent Application No. 62/415,911 are incorporated herein by reference.

BACKGROUND

The present application relates generally to bathrooms and fixtures and components intended for use within bathroom environments.

SUMMARY

Various embodiments provide for a bathroom module. The bathroom module comprises a shower area, a toilet area, a grooming area, and plumbing inlet lines. The shower area comprises a shower head, a control valve assembly, and a drain. The toilet area comprises a toilet assembly. The toilet area and the shower area are separated from each other by a first wall. The grooming area comprises a sink assembly that comprises a faucet. The grooming area is separated from the shower area and the toilet area by a second wall. The second wall is substantially perpendicular to the first wall. Plumbing inlet lines are disposed within the first wall and the second wall and configured to supply water to the control valve assembly, the shower head, the toilet assembly, and the faucet.

Various other embodiments provide another bathroom module. The bathroom module comprises a shower area, a toilet area, a transition area, a shower area front wall, a shower area side wall, a toilet area front wall, a toilet area side wall, and a grooming area. The shower area comprises a shower head, a control valve assembly, and a drain. The toilet area comprises a toilet assembly. The transition area is disposed between the shower area and the toilet area. The shower area is disposed along a first side of the shower area front wall and a first side of the shower area side wall. The toilet area is disposed along a first side of the toilet area front wall and a first side of the toilet area side wall. The grooming area comprises a sink assembly that comprises a faucet. The grooming area is disposed along a second side of one of the shower area front wall, the shower area side wall, the toilet area front wall, the toilet area side wall.

Another embodiment relates to a bathroom module that includes a shower area that includes a shower head, a control valve assembly, and a drain. The module also includes a toilet area including a toilet assembly and a transition area disposed between the shower area and the toilet area. The module also includes a shower area front wall and a shower area side wall, the shower area disposed along a first side of the shower area front wall and a first side of the shower area side wall. The module also includes a toilet area front wall and a toilet area side wall, the toilet area disposed along a first side of the toilet area front wall and a first side of the toilet area side wall. A grooming area includes a sink assembly that comprises a faucet, and the grooming area is disposed along a second side of at least one of the shower area front wall, the shower area side wall, the toilet area front wall, and the toilet area side wall.

Another embodiment relates to a bathroom module that includes a shower area, a toilet area, and a transition area disposed between the shower area and the toilet area. The module includes a shower area front wall and a shower area side wall, the shower area disposed along a first side of the shower area front wall and a first side of the shower area side wall. The module also includes a toilet area front wall and a toilet area side wall, the toilet area disposed along a first side of the toilet area front wall and a first side of the toilet area side wall. A grooming area is disposed along at a second side of at least one of the shower area front wall, the shower area side wall, the toilet area front wall, and the toilet area side wall.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

The accompanying drawings, which are included to provide further understanding of the concepts discussed herein, are incorporated in and constitute a part of this specification, and illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which the concepts discussed herein may be practiced.

FIGS. 9A-9D are side views of the shower head of FIG. 8 in different positions.

FIGS. 10A-10D are side view of the shower head of FIG. 8 in different positions with an occupant in the shower area.

FIG. 45A is a perspective view of the door of the second bathroom of FIG. 40 in the first position.

FIG. 45B is a perspective view of the door of FIG. 45A moving from the first position to the second position.

FIG. 45C is a perspective view of the door of FIG. 45A moving from the first position to the second position.

FIG. 45D is a perspective view of the door of FIG. 45A moving from the first position to the second position.

FIG. 45E is a perspective view of the door of FIG. 45A moving from the first position to the second position.

FIG. 45F is a perspective view of the door of FIG. 45A in the second position.

FIG. 61A is a perspective view of a sink assembly in the grooming area of FIG. 57A according to one embodiment.

FIG. 61B is a front view of the sink assembly of FIG. 61A.

FIG. 61C is a perspective view of the sink assembly of FIG. 61A.

FIG. 61D is a side view of the sink assembly of FIG. 61A.

FIG. 62A is a perspective view of a sink assembly in the grooming area of FIG. 57A according to another embodiment.

FIG. 62B is a front view of the sink assembly of FIG. 62A.

FIG. 62C is a perspective view of the sink assembly of FIG. 62A.

FIG. 62D is a side view of the sink assembly of FIG. 62A.

FIG. 63A is a top view of a portion of the grooming area of FIG. 57A with an occupant.

FIG. 63B is a top view of the portion of the grooming area of FIG. 63A with one light on.

FIG. 63C is a top view of the portion of the grooming area of FIG. 63A with both lights on.

FIG. 64A is a perspective view of a portion of a mirror of the grooming are of FIG. 57A.

Figure 57A:
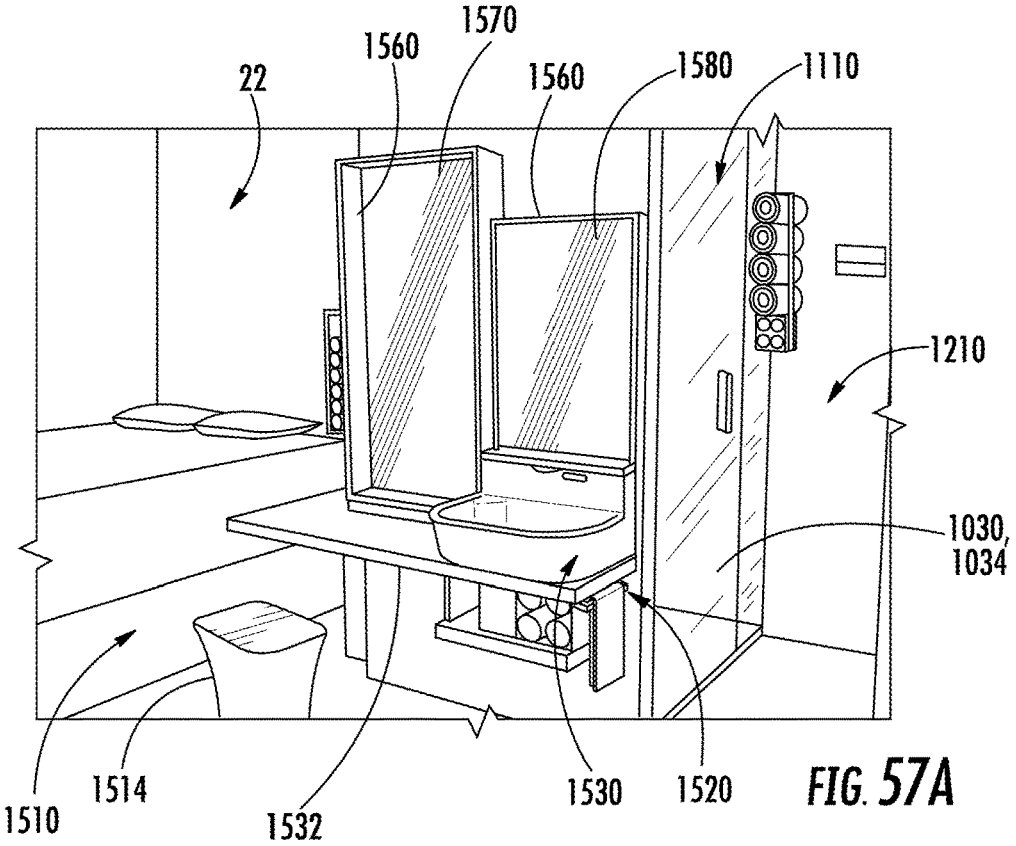
FIG. 57A is a perspective view of a grooming area of the second bathroom of FIG. 40 with the lights turned up.
Figure 64A:
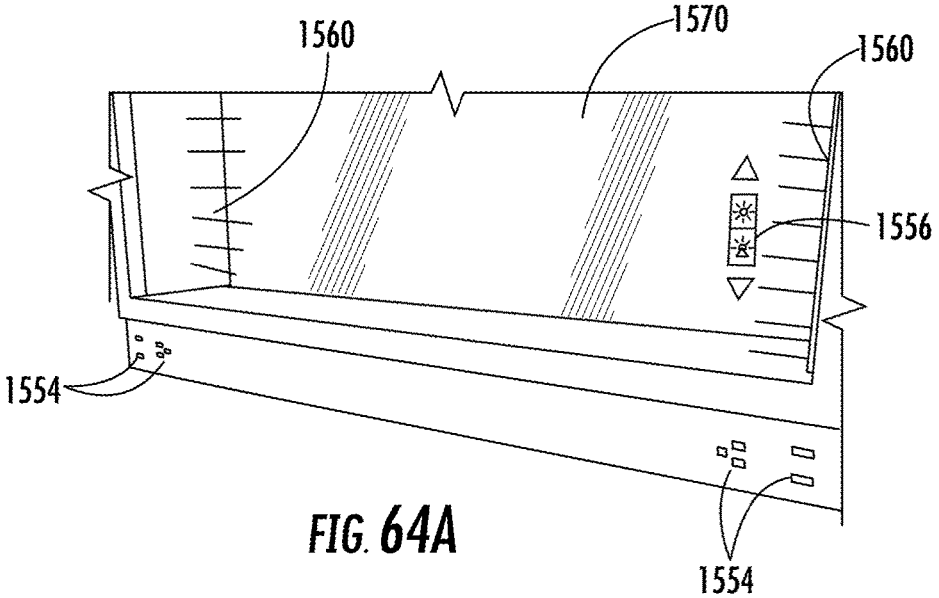
Figure 64B:
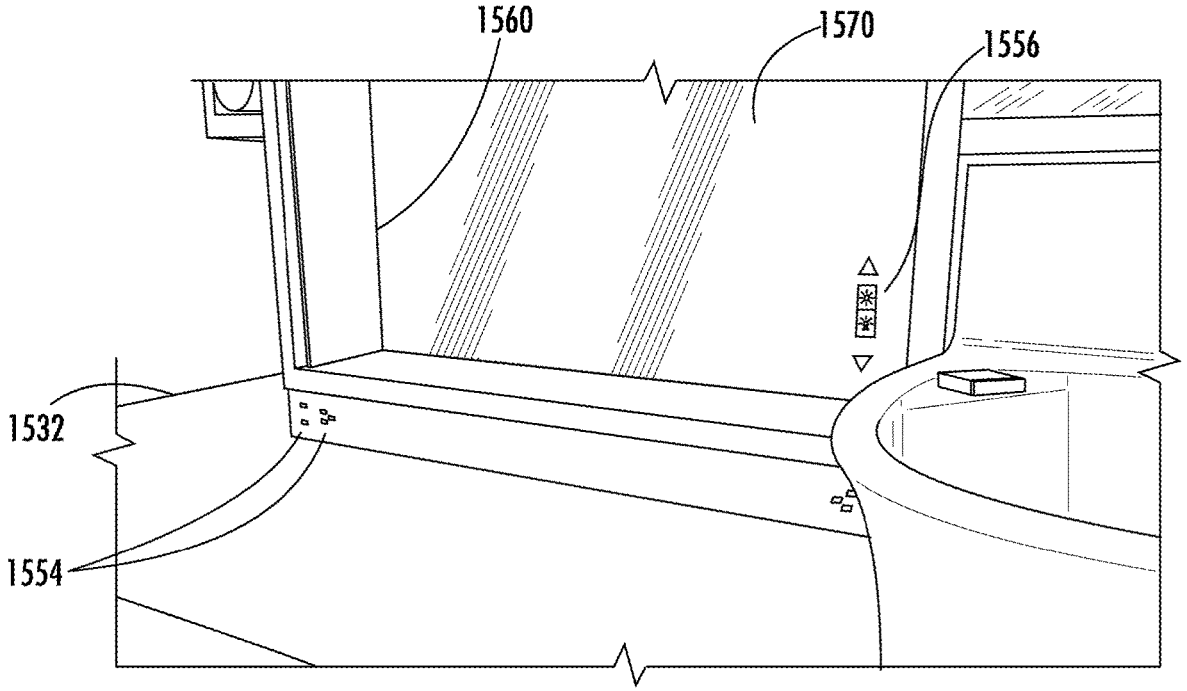

FIG. 64B is a perspective view of a portion of a mirror of the grooming area of FIG. 57A.

Figure 65A:
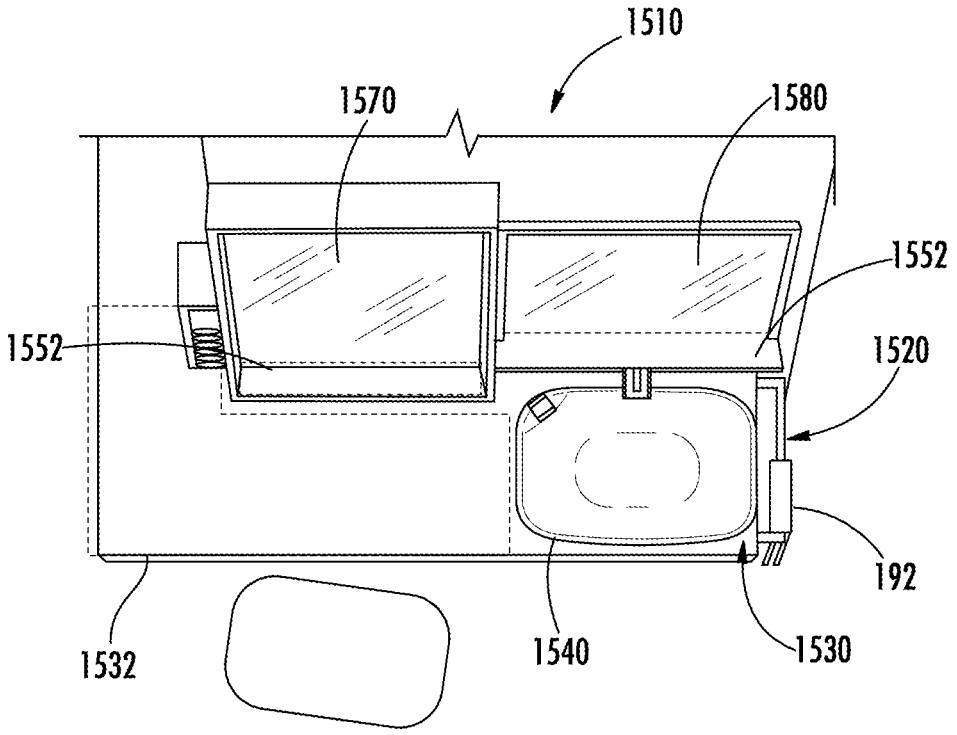

FIG. 65A is a top perspective view of the grooming area of FIG. 57A.

Figure 65B:
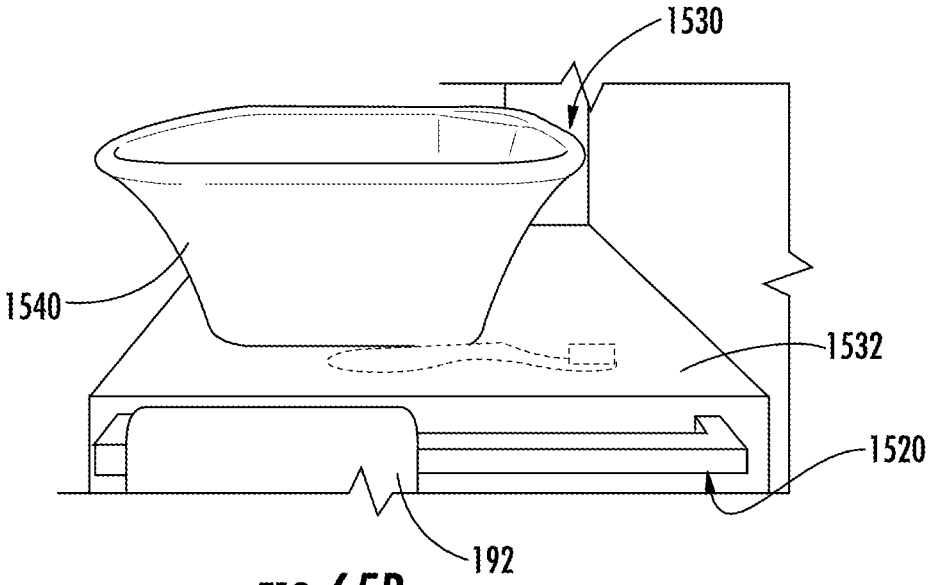

FIG. 65B is a side view of the sink assembly in the grooming area of FIG. 57A.

Figure 65C:
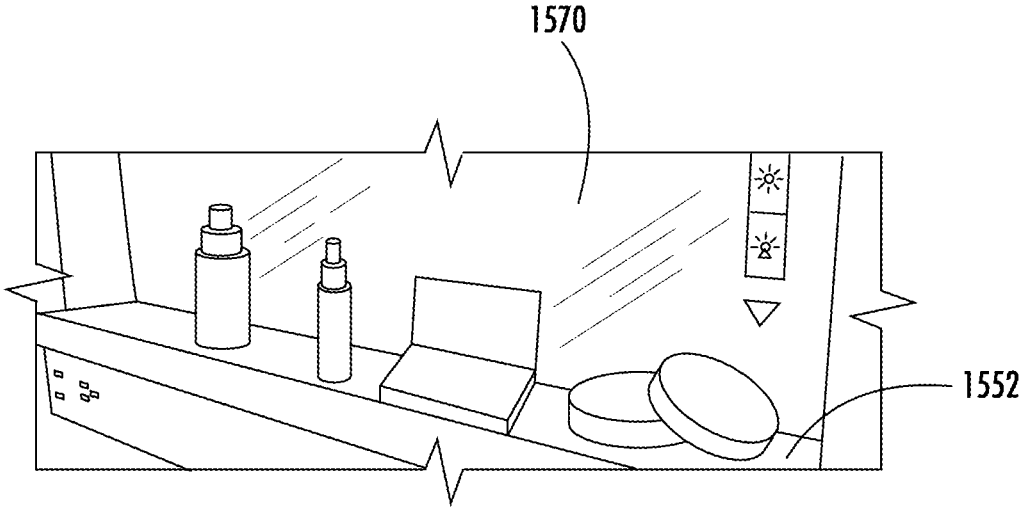

FIG. 65C is a perspective view of a shelf on a mirror in the grooming area of FIG. 57A.

Figure 65D:
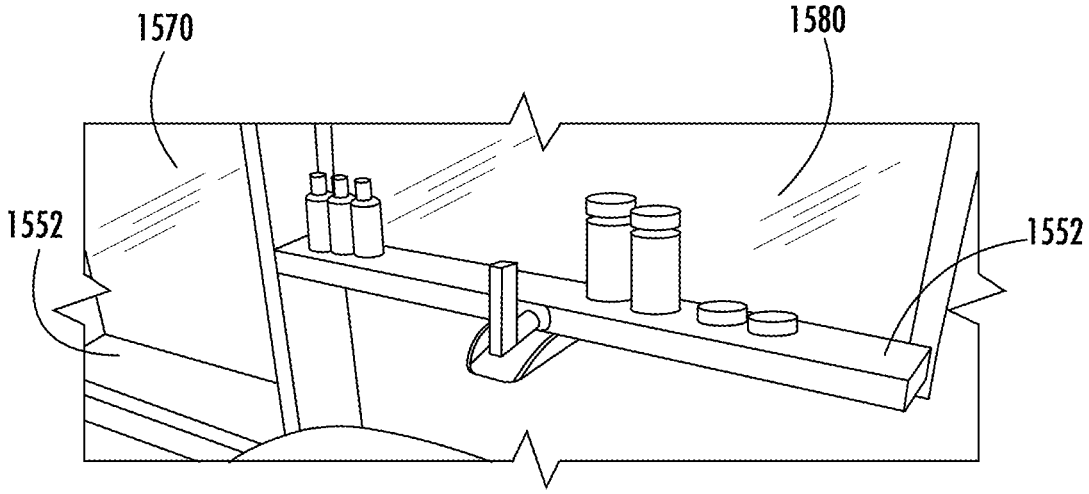

FIG. 65D is a perspective view of another shelf on another mirror in the grooming area of FIG. 57A.

DETAILED DESCRIPTION

Before turning to the figures, which illustrate the various exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to the figures, disclosed herein are bathrooms with various layouts and bathroom fixtures and components (e.g., amenities, products, and fixtures) including, but not limited to, the various layouts and features shown in the first bathroom and the second bathroom, as shown according to exemplary embodiments.

The layout (e.g., the overall design of the bathrooms and the positions or arrangement of each of the bathroom fixtures and components) allows the entire bathroom to work together and provide a continuous "flow" for the user. The various bathroom fixtures and components disclosed herein are designed to cater to the experience of the user and to optimize the user's interaction with the bathroom. Each of the various bathroom fixtures and components are designed to be in harmony with the space (e.g., the spatial layout of the bathroom and the other nearby bathroom fixtures and components) and to take into account the end user activities in order to provide user-centric bathroom solutions.

The various bathroom fixtures and components are designed to be used by a variety of different users (e.g., users of all ages, sizes, and abilities). The various bathroom fixtures and components also take into account the needs within a variety of different locations, such as a hotel or a residence.

The various bathroom fixtures and components are also designed to be easy to clean, look clean, and easy to inspect whether or not they have been cleaned, which may be particularly beneficial for hotel bathrooms that are used by many different people and require frequent cleaning. Since the bathroom fixtures and components are easy to clean, hotel guests are less likely to see that another guest previously was previously using the same bathroom.

The various bathroom fixtures and components and spatial layout may also increase or improve the safety and support, privacy, adaptability (e.g., adaptable to different user needs, preferences, and sizes), and comfort (e.g., spacious, warm, and relaxing, yet efficient) within the bathroom and may be more intuitive and obvious to use and interact with (e.g., no learning curve), even when the bathroom is unfamiliar. The layout of the bathroom fixtures and components may also help the user easily and effortlessly transition between different activities, tasks, or areas within the bathroom.

The bathroom fixtures and components may be positioned and used within a variety of different types of bathrooms, including but not limited to hotel bathrooms (e.g., hospitality), residential bathrooms, or other commercial settings. It is understood that the various bathroom fixtures and components may be used within any non-bathroom applications.

The bathroom spatial layouts, fixtures, and components are designed around and can be used by a variety of different users, including business, leisure, or vacation travelers within a hotel. The bathroom spatial layouts, fixtures, and components may be designed to provide a more enjoyable and intuitive end user experience within the bathroom.

Layout of the First Bathroom

As shown in FIGS. 1A-39D, the first bathroom module or bathroom 20 may include a variety of different bathroom fixtures and components and features. A layout of the first bathroom 20 (e.g., the "privately open bathroom") is shown in FIGS. 1A-5B. The first bathroom 20 may connect to, for example, a room 22 (such a sleeping space or bedroom in a hotel or a home).

The first bathroom 20 includes at least three spaces or areas: a shower space or area 110, a toilet space or area 310, and a grooming space or area 510, as described further herein. The shower area 110 may include (among other features) a shower valve assembly 120 and a shower head assembly 140 (that comprises a shower head 148), a drain 156, and an area for the occupant to use the shower valve assembly 120 and the shower head assembly 140. The toilet area 310 may include (among other features) a toilet assembly 320 and an area for the occupant to use the toilet assembly 320. The grooming area 510 may include (among other features) a sink assembly 530 (that comprises a faucet 542) and other grooming area accessories, including but not limited to a towel bar assembly 520, cabinets, drawers, a storage area 550, electrical outlets 554, lights 560, mirrors 570, 580, a storage space 590, and seating 514 (e.g., a stool, a seat, or a chair) and designated space for the occupant to use these features.

As shown in FIGS. 1A-3A, the grooming area 510 may include additional storage areas 516 to allow the occupant to access and store items, such as luggage and other amenities (such as coffee and a coffee maker), within the grooming area 510 of the first bathroom 20. This allows the occupant to access everything needed while in the first bathroom 20 and reduces the need to leave the first bathroom 20 during use to obtain necessary items from the room 22, thus providing a set-apart space from the room 22 for the occupant to get ready in.

Figure 3A:
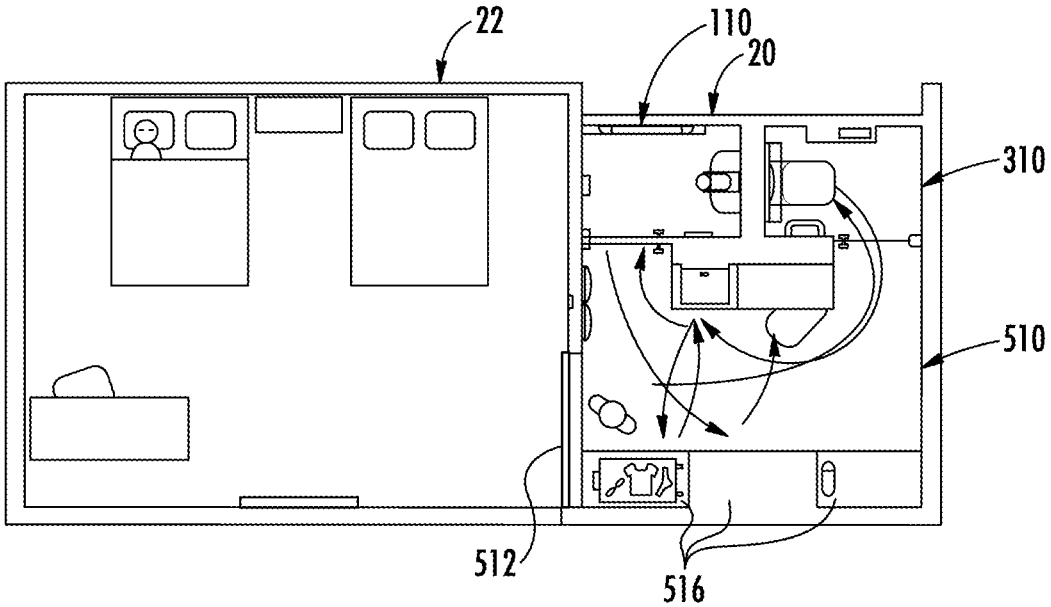
FIG. 3A is a top view of the layout of FIG. 1A with movement lines of an occupant in the first bathroom.
Figure 3B:
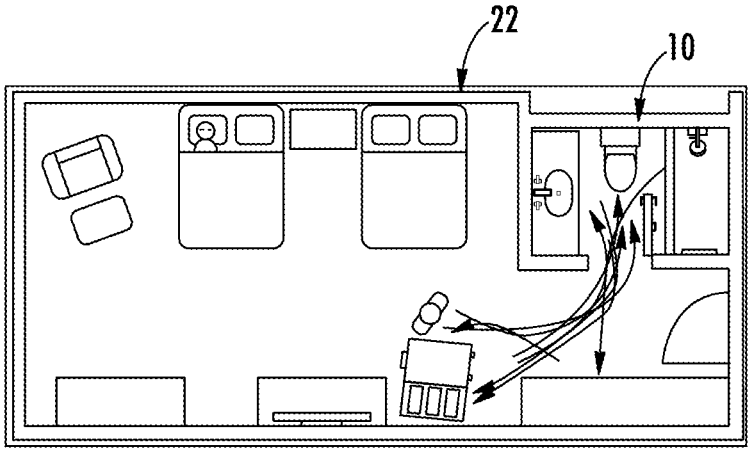
FIG. 3B PRIOR ART
FIG. 3B is a top view of a layout of a conventional bathroom and room with movement lines of an occupant in the conventional bathroom and room.

As shown in FIG. 3A, a first occupant can move around the first bathroom 20 without disturbing a second occupant in the room 22. The occupant may not have to enter into the room 22 (which may wake or disturb the second occupant) while using the first bathroom 20 since their items can be stored within the additional storage areas 516 of the grooming area 510 of the first bathroom 20. Accordingly, the first occupant still has access to their luggage within the grooming area 510 without having to go back into the room 22. Furthermore, by closing the grooming area door 512, the first occupant has privacy from the room 22. In a hotel, this may be particularly beneficial since the second occupant may want to rest or sleep undisturbed within the room 22 (in the quiet and with the lights off, for example) while the first occupant is using the first bathroom 20. In conventional bathrooms 10 (as shown, for example, in FIG. 3B), however, the first occupant may have to move between the bathroom 10 and the room 22 (due to the layout of the bathroom 10) while getting ready, which may be both inconvenient and inefficient and may further disturb the second occupant.

Figure 1A:
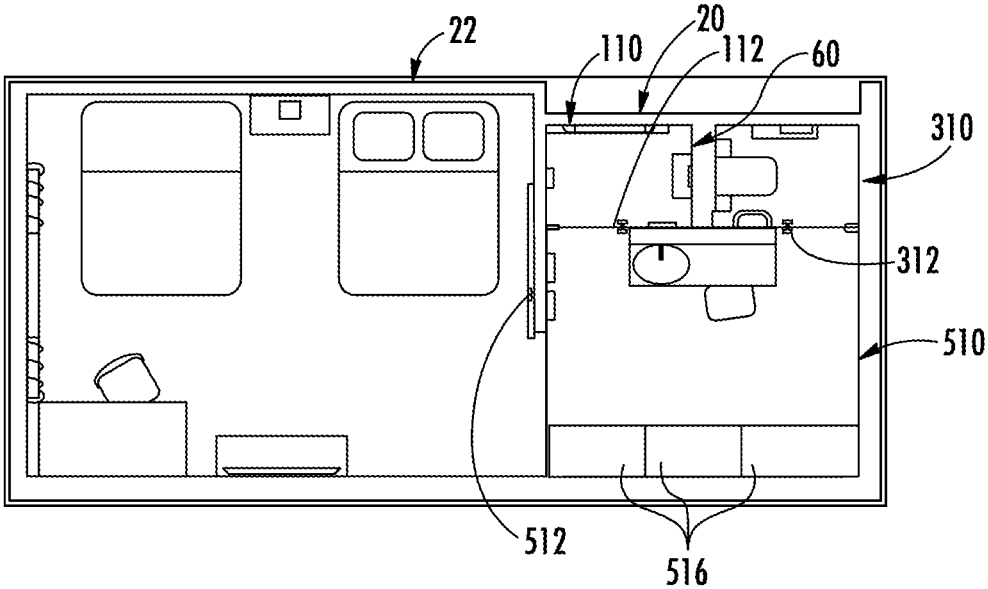
FIG. 1A is a top view of a layout of a first bathroom and a room with a grooming area door in an open position.
Figure 1B:
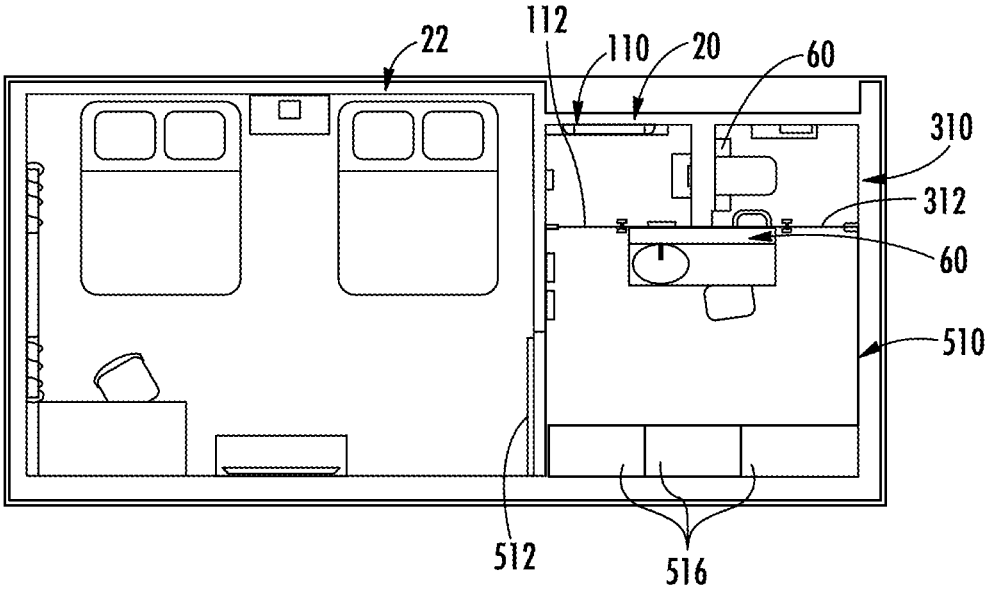
FIG. 1B is a top view of the layout of FIG. 1A with the grooming area door in a closed position.
Figure 2:
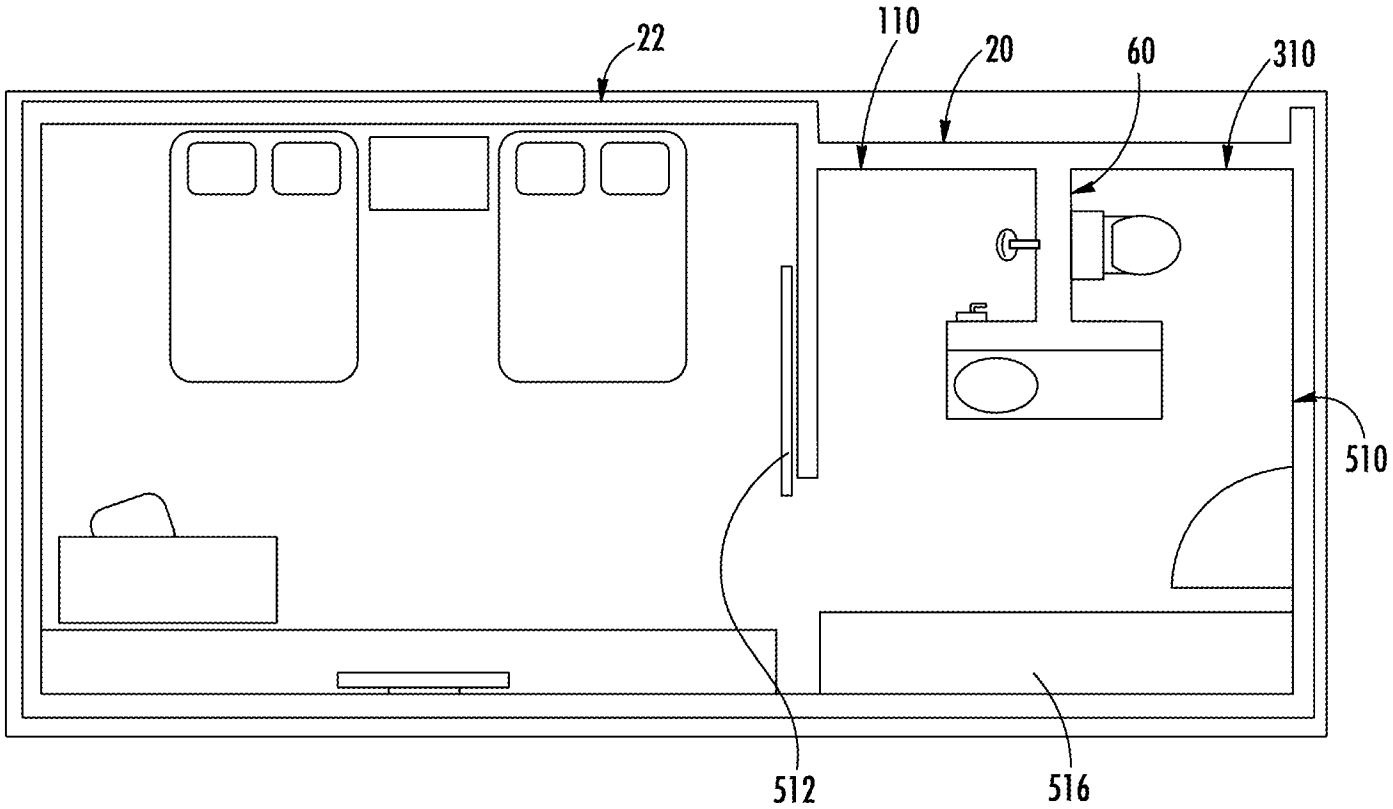
FIG. 2 is a top schematic view of the layout of the first bathroom of FIG. 1A and the room.
Figure 4A:
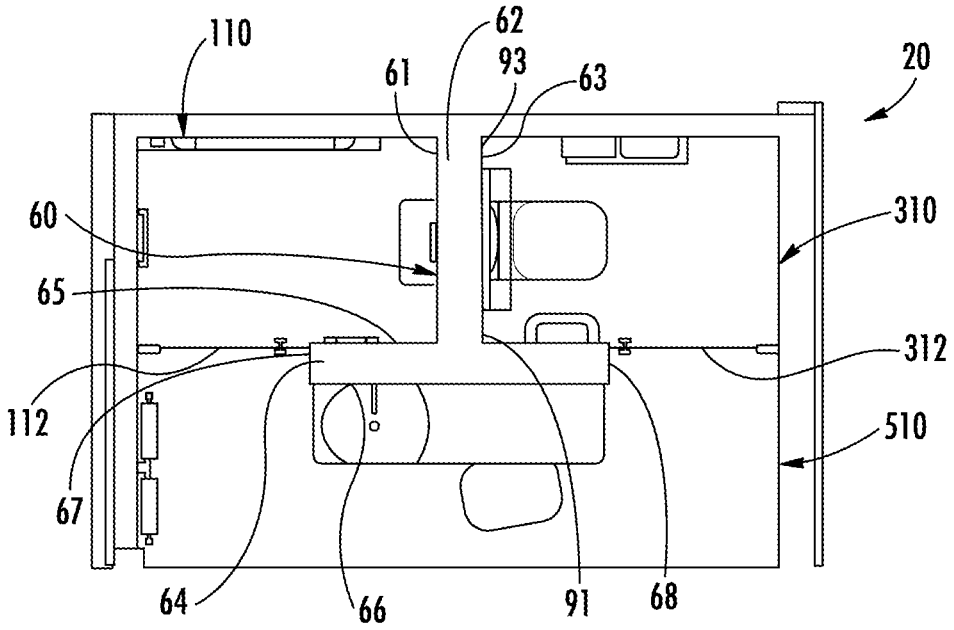
FIG. 4A is a top view of the first bathroom of FIG. 1A.
Figure 4B:
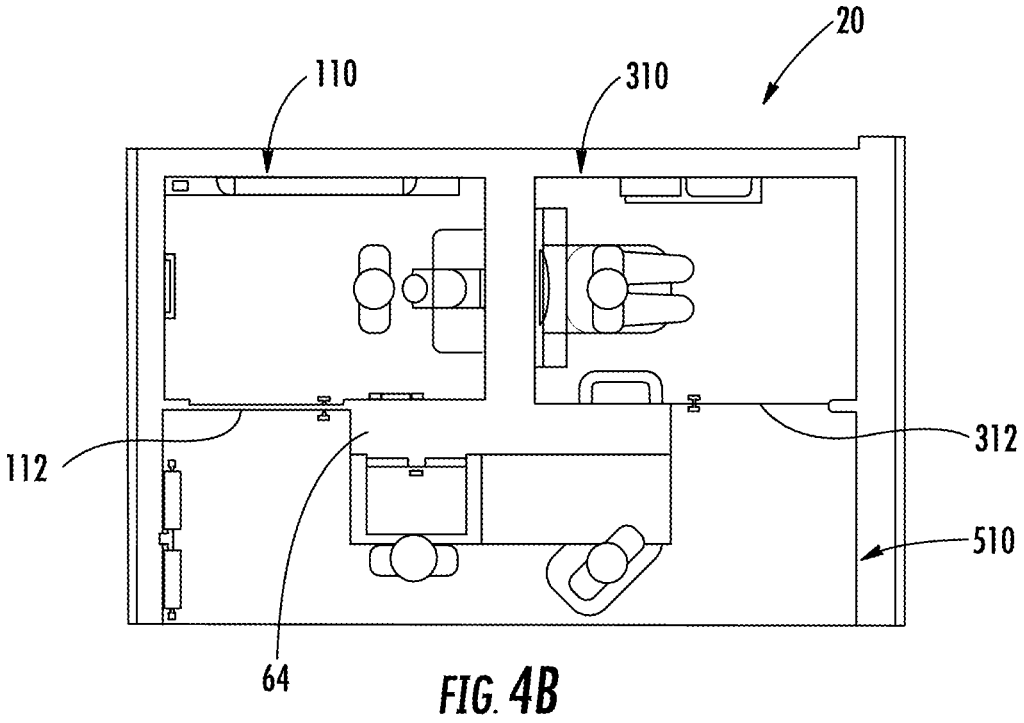
FIG. 4B is a top view of the first bathroom of FIG. 1A with occupants.

In order to provide privacy between the shower area 110, the toilet area 310, the grooming area 510, and the room 22, the first bathroom 20 may include various doors 112, 312, 512 that divide and separate each of the areas or rooms, as shown in FIGS. 1A-1B. For example, as shown in FIGS. 4A-4B, the first or shower area door 112 may be positioned between the grooming area 510 and the shower area 110 to provide access to the shower area 110 from the grooming area 510 and the second or toilet area door 312 may be positioned between the grooming area 510 and the toilet area 310 to provide access to the toilet area 310 from the grooming area 510. The shower area door 112 and the toilet area door 312 may each be movable between an open position and a closed position (as shown, for example, in FIGS. 6A-6B and 17-18).

As shown in FIG. 4A, the shower area door 112 is positioned within a first side of the grooming area 510. The shower area door 112 is movably attached to a wall across from a first end 67 of the second wall 64. In the closed position, the shower area door 112 is substantially parallel to the second wall 64 and an end of the shower area door 112 directly abuts or is very close to the first end 67 of the second wall 64. The toilet area door 312 is positioned within a second side of the grooming area 510. The toilet area door 312 is movably attached to a wall across from a second end 68 of the second wall 64. In the closed position, the toilet area door 312 is substantially parallel to the second wall 64 and an end of the toilet area door 312 directly abuts or is very close to the second end 68 of the second wall 64. The first end 67 and the second end 68 of the second wall 64 are opposite each other along the length of the second wall 64.

As shown in FIG. 1A-1B, the third or grooming area door 512 may be positioned between the grooming area 510 and the room 22 to provide access to the grooming area 510 from an area outside of the first bathroom 20 (e.g., the room 22) and may be movable between an open position (as shown in FIG. 1A) and a closed position (as shown in FIG. 1B). Each of the doors 112, 312, 512 may be a variety of different type of doors, such as a hinged door or a sliding door. The doors 112, 312, 512 may move or pivot in either direction if the doors 112, 312, 512 are hinged doors.

As shown in FIG. 4B, the layout of the first bathroom 20 (which includes the doors 112, 312, 512) provides privacy and personal space for each of the grooming area 510, the toilet area 310, and the shower area 110, even if they are simultaneously being used. For example, the enclosed toilet area 310 conceals sights, smells, and sounds and the enclosed shower area 110 provides visual privacy and contains humidity. Accordingly, multiple occupants may simultaneously use each of the grooming area 510, the toilet area 310, and the shower area 110 without invading each other's personal space and privacy. Furthermore, the toilet assembly 320 is no longer positioned in a central area within the first bathroom 20 (compared to traditional bathrooms) in order to provide more privacy and a layout that is easier for the user to navigate. As shown in FIG. 3A, multiple occupants may also simultaneously use the first bathroom 20 and the room 22 without disturbing each other.

According to one embodiment, the room 22 may be approximately 368 feet$^2$ and the first bathroom 20 may be approximately 75 feet$^2$.

According to one embodiment, the first bathroom 20 is a prefabricated as a transportable bathroom module that can be used within a variety of different spaces and next to a variety of different rooms.

Divider Wall Assembly

As shown in FIGS. 4A-5B, the grooming area 510, the toilet area 310, and the shower area 110 may be separated or divided by a divider wall assembly 60. The divider wall assembly 60 may be approximately in the shape of a "T," with a first wall 62 substantially perpendicular to a second wall 64. As shown in FIG. 4A, the first end 91 of the first wall 62 intersects or abuts a first side 65 of the second wall 64 in approximately the middle of the length of the second wall 64, which creates the "T" shape of the divider wall assembly 60.

The second end 93 of the first wall 62 may be bolted to another wall (such as a main wall that may be substantially perpendicular to the first wall 62, and therefore substantially parallel to the second wall 64). Accordingly, the divider wall assembly 60 may be easily installed into the first bathroom 20 by attaching to the main wall and connecting to the plumbing and/or electricity within the main wall. The first end 91 and the second end 93 of the first wall 62 are opposite each other along the length of the first wall 62.

As shown in FIG. 4A, the first wall 62 separates the toilet area 310 and the shower area 110 from each other. According to one embodiment, the shower area 110 is on a first side 61 of the first wall 62 and the toilet area 310 is on a second side 63 of the first wall 62. The first side 61 and the second side 63 are on opposite sides from each other on the first wall 62.

Additionally, the second wall 64 separates the grooming area 510 from the toilet area 310 and the shower area 110. According to one embodiment, a first side 65 of the second wall 64 directly abuts the first end 91 of the first wall 62. The shower area 110 and the toilet area 310 are positioned along the first side 65 of the second wall 64 and the grooming area 510 is positioned along the second side 66 of the second wall 64. Accordingly, the sink assembly 530, the storage area 550, and the mirrors 570, 580 extend along the second side 66 of the second wall 64. The first side 65 and the second side 66 are on opposite sides from each other on the second wall 64.

Figure 5A:
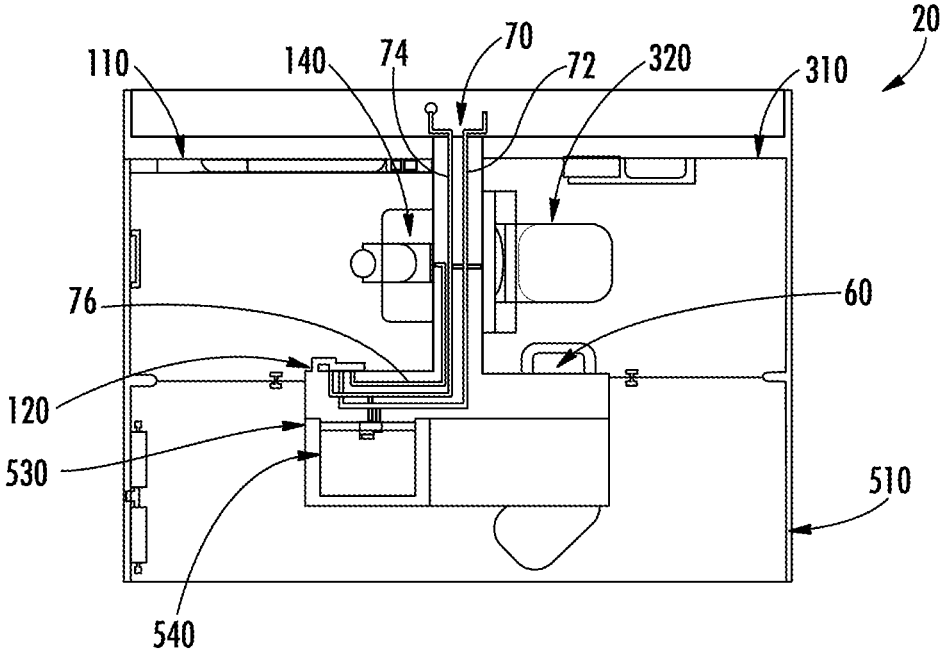
FIG. 5A is a top view of the inlet plumbing of the first bathroom of FIG. 1A.
Figure 5B:
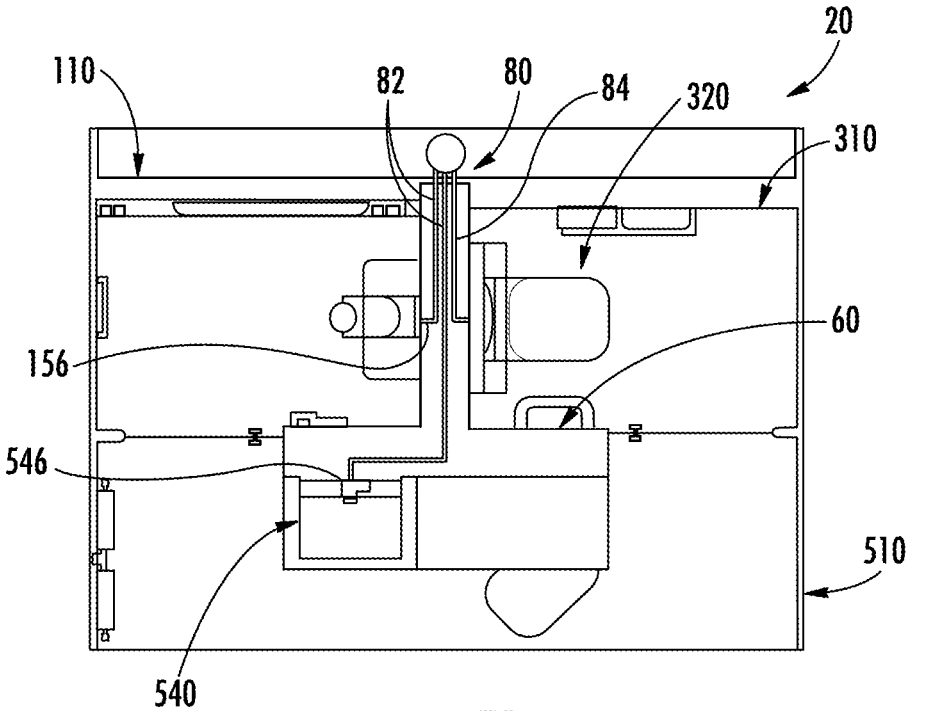
FIG. 5B is a top view of the drainage plumbing of the first bathroom of FIG. 1A.

As shown in FIGS. 5A-5B, the divider wall assembly 60 includes interior or back-end plumbing or plumbing pipes or lines extending through the walls and connecting to external plumbing to easily and seamlessly integrate with various appliances or fixtures within the first bathroom 20 by, for example, providing water to and removing water or waste from the sink 540, the toilet assembly 320, and the shower area 110. The plumbing is a part of the architecture of the divider wall assembly 60. For example, the divider wall assembly 60 includes water inlet plumbing 70 (as shown in FIG. 5A) and drainage plumbing 80 (as shown in FIG. 5B). The divider wall assembly 60 may also include electricity lines to provide power to, for example, various lights 560 and/or power outlets 554.

As shown in FIG. 5A, the water inlet plumbing 70 comprises plumbing inlet lines disposed within and extending through the divider wall assembly 60 (i.e., disposed within the first wall 62 and the second wall 64). The plumbing inlet lines lead to and are configured to supply water to the shower valve assembly 120, the shower head assembly 140, the toilet assembly 320, and the faucet 542 of the sink assembly 530. Accordingly, the plumbing inlet lines include a hot water line 72, a cold water line 74, and a connector line 76. The hot water line 72 and the cold water line 74 provide hot water and cold water, respectively, to the first bathroom 20 and the connector line 76 fluidly connects the shower valve assembly 120 to the shower head 148 of the shower head assembly 140. Specifically, the cold water line 74 leads to and provides cold water for the toilet assembly 320, the sink assembly 530, and the shower valve assembly 120. The hot water line 72 leads to and provides hot water for the sink assembly 530 and the shower valve assembly 120. In order to control the temperature of the water being expelled by the shower head assembly 140 with the shower valve assembly 120, the cold water line 74 and the hot water line 72 lead directly to and provide cold and hot water, respectively, directly to the shower valve assembly 120. The shower valve assembly 120 mixes the cold water and the hot water according to the user's desired water temperature and outputs the mixed water to the connector line 76. The connector line 76 then directs the mixed water from the shower valve assembly 120 to the shower head 148 of the shower head assembly 140, according to one embodiment. According to one embodiment, in order to be accessible to the plumbing inlet lines, the shower valve assembly 120 is positioned along the first side 65 of the second wall 64, the shower head assembly 140 is positioned along the first side 61 of the first wall 62, the toilet assembly 320 is positioned along the second side 63 of the first wall 62, and the sink assembly 530 is positioned along the second side 66 of the second wall 64.

As shown in FIG. 5B, the evacuation or drainage plumbing 80 comprises plumbing drainage lines that remove or drain water and waste away from the first bathroom 20 (e.g., from the shower area 110, the toilet area 310, and the grooming area 510). The plumbing drainage lines comprise water outlet lines 82 and a sewage line 84. The water outlet lines 82 connect to the drain 546 in the sink 540 and the drain 156 in the shower area 110 to allow water and waste to be drained from the sink 540 and the shower area 110. The sewage line 84 connects to the toilet assembly 320 and allows waste to be removed from the toilet assembly 320. The plumbing drainage lines may be disposed within the first wall 62 and the second wall 64 and/or may be positioned beneath or below the first wall 62 and the second wall 64.

The various plumbing features are ready to be fitted to various fixtures or appliances (such as the sink 540, the drain 546, the toilet assembly 320, the shower valve assembly 120, the shower head assembly 140, and the drain 156) and accordingly may include connectors with a universal fit.

Shower Area #1

As shown in FIGS. 6A-18, the shower area 110 is shown in greater detail. The shower area 110 may include (among other features) a shower valve assembly 120, a shower head assembly 140, a perch 150, a drain 156, a grab bar 160, and a foot ledge/doorstop 180. A storage space 590 may be positioned just outside of the shower area 110.

Figure 6A:
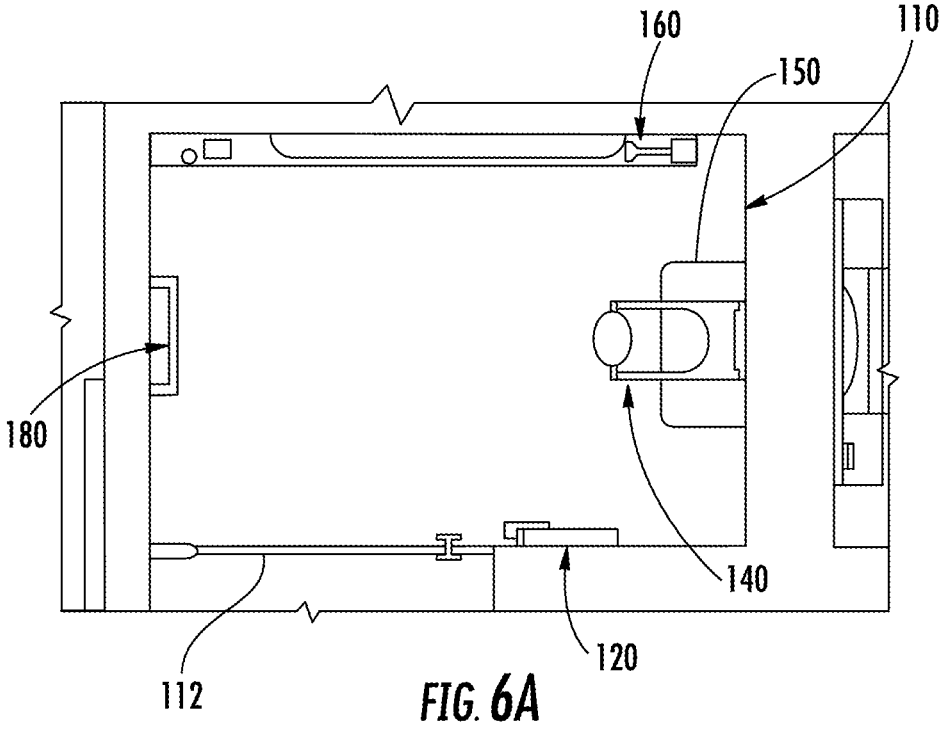
FIG. 6A is a top view of a shower area of the first bathroom of FIG. 1A with the shower area door in a closed position.
Figure 6B:
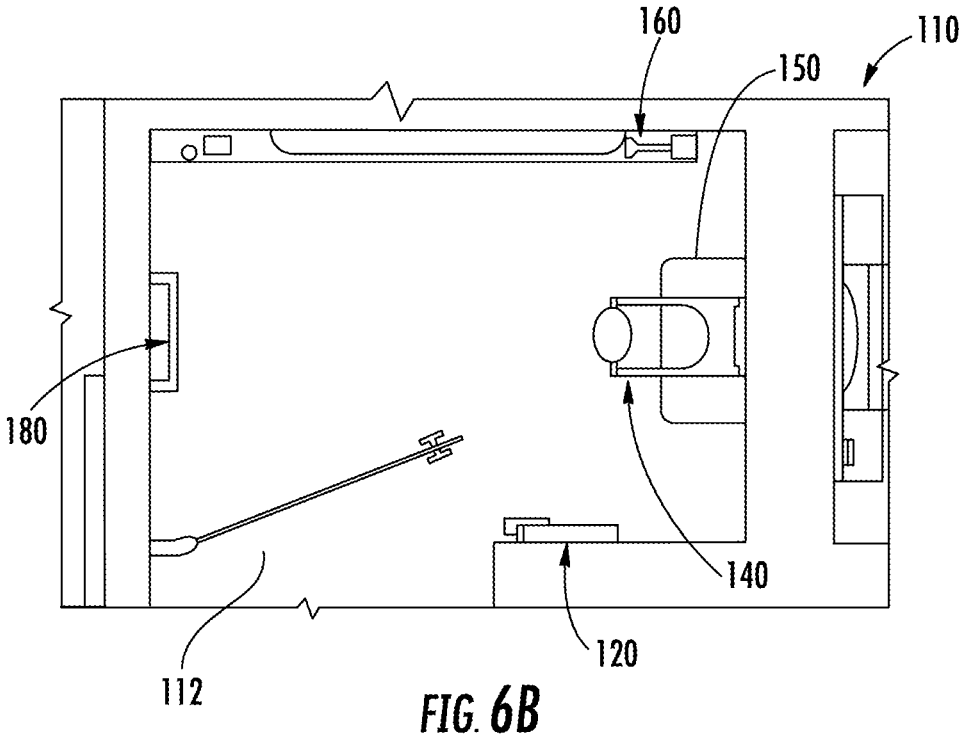
FIG. 6B is a top view of the shower area of FIG. 6A with the shower area door in an open position.

The entrance and exit to the shower area 110 may include a door 112 that can be opened (as shown in FIG. 6B) for the user to access inside the shower area 110 or closed (as shown in FIG. 6A) to contain humidity, prevent water leakage, and for privacy from the rest of the first bathroom 20.

Shower Valve Assembly

Figure 7A:
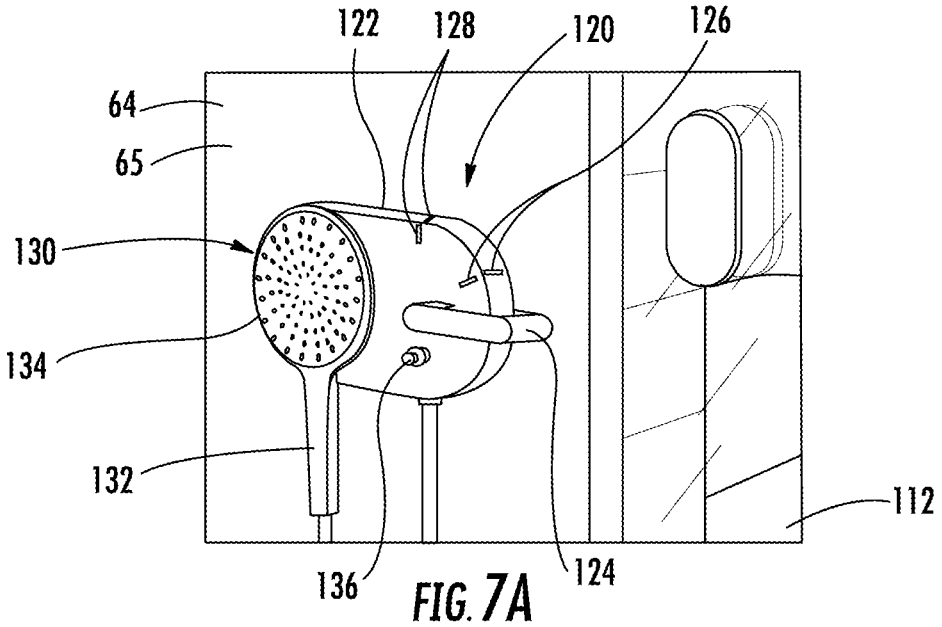
FIG. 7A is a perspective view of a shower valve assembly within the shower area of FIG. 6A.
Figure 7B:
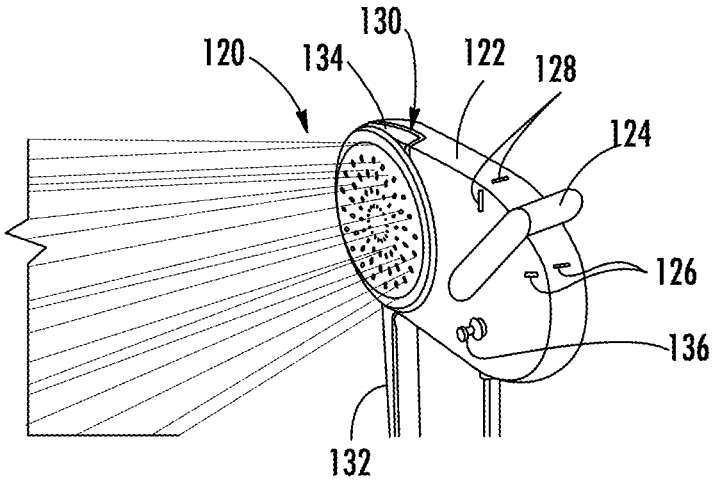
FIG. 7B is a perspective view of the shower valve assembly of FIG. 7A with water being expelled from the hand shower.
Figure 7C:
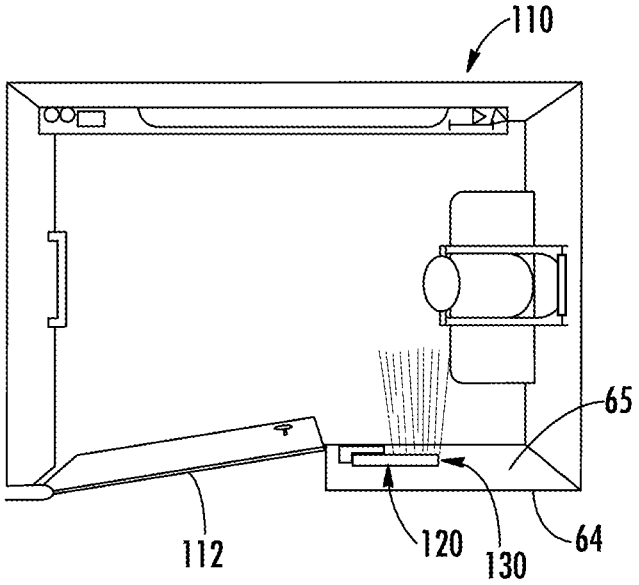
FIG. 7C is a top view of the shower area of FIG. 6A with water being expelled from the hand shower.

As shown in FIGS. 7A-7C, a shower control valve assembly 120 may be used within the shower area 110 in order to control the water flowing from the hand shower 130 and/or the shower head assembly 140. For example, the shower valve assembly 120 controls whether or not water flows through the hand shower 130 and/or the shower head assembly 140 and the temperature of the water.

The shower valve assembly 120 may include a base 122 that is statically attached to the first side 65 of the second wall 64 of the shower area 110 and holds various components of the shower valve assembly 120. The base 122 can be attached to the second wall 64 through a variety of different mechanisms, including but not limited to magnets or bolts.

As shown in FIG. 7C, the base 122 (and therefore the rest of the components of the shower valve assembly 120) may be positioned near the shower area door 112 and thus near the entrance to the shower area 110. For example, the base 122 may be positioned along the first side 65 of the second wall 64 (near the first end 67 of the second wall 64). Accordingly, the user may easily access and control the shower valve assembly 120 by slightly opening the shower area door 112 of the shower area 110 (as shown in FIG. 7C) and reaching through the gap between the door 112 and the second wall 64 of the shower area 110. If the door 112 is on a hinge, the door 112 may be slightly opened into the shower area 110. Accordingly, the user does not have to enter into the shower area 110 to control the shower valve assembly 120 and therefore does not have to get wet while controlling the shower valve assembly 120 or while the water is warming up.

As shown in FIGS. 7A-7B, the shower valve assembly 120 also includes a handle, valve control, or lever 124 that is movably or rotatably attached to the base 122 of the shower valve assembly 120 and may be used to control the water in the shower area 110. By moving the lever 124 relative to the base 122, the hand shower 130 and/or the shower head assembly 140 are turned on and water is released (or turned off and the water is stopped). According to one embodiment, the flow rate of the water is uniform or consistent when the shower valve assembly 120 is turned on, regardless of the position of the lever 124 or the temperature of the water. However, it is understood that the shower valve assembly 120 could also control the flow rate of the water.

As shown in FIGS. 7A-7B, the lever 124 is rotatable a certain number of degrees relative to the base 122. The lever 124 may optionally be rotatable beyond at least one of a cold temperature indicator 126 or a hot temperature indicator 128 in order to turn on or off the water flow. Additionally, the lever 124 may be positioned and movable along the side and/or the top of the base 122 and extend along the front of the base 122 in order to be easily accessible to the user from a variety of different positions.

By moving the lever 124 relative to the base 122, the temperature of the water can be controlled. As shown in FIGS. 7A-7B, the lever 124 can be moved between the cold temperature indicator 126 and the hot temperature indicator 128, each of which are statically located on the base 122. By moving the lever 124 closer to or further from the cold temperature indicator 126 or the hot temperature indicator 128, the temperature of the output water is changed. For example, if the lever 124 is closer to the cold temperature indicator 126, the water is relatively colder. Conversely, if the lever 124 is closer to the hot temperature indicator 128, the water is relatively hotter.

According to one embodiment, the cold temperature indicator 126 may be a blue marking and the hot temperature indicator 128 may be a red marking. Both the cold temperature indicator 126 and the hot temperature indicator 128 may be immediately visible from the entrance to the shower area 110 to allow the user to easily use and control the shower valve assembly 120 without being in the shower area 110. The cold temperature indicator 126 and the hot temperature indicator 128 may be positioned on both the top and side of the base 122, as well as the front of the base 122 in order to be visible from both the entrance to the shower area 110 as well as from within the shower area 110.

The shower valve assembly 120 may also include a mixer valve to combine and mix the hot water and the cold water from the hot water line 72 and the cold water line 74, respectively.

The shower valve assembly 120 may also include and hold a hand shower 130 that sprays water and is removably attachable to the base 122. For example, the user may use the hand shower 130 and then secure the hand shower 130 back onto the base 122 for storage. The base 122 may secure the hand shower 130 such that, when turned on, the hand shower 130 sprays water approximately perpendicularly from the second wall 64 of the shower area 110, as shown in FIGS. 7B-7C. When the shower valve assembly 120 is first turned on, the water will first spray out of the hand shower 130, allowing the user to first test the water before entering into the shower area 110 and getting wet (for example, the user may test the temperature of the water with their hand through the entrance to the shower area 110).

The hand shower 130 may include a handle portion 132 and a spraying portion 134. The handle portion 132 may provide an area for the user to grasp while using the hand shower 130 and the spraying portion 134 may provide an area for the water to spray or be expelled from. As shown in FIGS. 7A-7B, the base 122 may hold or secure the hand shower 130 by the spraying portion 134 of the hand shower 130. However, it is understood that the base 122 may hold the handle portion 132 of the hand shower 130. The hand shower 130 can be secured to the base 122 through a variety of different mechanisms, including, but not limited to, magnets, a frictional fit, snaps, a ledge, or clips.

The hand shower 130 and the lever 124 are positioned with each other as one unit on the base 122. Since the hand shower 130 is positioned on the base 122 of the shower valve assembly 120, and is therefore near the lever 124 of the shower valve assembly 120, the user has direct access to the water at the point of control (e.g., the lever 124). Accordingly, the user can easily test or feel the actual temperature of the water from the hand shower 130 and adjust the lever 124 accordingly without moving their hand far.

The shower valve assembly 120 may also include a knob, switch, or diverter 136 to change whether the water is being expelled through the hand shower 130 or through the shower head assembly 140. The diverter 136 may be pushed, pulled, or rotated according to various embodiments in order to change where the water is being diverted to. As described further herein, the connector line 76 may fluidly connect the hand shower 130 of the shower valve assembly 120 and the shower head assembly 140 such that the same temperature water is expelled through each of the hand shower 130 and the shower head assembly 140.

It is understood that the shower valve assembly 120 may not include the hand shower 130 and instead may only control the shower head assembly 140. It is also understood that the shower area 110 may not include the shower head assembly 140 and instead the shower valve assembly 120 may only control the hand shower 130.

The shower valve assembly 120 can be designed to be easily controlled by a right-handed person or a left-handed person, depending on the desired configuration.

Shower Head Assembly

As shown in FIGS. 8-10D, the shower area 110 may include a shower head assembly 140 that can be adjusted or articulated to accommodate different user heights or desired angles of water spray. The shower head assembly 140 allows the user to have a wide range of choices as to where the water spray is being directed. For example, both the height and the angle of the shower head 148 of the shower head assembly 140 can be adjusted independently to change where the water spray is expelled from and where the water spray is directed.

As shown in FIGS. 9A-10D, the shower head assembly 140 may be adjusted to or positioned at multiple or a range of different heights and angles according to the user's preference. Accordingly, the shower head assembly 140 can accommodate users that are relatively taller (as shown in FIGS. 9A and 10A) or shorter (as shown in FIGS. 9B and 10B) and users that are standing up (as shown in FIGS. 10A-10B) or sitting down (as shown in FIGS. 10C-10D). Accordingly, the user does not have to stand up and can instead sit down (on the perch 150, for example) and relax while still using and getting wet from the shower head assembly 140.

The angle of water spray can also be adjusted in order to attain, for example, the feeling of a rainhead (as shown in FIGS. 9C and 10C) or body spray (as shown in FIGS. 9D and 10D). The user can also position and angle the shower head assembly 140 such that their hair does not get wet while showering (if, for example, they do not want to wash or wet their hair). By adjusting the shower head assembly 140, the user can position the water at different angles and heights to create a more luxurious shower experience, giving the feeling that a hydrorail, a rain head, and a body spray have been integrated into one product.

Figure 8:
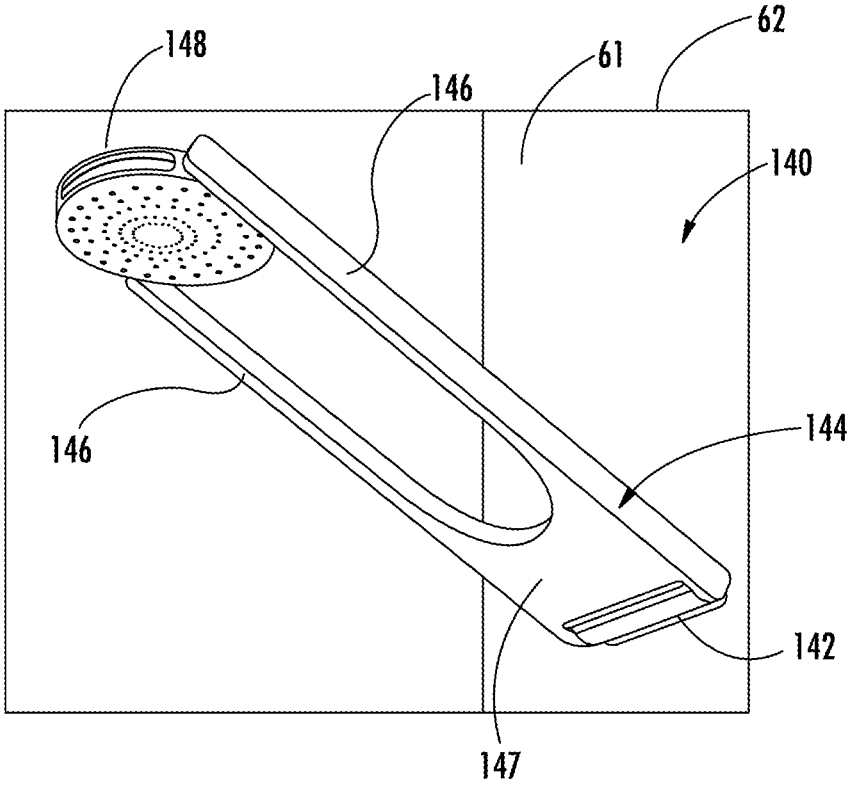
FIG. 8 is a perspective view of a shower head within the shower area of FIG. 6A.

As shown in FIG. 8, the shower head assembly 140 is attached to the first wall 62 through a hinge 142. The hinge 142 is statically attached to the first side 61 of the first wall 62.

The shower head assembly 140 may include a movable base, mount, or arm 144 that is pivotably attached to the first side 61 of the first wall 62 through the hinge 142 in order to change or adjust the height of the shower head 148. The arm 144 may be rotated or articulated to be almost substantially parallel to the first wall 62 such that the shower head 148 is either above or below the hinge 142. The position of the arm 144 relative to the hinge 142 or the first wall 62 can be adjusted regardless or independent of the angle of the shower head 148 relative to the arm 144.

The arm 144 may have two extensions 146 that each extend from a base 147 of the arm 144. According to one embodiment, the base 147 is directly attached to the hinge 142 and the extensions 146 extend substantially parallel to each other from the base 147 and attach to either side of the shower head 148. Accordingly, the water may flow through the hinge 142, into at least a portion of the base 147, through one or two of the extensions 146, and through the shower head 148.

The shower head 148 is pivotably or rotatably attached to the arm 144 in order to allow the angle or orientation of the water spray to be adjusted. For example, the shower head 148 is movably attached on either side to the two extensions 146. The angle of the shower head 148 relative to the arm 144 can be adjusted regardless or independent of the position of the arm 144 relative to the hinge 142 or the first wall 62. While the shower head 148 is illustrated as having nozzles only on one surface of the shower head, it should be understood that according to other exemplary embodiments, a shower head may have nozzles on two or more surfaces of the shower head to provide different shower experience (e.g., the Flipside® Shower Head offered by Kohler Co. of Kohler, Wis.) or may have a control mechanism that allow a user to select between a number of different spray modes for the shower head.

Perch and Drain

Figure 11A:
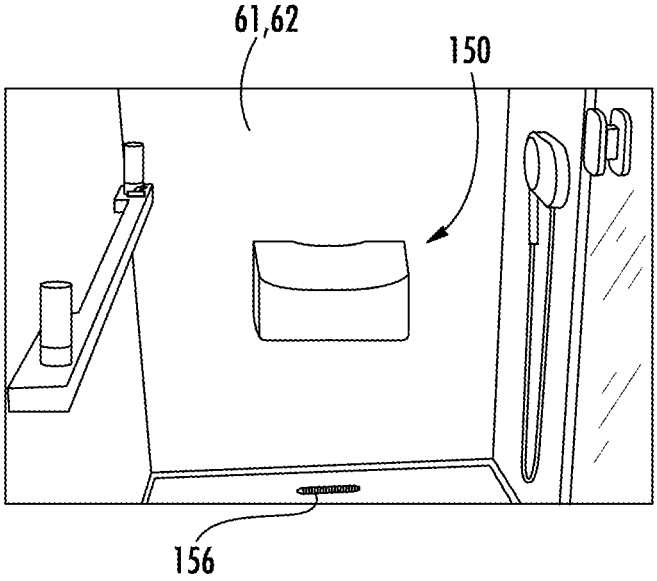
FIG. 11A is a perspective view of a perch and drain within the shower area of FIG. 6A according to one embodiment.
Figure 11B:
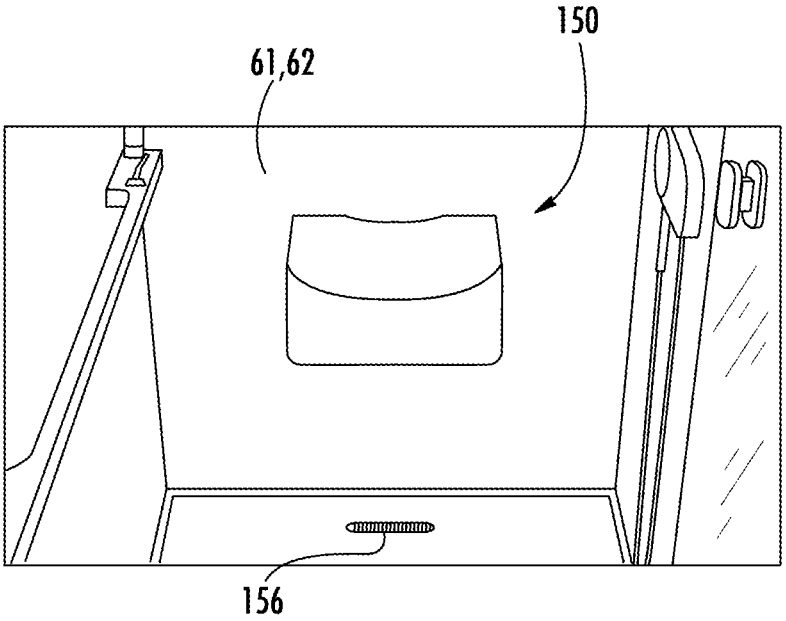
FIG. 11B is a perspective view of the perch and drain of FIG. 11A.
Figure 12:
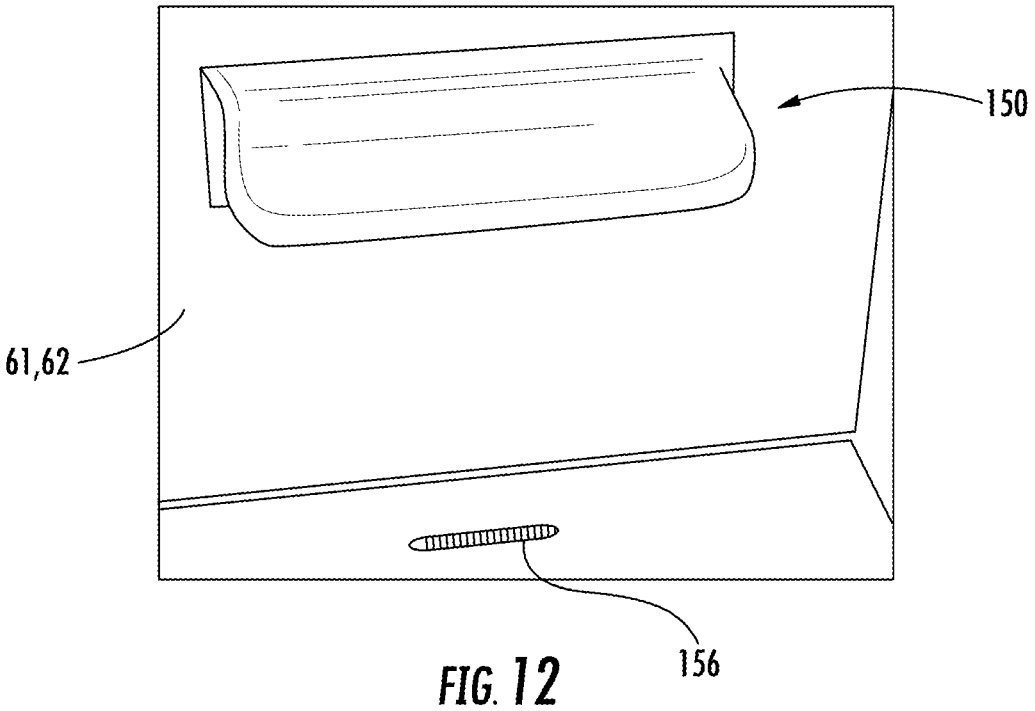
FIG. 12 is a perspective view of a perch and drain within the shower area of FIG. 6A according to another embodiment.

As shown in FIGS. 11A-12, the shower area 110 may include a seat or perch 150 and a drain 156. The perch 150 may be statically attached to the first side 61 of the first wall 62 and may extend substantially perpendicularly to the first wall 62 in order to provide a seating, resting, relaxation, or perching area for the occupant to use while showering (as shown, for example, in FIGS. 10C-10D).

As shown in FIGS. 9A-10D, the perch 150 may be positioned near the shower head assembly 140 in order to position the occupant within the water stream from the shower head 148 while the occupant is on the perch 150. For example, the perch 150 may be positioned directly underneath or below the shower head 148 along the first wall 62. Accordingly, the occupant may take advantage of the warmth of the water while using or sitting down on the perch 150.

As shown in FIGS. 11A-11B and FIG. 12, the perch 150 may have a variety of different configurations, shapes, sizes, and designs in order to provide different aesthetics within the shower area 110. It is understood that the various designs, configurations, shapes, and features can be integrated with each other.

The drain 156 may allow liquid (e.g., waste, such as wastewater) to exit or drain out of the shower area 110 and accordingly may connect to the water outlet line 82. The drain 156 may be positioned beneath or below the perch 150 on the floor of the shower area 110 such that the drain 156 is accessible, yet still out of direct view from the occupant. Accordingly, the drain 156 can easily be cleaned and hair and residue can easily be removed from the drain 156, thereby preventing buildup of dirt. Since the drain 156 is out of the way underneath the perch 150, it is unlikely that the occupant will step on the drain 156 while in the shower area 110.

Grab Bar

Figure 13A:
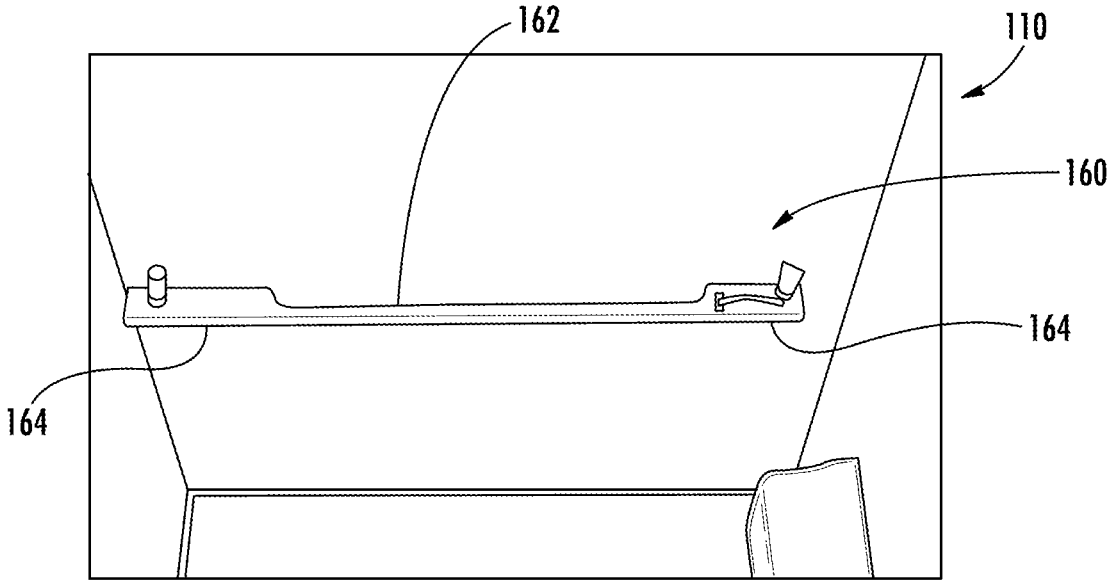
FIG. 13A is a perspective view of a grab bar within the shower area of FIG. 6A according to one embodiment.
Figure 13B:
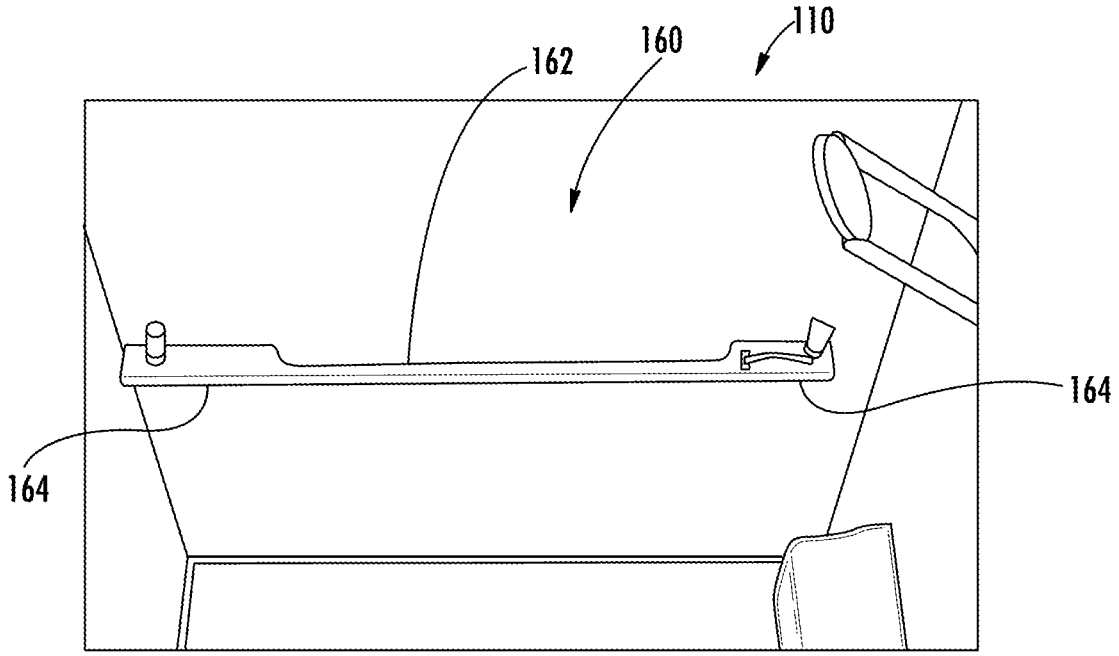
FIG. 13B is a perspective view of the grab bar of FIG. 13A.
Figure 14:
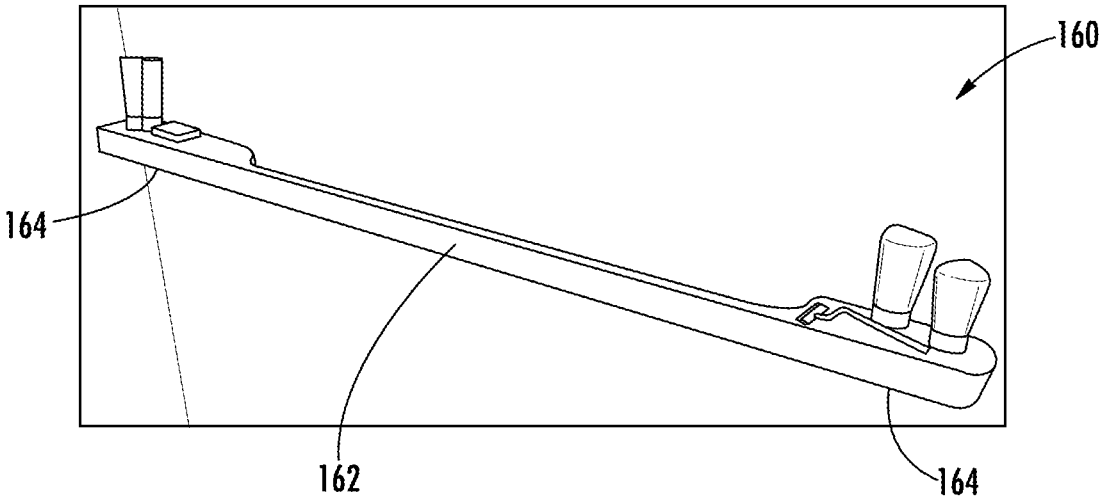
FIG. 14 is a perspective view of a grab bar within the shower area of FIG. 6A according to another embodiment.

As shown in FIGS. 13A-14, the shower area 110 may include a horizontal element or grab bar 160 that may be attached to a wall within the shower area 110. The grab bar 160 may be used in order to provide an area for the occupant to grasp or hold onto for support while in the shower area 110 to prevent any slipping or falling and to allow the user to keep their balance.

As shown in FIGS. 13A-14, the grab bar 160 may have two shelf areas 164 on either side of a middle section 162 (e.g., along the ends of the grab bar 160). The middle section 162 of the grab bar 160 may provide an area for the occupant to easily grasp for support and accordingly may be at least partially separated from the wall of the shower area 110 such that there is a gap between the middle section 162 and the wall. This gap may also allow water to drain between the grab bar 160 and the wall. The middle section 162 may be a variety of different lengths. According to one embodiment, the middle section 162 may be approximately 36 inches.

The grab bar 160 may also include at least one shelf area 164 along the length of the grab bar 160 that can be used to stage, store, or hold different various items, such as shower products and amenities. Various items on the shelf areas 164 may be easily accessible or presented to the occupant within the shower area 110. The shelf areas 164 may provide sufficient room in order to display and hold both hotel products and the user's own personal belongings, toiletries, or products.

The shelf areas 164 may be located on either end of the grab bar 160. The grab bar 160 (and optionally the shelf areas 164) may extend or span into the corners of the shower area 110.

Foot Ledge/Doorstop

Figure 15:
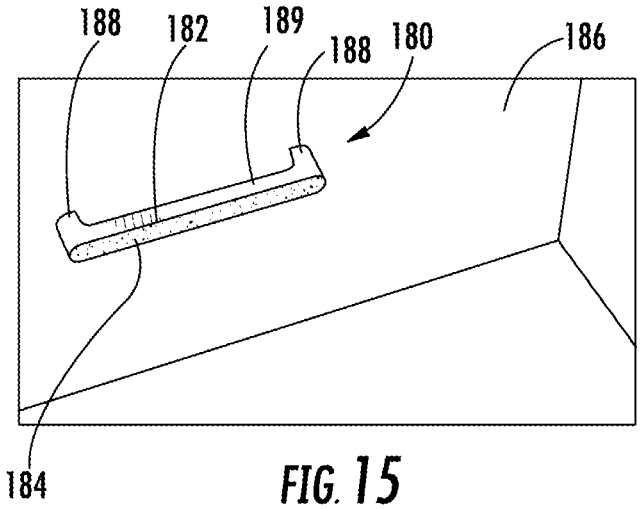
FIG. 15 is a perspective view of a foot ledge/doorstop within the shower area of FIG. 6A.
Figure 16A:
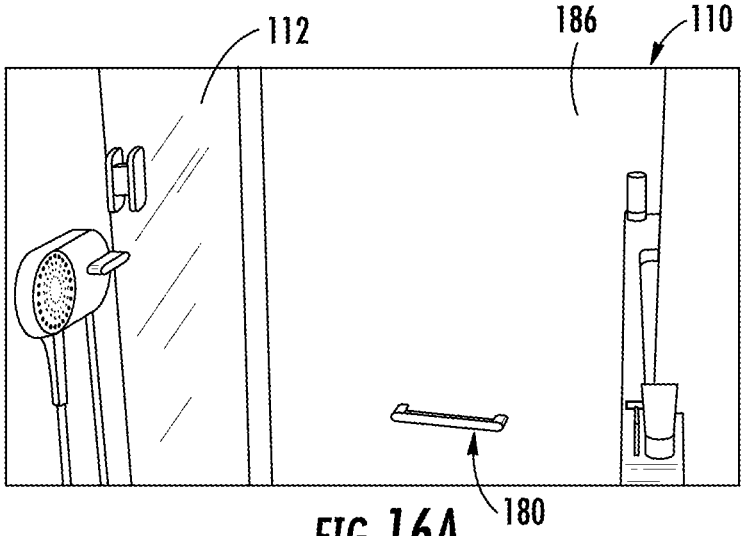
FIG. 16A is a perspective view of the foot ledge/doorstop of FIG. 15 with the shower area door closed.
Figure 16B:
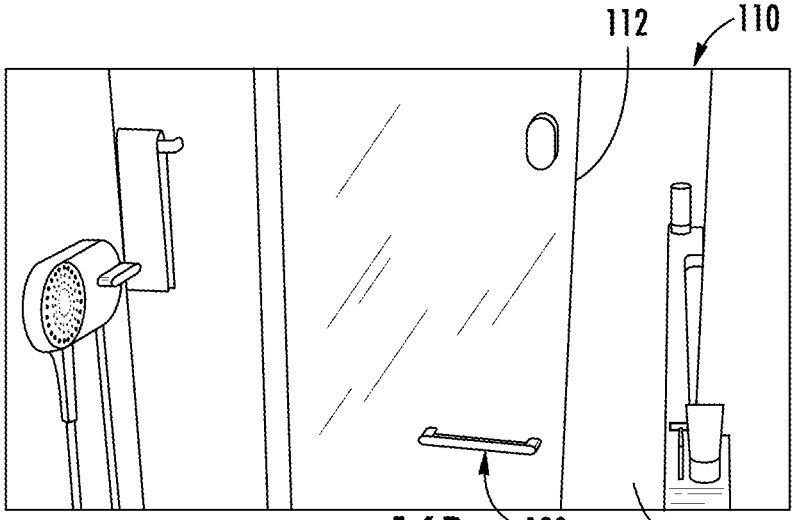
FIG. 16B is a perspective view of the foot ledge/doorstop of FIG. 15 with the shower area door open.

As shown FIGS. 15-16B, the shower area 110 may include foot ledge/doorstop 180 that is a substantially horizontal bar that provides both a foot ledge and a door stop within the shower area 110. Accordingly, the foot ledge/doorstop 180 may be positioned relatively near the floor of the shower area 110 and on a wall 186 of the shower area 110 that is close to the shower area door 112 when the door 112 is open (into the shower area 110) (as shown in FIG. 16B), but also readily accessible within the shower area 110 when the door 112 is closed (as shown in FIG. 16A). Accordingly, the shower area door 112 may be movably attached to the wall 186. The occupant may use the foot ledge/doorstop 180 to both care for their lower extremities with more stability and comfort, for example, and also act as a doorstop.

The foot ledge/doorstop 180 may protrude outward substantially perpendicularly from the wall 186 of the shower area 110 in order to provide a ledge or lip for the occupant to use while in the shower area 110 and when the shower door 112 is closed (as shown in FIG. 16A). For example, the occupant may use the foot ledge/doorstop 180 as a comfortable, stable, and secure spot or area to place or prop up their foot while in the shower area 110 in order to, for example, shave their legs, wash between their toes, and dry their legs after showering more easily and safely. Accordingly, the occupant may more easily and safely balance with one foot on the floor and one foot positioned on the foot ledge/doorstop 180 while in the shower area 110.

Additionally, since the foot ledge/doorstop 180 protrudes outward from the wall 186, the foot ledge/doorstop 180 may also stop the door 112 from moving any further and prevent the door 112 from hitting the wall 186 when the door 112 is opened (as shown in FIG. 16B). Thus, the foot ledge/doorstop 180 prevents damage to the door 112 and/or to the wall 186 and reduces or eliminates noise when the door 112 is opened and would otherwise hit the wall 186. When the door 112 is opened completely (by rotating the door 112 into the shower area 110), one side of the door 112 hits the outer surface 182 of the foot ledge/doorstop 180, which stops the movement of the door 112. The door 112 may be hinged from the wall 186 or an adjacent wall.

The front face or outer surface 182 of the foot ledge/doorstop 180 may be substantially parallel to the wall 186 and to the one side of the door 112 (when the door 112 is open). In order to prevent any damage to the door 112 and reduce the noise as the door 112 hits the outer surface 182 of the foot ledge/doorstop 180, the outer surface 182 may include a rubber surface, cushion, or stopper 184 that directly abuts one side of the door 112 and stops the door 112 from moving when the door 112 is fully opened into the shower area 110. The rubber stopper 184 may be a variety of different impact-absorbing materials, including but not limited to silicone. The rubber stopper 184 may span a portion of or the entire outer surface 182. According to other exemplary embodiments, the rubber may be replaced with other cushioning materials or layers of materials that are configured to absorb the force and/or reduce the noise associated with the shower area door 112 impacting the outer surface 182 of the foot ledge/doorstop 180.

The foot ledge/doorstop 180 is statically attached to the wall 186 of the shower area 110. According to one embodiment as shown in FIG. 15, the foot ledge/doorstop 180 may have two ends 188 on either side of a middle section 189. Both ends 188 of the foot ledge/doorstop 180 may attach to the wall 186 of the shower area 110 and the middle section 189 of the foot ledge/doorstop 180 may be separated or spaced apart from the wall 186 of the shower area 110 such that there is a gap between the middle section 189 of the foot ledge/doorstop 180 and the wall 186. This gap may allow water to drain between the foot ledge/doorstop 180 and the wall 186.

Storage Space

Figure 17:
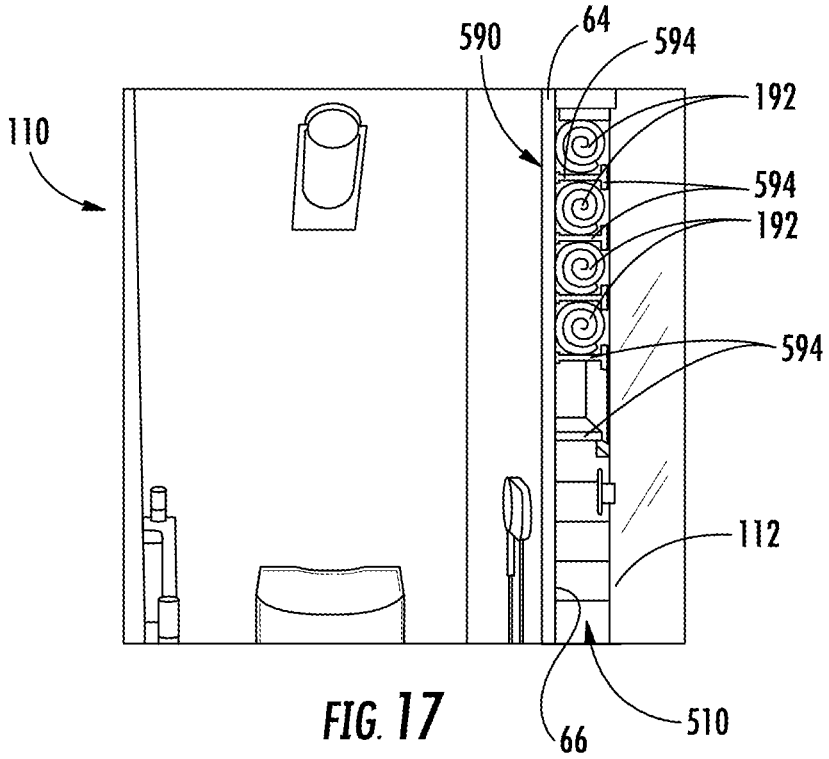
FIG. 17 is a perspective view from within the shower area of FIG. 6A of a storage space outside of the shower area.
Figure 18:
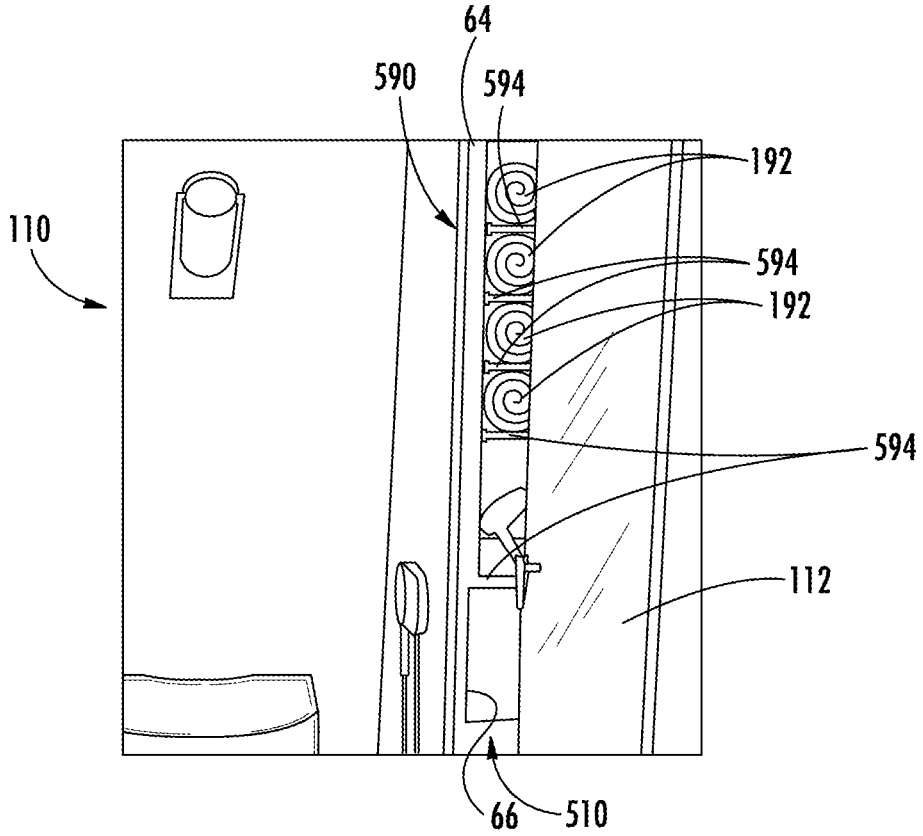
FIG. 18 is a perspective view from within the shower area of FIG. 6A of a storage space outside of the shower area.
Figure 19:
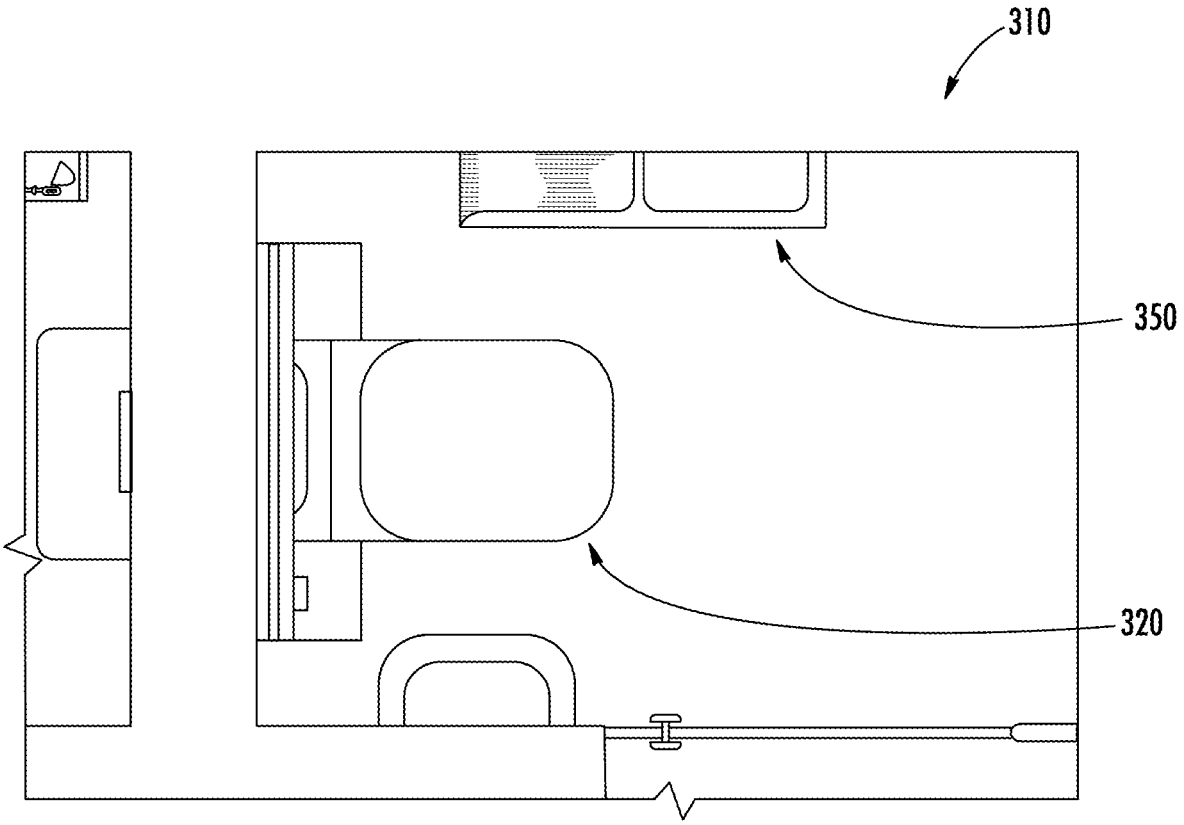
FIG. 19 is a top view of a toilet area of the first bathroom of FIG. 1A.
Figure 38:
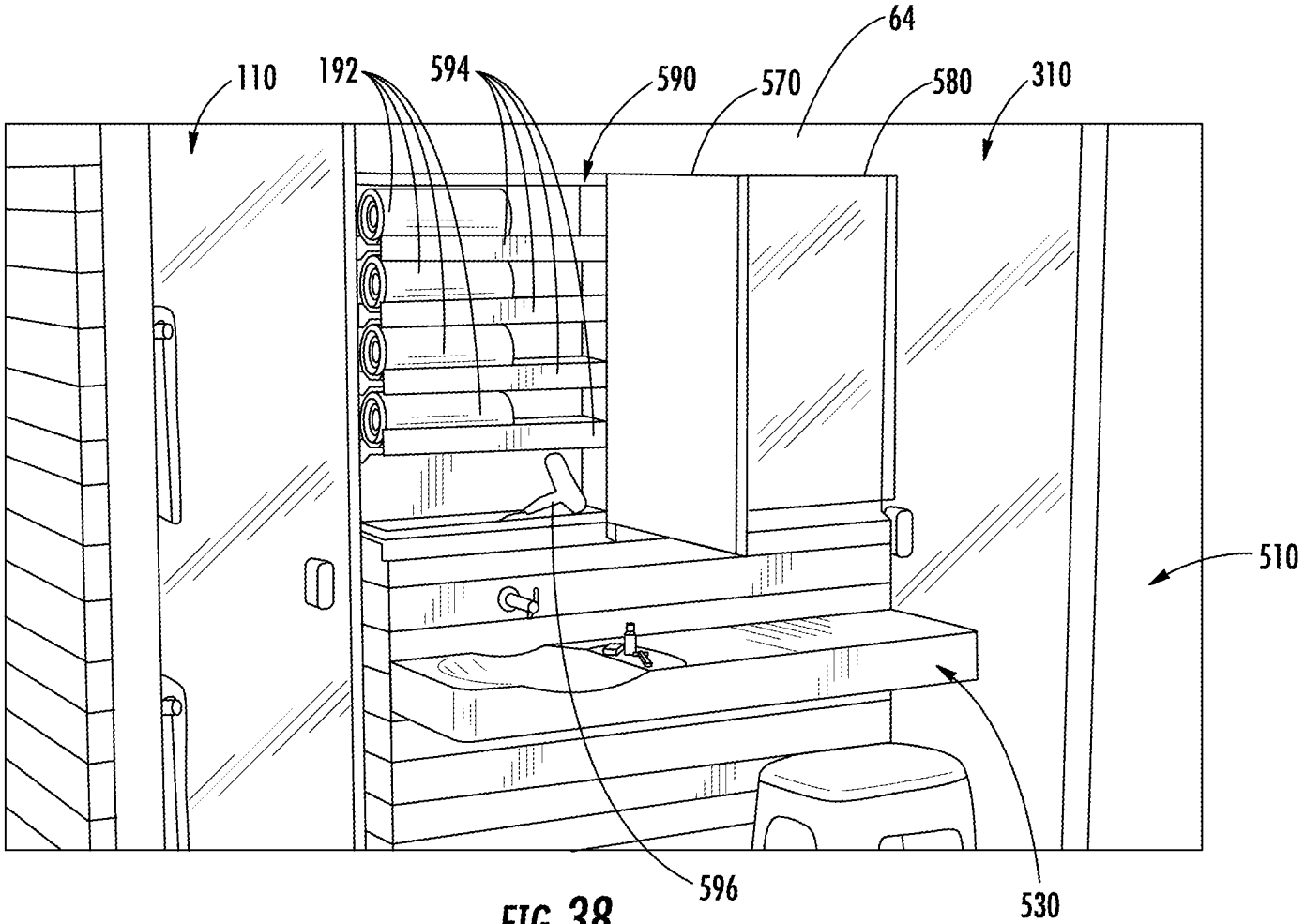
FIG. 38 is a perspective view of the grooming area with the left mirror in the second position.

As shown in FIGS. 17-18 and 38, a towel rack or storage space 590 (as described further herein) that can store various items, such as towels 192, may be positioned in the grooming area 510 just outside the shower area 110 and near the entrance to and exit of the shower area 110. Since the storage space 590 is on the second side 66 of the second wall 64 (near the first end 67 of the second wall 64) and within the grooming area 510, the storage space 590 prevents the towels 192 from getting wet while the occupant is taking a shower, while still being conveniently located and accessible to the occupant from within the shower area 110. As illustrated in FIGS. 38 and 39A-D, the same towels 192 may also be accessible from the outside of the shower area 110, as will be described in greater detail below.

As shown in FIGS. 17-18, the occupant may easily reach or access and obtain a towel 192 from the storage space 590 without exiting or leaving the shower area 110 by slightly opening the shower area door 112 of the shower area 110 into the grooming area 510 and reaching through the gap between the door 112 and the second wall 64 of the shower area 110. If the door 112 is on a hinge, the door 112 may be slightly opened away from the shower area 110 and into the grooming area 510. The user does not have to exit the shower area 110 in order to obtain a dry towel 192 from the storage space 590 and therefore does not have to get cold while obtaining the towel 192 when the occupant is ready to dry off after showering, for example.

Toilet Area #1

As shown in FIGS. 19-23B, the toilet area 310 is shown in greater detail. The toilet area 310 may include (among other features) a toilet assembly 320 and a toilet paper holder 350.

Toilet Assembly

As shown in FIGS. 20A-21C, the toilet area 310 may include the toilet assembly 320 that is designed to prevent or minimize dirt, dust, and grime collection or accumulation, be easier to clean and wipe down, and be easier for the user to inspect for cleanliness before using. For example, the entire structure of the toilet assembly 320 is more streamlined and sleek with minimal or no "nooks and crannies" than conventional toilets 398 (as shown, for example, in FIG. 21C) in order to be easier to clean and to inspect for cleanliness before use or after cleaning.

Figure 20C:
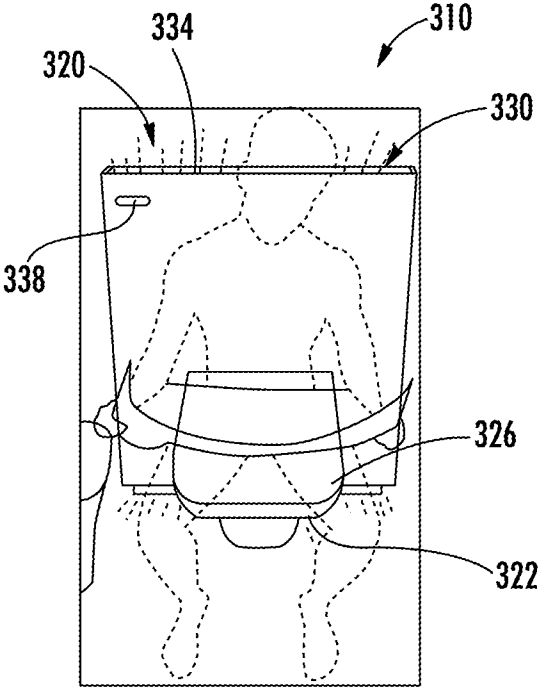
FIG. 20C is a perspective view within the toilet area of FIG. 19 with an occupant on the toilet assembly.

The toilet assembly 320 may include a toilet bowl 322 in order to provide an area to hold water and receive and discard waste. The toilet assembly 320 may also include a toilet seat to provide an area for the user to sit on in order to use the toilet assembly 320 and a toilet lid 326 to cover the toilet seat while the toilet assembly 320 is not in use. (Although FIG. 20C depicts the user sitting on the toilet lid 326, it is understood that the user can sit on the toilet seat (which is underneath the toilet lid 326 in FIG. 20C) and be in the same position and location within the toilet area 310.) The toilet seat may be positioned on and pivotably attached to the toilet bowl 322. The toilet lid 326 may be positioned on the toilet seat and pivotably attached to both the toilet seat and the toilet bowl 322.

Figure 21B:
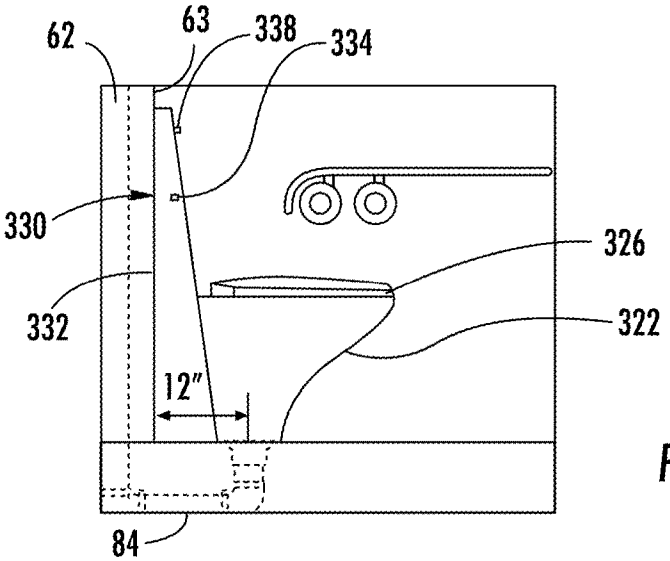
FIG. 21B is a side view of the toilet area of FIG. 19 with some drainage plumbing shown.
Figure 21C:
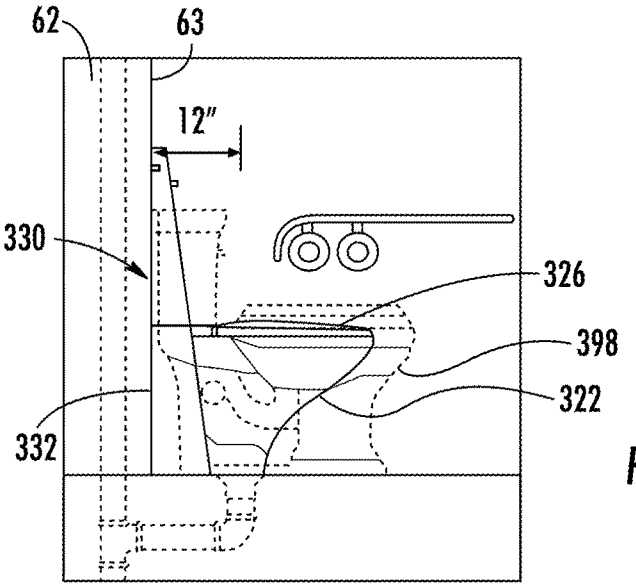
FIG. 21C is a side view of the toilet area of FIG. 19 overlaid with a conventional toilet.
Figure 21A:
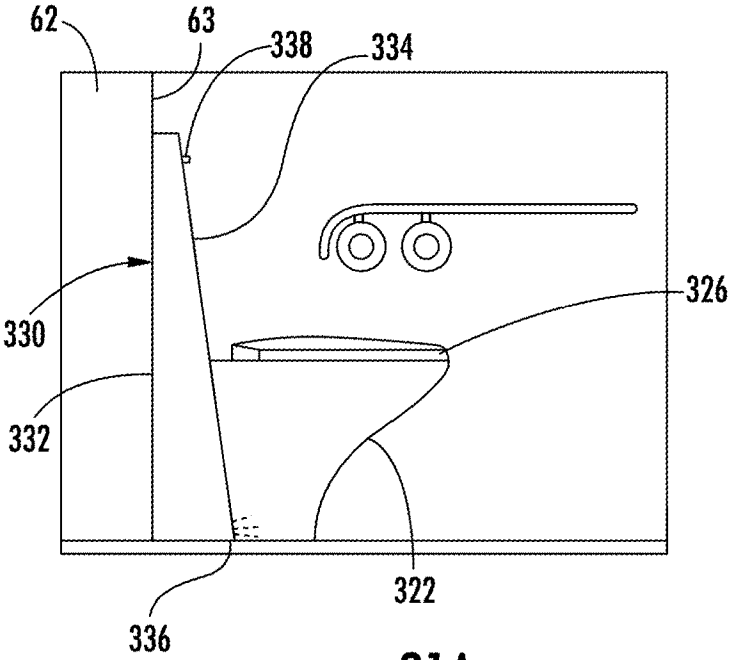
FIG. 21A is a side view of the toilet area of FIG. 19.

The toilet assembly 320 may also include a water tank 330 that is used to contain water for flushing the toilet bowl 322. As shown in FIGS. 21A-21C, the back panel or side 332 of the water tank 330 may directly abut or lie against one of the walls, such as the second side 63 of the first wall 62, in order to minimize the amount of space the toilet assembly 320 requires (e.g., the length of the toilet assembly 320) within the toilet area 310. The back side 332 of the water tank 330 may be substantially parallel to the first wall 62. By placing most of the back side 332 close against the first wall 62, the water tank 330 is longer and thinner which saves space within the toilet area 310 and obtains the same space-saving benefits and feeling of a wall-hung toilet while still fitting with a standard 12 inch rough-in. With more space within the toilet area 310, the user may have more room for their knees, more leg room, and/or more room to move around within the toilet area 310.

Figure 20A:
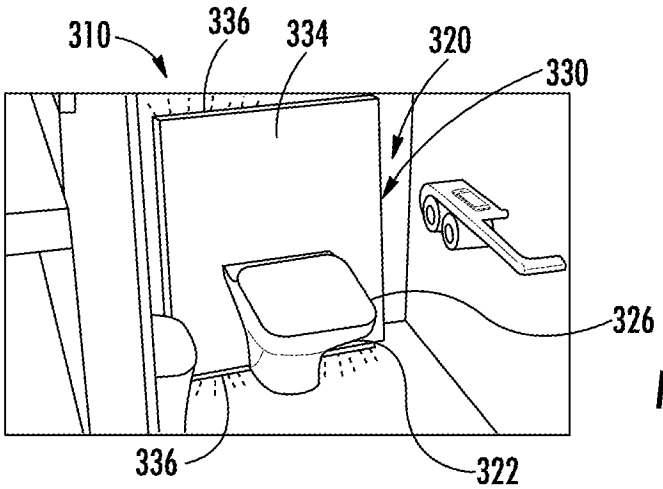
FIG. 20A is a perspective view within the toilet area of FIG. 19.
Figure 20B:
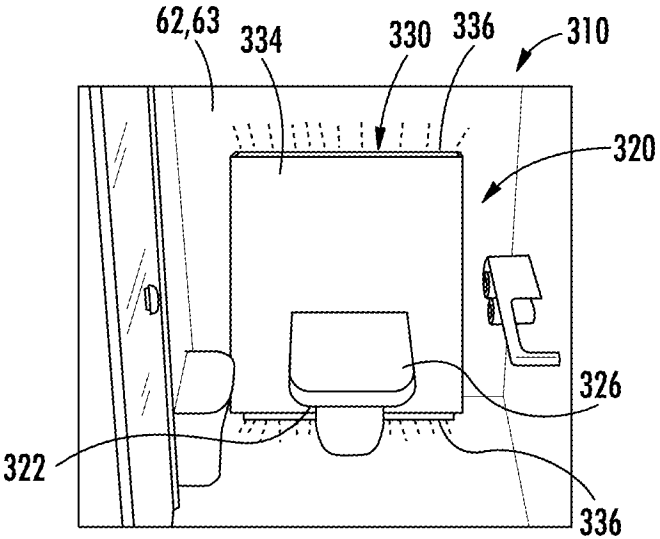
FIG. 20B is a perspective view within the toilet area of FIG. 19.

The front panel or side 334 of the water tank 330 (which is on an opposite side as the back side 332 of the water tank 330) may be slanted, tilted, or angled relative to the back side 332 and the first wall 62. Accordingly, the water tank 330 has a wedge shape along the cross-sectional view or side view (as shown in FIG. 21A), which spaces the toilet bowl 322 from the first wall 62 in order to provide sufficient room for plumbing and to align with conventional plumbing (e.g., with a standard 12-inch rough-in). The overall shape of the water tank 330 may allow the entire toilet assembly 320 to be more easily accessed and cleaned (compared to conventional toilets 398). As shown in FIGS. 20A-20B, the front side 334 of the water tank 330 may also be covered in a glass material (such as a dark glass material) to provide a clean-looking surface on the water tank 330.

The water tank 330 may hold the water for the toilet bowl 322 in an area that is above the level of the toilet bowl 322 in order to sufficiently flush the toilet assembly 320. The area of the water tank 330 that is below the level of the toilet bowl 322 may cover or obscure the interface of the toilet assembly 320 to the sewage line 84 for drainage in order to provide a more "clean look" for the toilet assembly 320.

As shown in FIG. 21C, the length of the entire toilet assembly 320 may be shorter than the length of a conventional toilet 398, thereby providing more available room within the toilet area 310. However, as shown in FIGS. 21B-21C, the toilet assembly 320, in particular the toilet bowl 322, may still be shaped and sized in order to fit a standard 12-inch rough-in and the sewage line 84. Accordingly, the toilet assembly 320 fits with conventional plumbing, is easily installed, and does not require relocating the rough-in. The toilet assembly 320 can be retro-fit onto an existing standard rough-in.

As shown in FIG. 20C, the toilet assembly 320 may also include a trip lever 338 on the front side 334 of the water tank 330 that may be used to flush the water tank 330, thereby discarding of any waste. Since the water tank 330 is longer than the tank of a conventional toilet (along a direction parallel to the first wall 62), the lever 338 is farther to the side and farther away from the centerline of the toilet bowl 322 than a lever of a conventional toilet. Accordingly, the user may more easily access or reach and activate the lever 338 while sitting on the toilet seat or on the toilet lid 326, as shown in FIG. 20C.

As shown in FIGS. 20A-20B and 21A, the water tank 330 may include a warm backlight or ambient lighting 336 around at least a portion of the perimeter to provide a "glow" or lighting around at least a portion of the toilet assembly 320. The lighting 336 may provide ambiance for the toilet area 310 and may also improve the safety of the toilet area 310 by allowing the user to easily navigate the toilet area 310 and use the toilet assembly 320 at night. The lighting 336 may provide sufficient light such that the user can easily and safety navigate the toilet area 310 and use the toilet assembly 320 without bumping into anything or turning on any other additional lights (e.g., in the dark in the middle of the night). At the same time, the lighting 336 may not provide too much light to allow the user's eyes to more easily adjust to the light (from the dark) and to prevent fully waking up the user when turning on in the dark at night. The lighting 336 may optionally turn on automatically when the user enters into the toilet area 310.

According to one embodiment, the lighting 336 may extend around the entire perimeter or a portion of the perimeter of the water tank 330 such that the top, sides, and/or bottom of the water tank 330 are illuminated. The lighting 336 may be projected from the back side 332 and/or the front side 334 of the water tank 330 or along an edge of the water tank 330. The lighting 336 may be directed toward the first wall 62 and/or into the center of the water tank 330 in order to provide indirect light. Accordingly, the portion of the perimeter of the water tank 330 that includes the lighting 336 may be at least partially spaced from the first wall 62 and/or the floor of the toilet area 310. Other portions of the back side 332 of the water tank 330 may, however, directly abut the first wall 62 or the floor. Alternatively, the lighting 336 may shine through a small seam in certain portions of the water tank 330.

Toilet Paper Holder

Figure 22A:
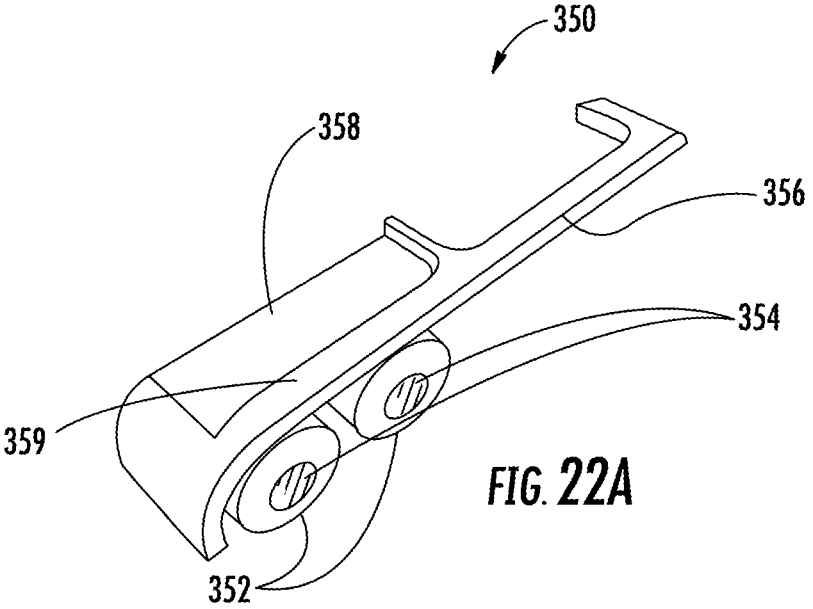
FIG. 22A is a perspective view of a toilet paper holder in the toilet area of FIG. 19.
Figure 22B:
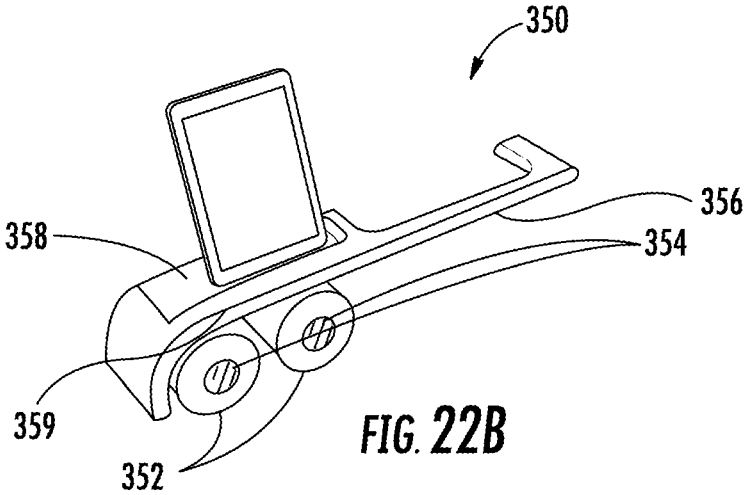
FIG. 22B is a perspective view of the toilet paper holder of FIG. 22A holding an item.
Figure 22C:
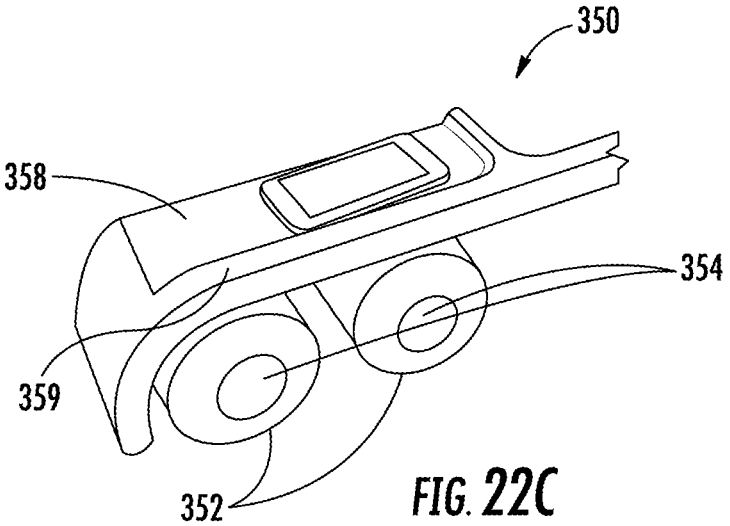
FIG. 22C is a perspective view of the toilet paper holder of FIG. 22A holding a different item.
Figure 23A:
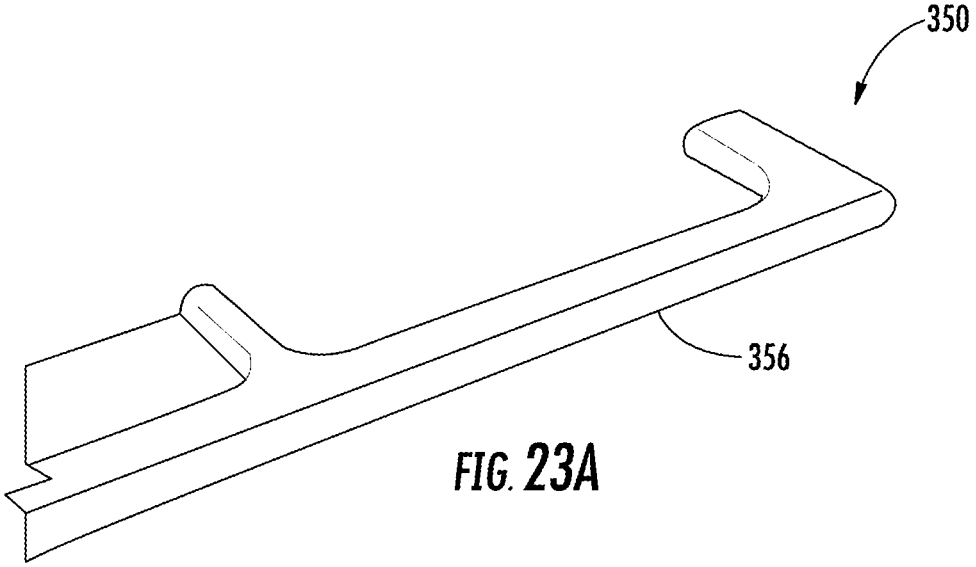
FIG. 23A is a perspective view of the grab point of the toilet paper holder of FIG. 22A.
Figure 23B:
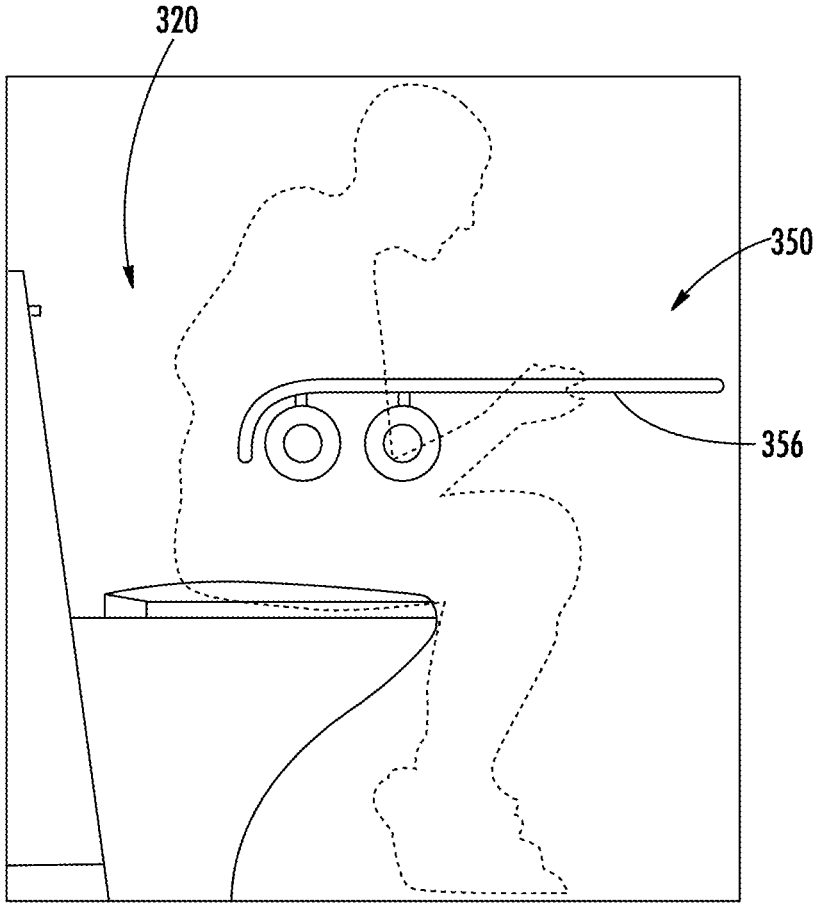
FIG. 23B is a side view with an occupant on the toilet assembly and holding the grab point on the toilet paper holder of the toilet area of FIG. 19.

As shown in FIGS. 22A-23B, the toilet area 310 may include a toilet paper holder 350 that may hold and store toilet paper 352. The toilet paper holder 350 may be positioned on a wall of the toilet area 310 such that the user can conveniently reach the toilet paper 352 from the toilet paper holder 350 while sitting on the toilet seat of the toilet assembly 320, as shown in FIG. 23B.

As shown in FIGS. 22A-22C, the toilet paper holder 350 may include at least one bar 354 to hold and secure the toilet paper 352 and allow the roll of toilet paper 352 to rotate as the user obtains their desired amount.

The toilet paper holder 350 may also include a handle, bar, or integrated grab point 356 for the user to firmly grasp for support, stability, safety, assistance, and security (as shown in FIG. 23B) while raising and/or lowering themselves (e.g., sitting down and/or standing up) from the toilet seat of the toilet assembly 320. The grab point 356 may be particularly beneficial for users who have difficulty getting on or off of the toilet assembly 320. The grab point 356 may be positioned close to the toilet assembly 320 such that the user can easily hold onto the grab point 356 while seated on the toilet assembly 320. The grab point 356 is spaced apart from the wall such that the user can fully grasp the grab point 356 for support.

As shown in FIGS. 22A-22C, the toilet paper holder 350 may also include a shelf 358 in order to provide an area to securely and conveniently hold any items, such as a phone, tablet, or a book, that the user happens to bring into the toilet area 310. The shelf 358 may optionally have a lip 359 in order to further secure or prop up (as shown in FIGS. 22B-22C) the user's items. The shelf 358 may be positioned directly above the bars 354 that are directly holding the toilet paper 352 such that the shelf 358 can be easily and conveniently accessed while the user is using and sitting on the toilet assembly 320. The grab point 356 may be positioned in front of the shelf 358 such that the occupant can grab the grab point 356 while an item is still being stored undisturbed on the shelf 358.

Grooming Area #1

As shown in FIGS. 24-39D, the dressing space or grooming area 510 is shown in greater detail. The grooming area 510 may include (among other features), a towel bar assembly 520, a sink assembly 530, a storage area 550, lights 560, adjustable mirrors 570, 580, and a storage space 590.

Towel Bar Assembly

Figure 25A:
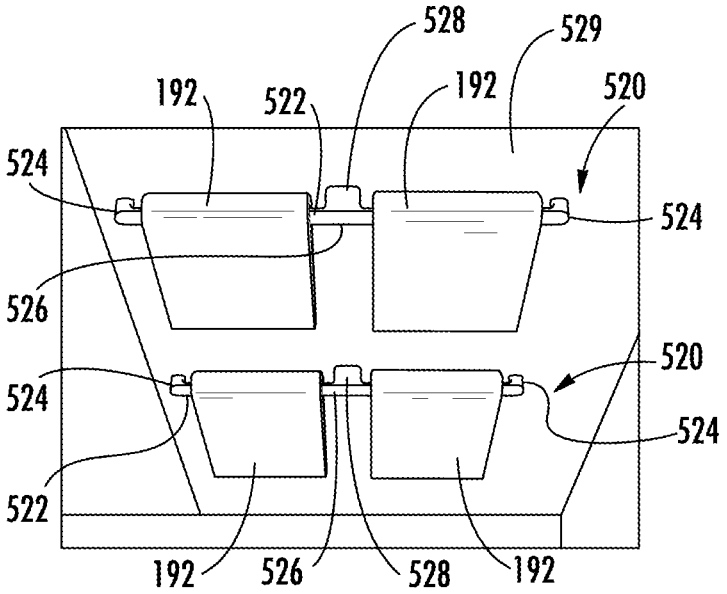
FIG. 25A is a perspective view of a towel bar assembly within the grooming area of FIG. 24.
Figure 25B:
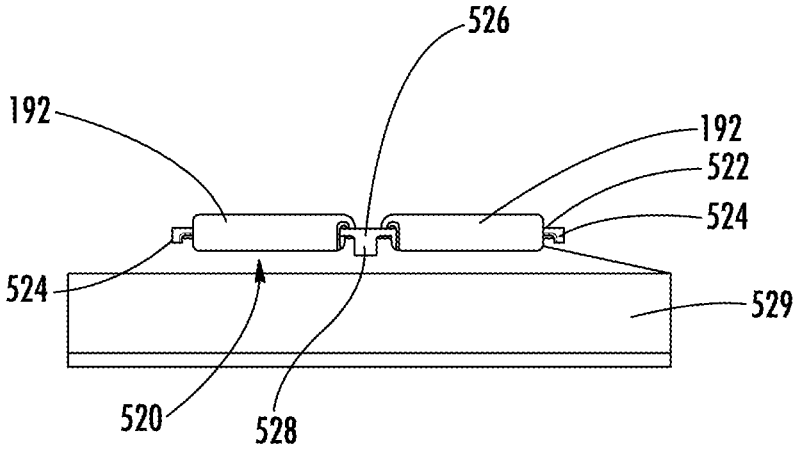
FIG. 25B is a top view of the towel bar assembly of FIG. 25A holding towels that are the same size.
Figure 25C:
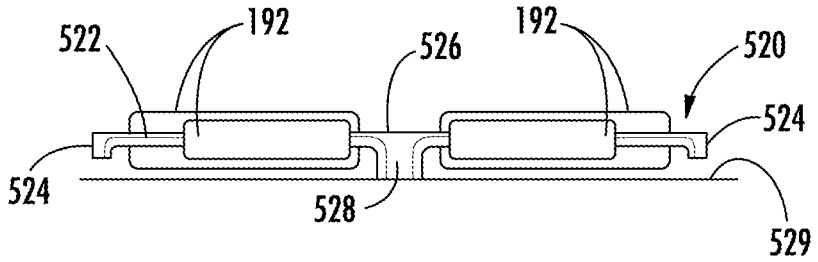
FIG. 25C is a top view of the towel bar assembly of FIG. 25A holding towels that are different sizes.

As shown in FIGS. 25A-26D, the grooming area 510 may include a towel rack or bar assembly 520 that can be used to hang and dry towels 192 on. The towel bar assembly 520 may include a substantially horizontal bar 522 to hang the towels 192 on and at least one anchor 528 to statically attach and secure the bar 522 to a wall 529, as shown in FIGS. 25A-25C. The towel bar assembly 520 may be positioned close to the shower area 110 and the sink assembly 530 in order to position the towels 192 to be easily accessible to the user when needed.

The bar 522 includes two side portions or end portions 524 on opposite sides of the bar 522 and a center or middle portion 526 between the two end portions 524. Each of the end portions 524 and the middle portion 526 each include approximately ⅓ of the length of the bar 522. Instead of the anchor 528 attaching each of the end portions 524 of the bar 522 to the wall 529, the anchor 528 only directly attaches the middle portion 526 to the wall 529. Accordingly, the end portions 524 are not directly attached to the wall 529 and are only indirectly attached to the wall 529 through the middle portion 526.

By attaching the bar 522 to the wall 529 only through the middle portion 526 of the bar 522, towels 192 can be hung more easily on the bar 522. For example, the towels 192 do not need to be threaded through two anchors in order to hang the towel 192 on the bar 522. Instead, the end portions 524 of the bar 522 provide a natural hook for the towels 192 to be spread across and laid out on, thereby making it easier for the user to hang the towels 192 and providing more air flow to the towels 192. Accordingly, the towels 192 can be dried more easily and faster than conventional towel bars.

Figure 26B:
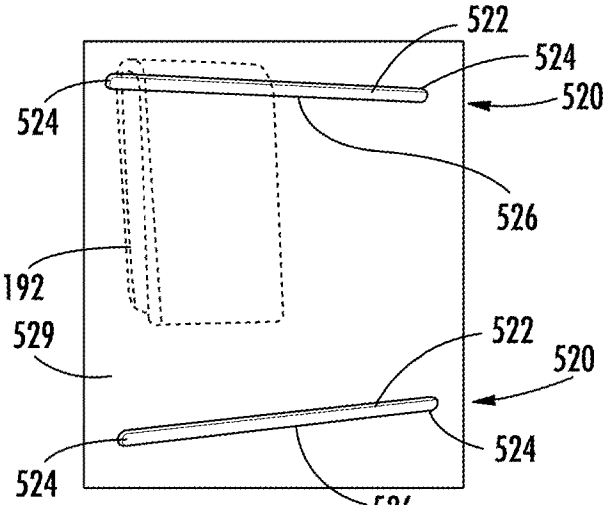
FIG. 26B is a schematic view of the towel bar assembly of FIG. 25A holding a folded towel.
Figure 26D:
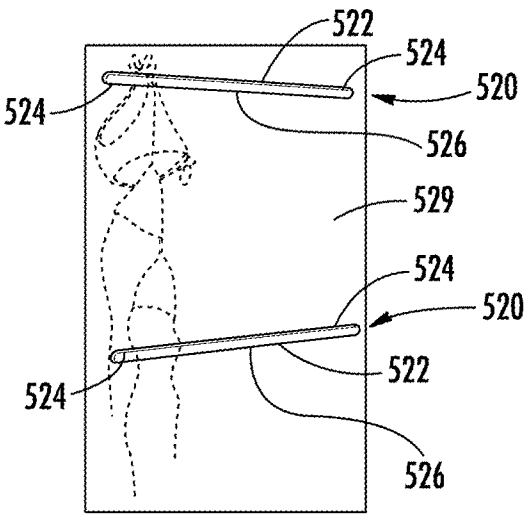
FIG. 26D is a schematic view of the towel bar assembly of FIG. 25A holding a bathing suit.
Figure 26A:
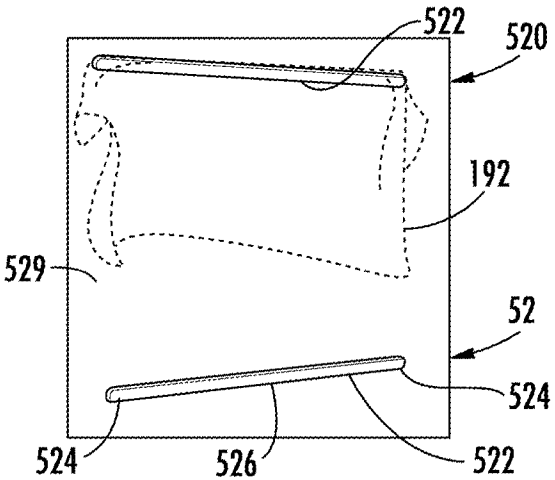
FIG. 26A is a schematic view of the towel bar assembly of FIG. 25A holding a towel spread out over the towel bar assembly.
Figure 26C:
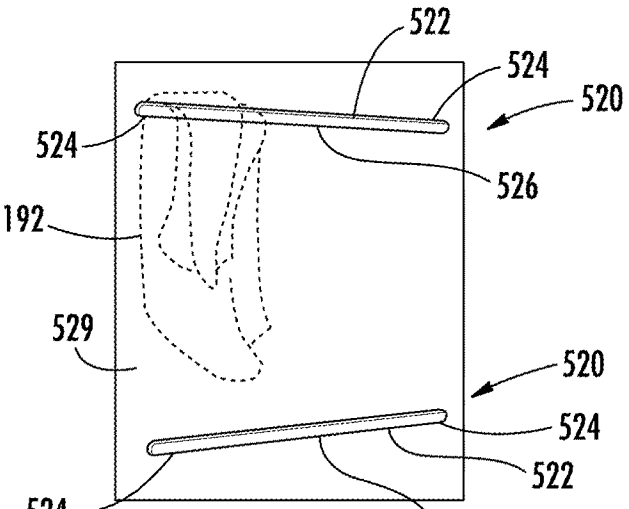
FIG. 26C is a schematic view of the towel bar assembly of FIG. 25A holding a towel hung in a bunch on the towel bar assembly.

Furthermore, as shown in FIGS. 26A-26D, the towels 192 can be hung on the bar assembly 520 in a variety of different configurations, according to the user's preference. For example, the towels 192 can be spread out over the bar 522 to encourage more air flow and dry the towel 192 faster (as shown in FIG. 26A), neatly folded (as shown in FIG. 26B), or swung over one of the end portions 524 of the bar 522 to hang the towel 192 in a bunch quickly and easily and to utilize the bar 522 as a "hook" (as shown in 26C). As shown in FIG. 26D, other items (such as a wet bathing suit) can also be easily hung on the bar 522.

As shown in FIG. 25A, multiple towel bar assemblies 520 may be positioned along the wall 529. For example, two towel bar assemblies 520 may be vertically aligned with each other along the wall 529 such that one of the towel bar assemblies 520 is above the other towel bar assembly 520.

Sink Assembly

Figure 28A:
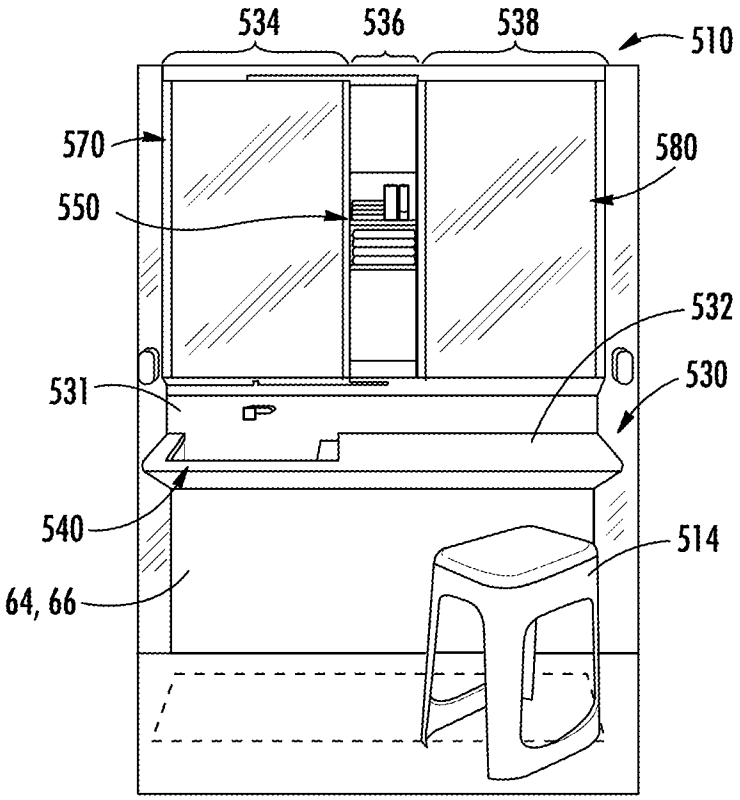
FIG. 28A is a front view of the grooming area of FIG. 24 according to another embodiment.
Figure 27:
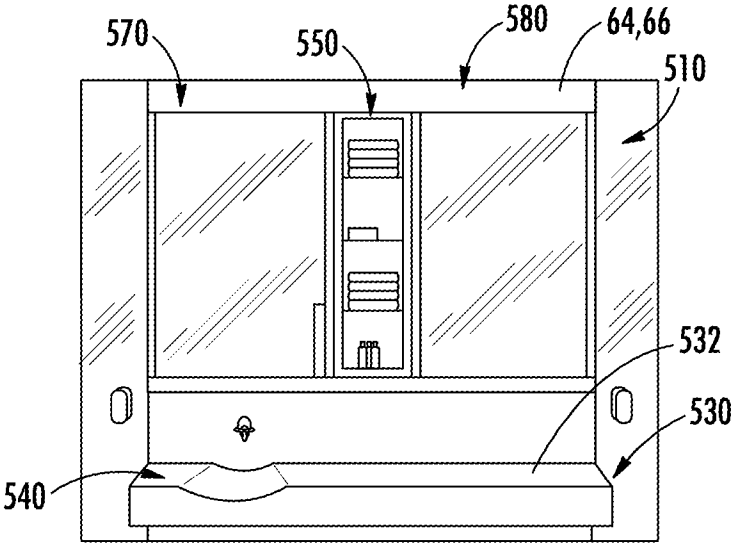
FIG. 27 is a front view of the grooming area of FIG. 24 according to one embodiment.
Figure 28B:
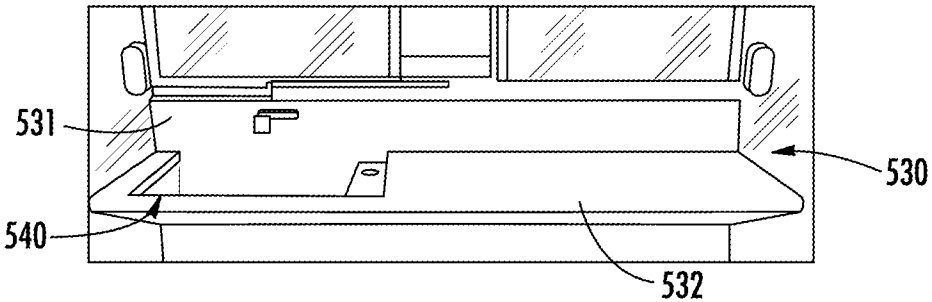
FIG. 28B is an enlarged view of the sink assembly of FIG. 28A.
Figure 29:
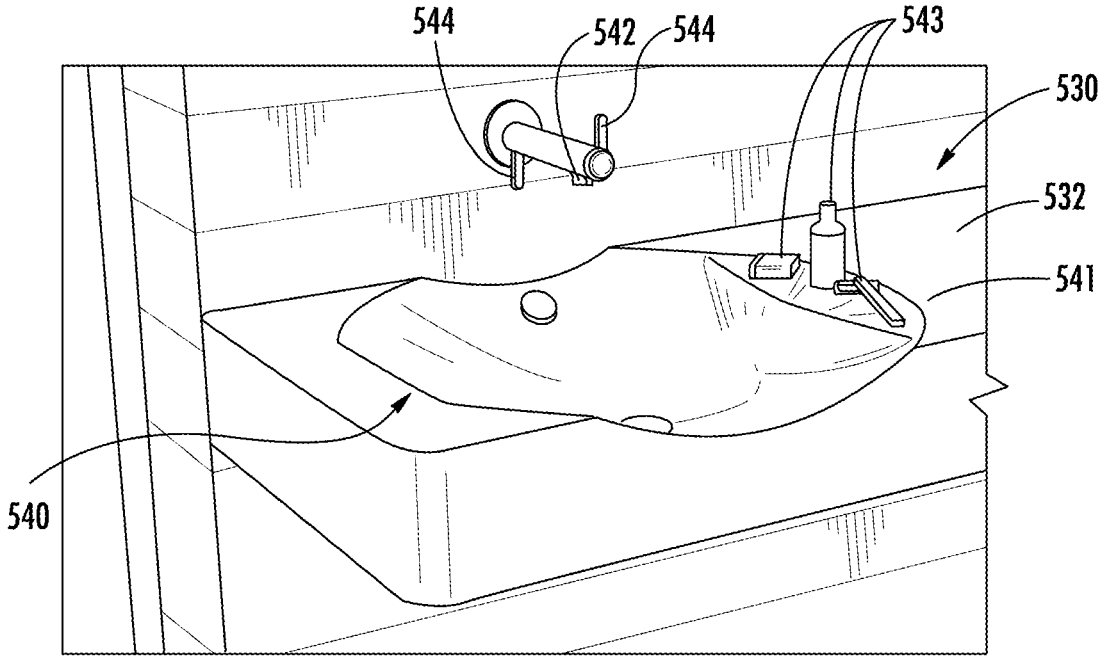
FIG. 29 is a perspective view of the sink of the sink assembly of FIG. 27.

As shown in FIGS. 27-33B, the vanity or sink assembly 530 may include, among other features, a surface or counter 532 and a basin or sink 540 (as described further herein). As shown in FIGS. 27-28B, the counter 532 and the sink 540 may have a one-piece configuration (e.g., may be integrally formed), which allows the sink assembly 530 to be more seamlessly integrated into the grooming area 510. The counter 532 and the sink 540 may have the same depth in order to provide one continuous area for the sink assembly 530.

As shown in FIGS. 27 and 29-30C and FIGS. 28A-28B and 31-33B, the sink assembly 530 (and its various components) may have a variety of different configurations, shapes, sizes, and designs in order to provide different aesthetics within the grooming area 510. It is understood that the various designs, configurations, shapes, and features can be integrated with each other.

Figure 24:
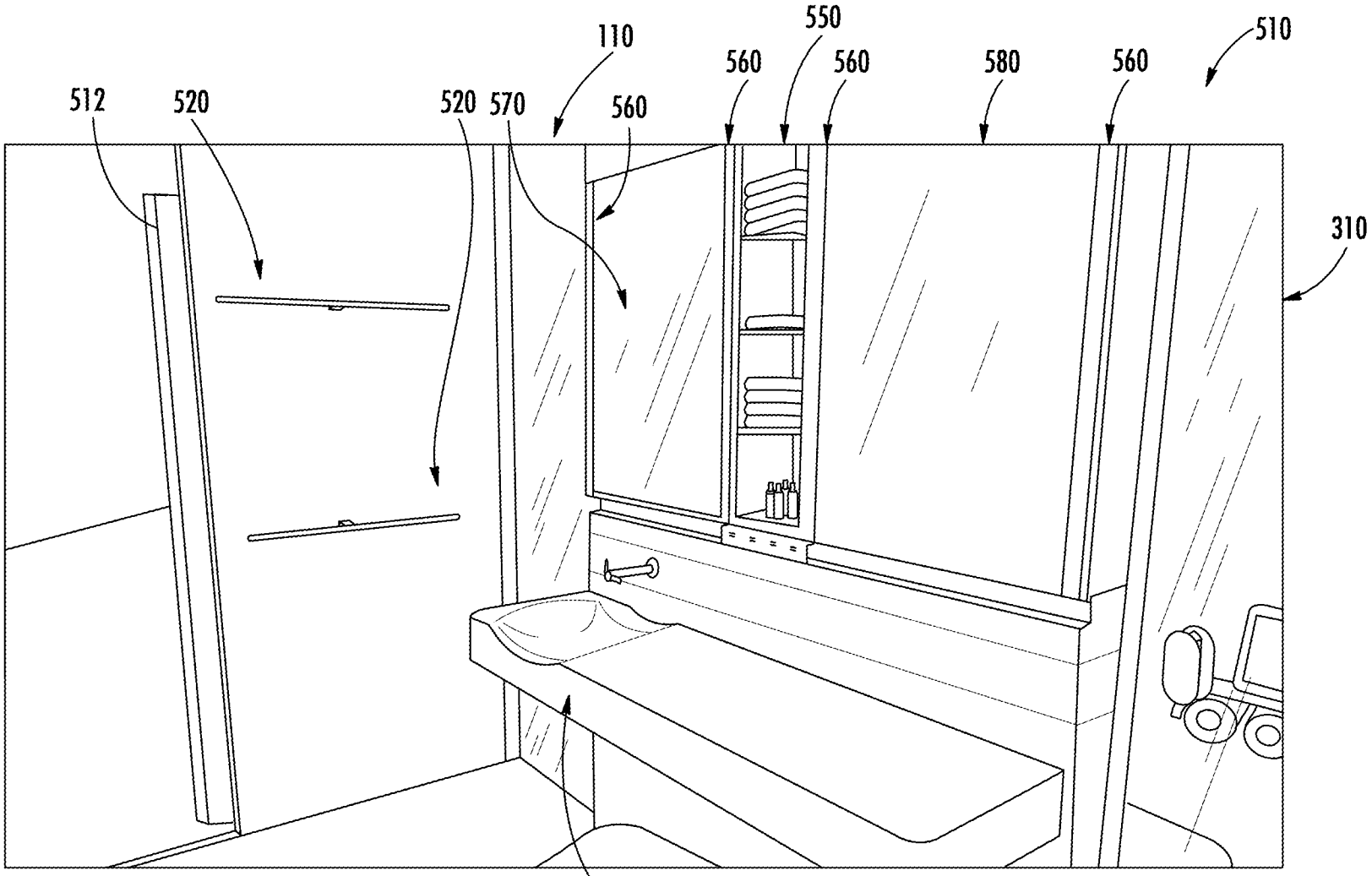
FIG. 24 is a perspective view of a grooming area of the first bathroom of FIG. 1A.

As shown in FIGS. 24 and 28A, the sink assembly 530 (optionally with the mirrors 570, 580 and the storage area 550) may be wall-mounted to a wall of the grooming area 510 (such as to the second side 66 of the second wall 64). Accordingly, the sink assembly 530 does not require any legs to hold up the sink assembly 530, which prevents the users from stubbing their toes and eliminates any floor or cleaning obstacles to allow the surrounding area to be cleaned more easily and thoroughly.

As further shown in FIG. 28A, the sink assembly 530 may be divided into a wet region, zone, or area 534, a transition region, zone, or area 536, and a dry region, zone, or area 538. Accordingly, the sink 540 is positioned within the wet area 534 and the counter 532 is positioned within the dry area 538. The transition area 536 is positioned between the wet area 534 and the dry area 538 within the sink assembly 530 to prevent any liquid from the wet area 534 from entering into the dry area 538. The user can perform different activities in each of the areas 534 and 538, depending on whether the activity uses liquid or not, for example.

By separating the wet area 534 and the dry area 538, items or people that are not meant to be wet are prevented from getting wet. Accordingly, as shown in FIG. 4B, the sink assembly 530 can be easily and comfortably shared at the same time by two people without accidently getting one of the people wet. For example, one person may be doing their hair or apply makeup over the counter 532 in the dry area 538 and the other person may be washing their face in the sink 540 in the wet area 534. By separating the wet area 534 and the dry area 538, it is less likely that the person doing their hair in the dry area 538 will get wet from the person washing their face in the wet area 534.

The wet area 534 and the dry area 538 may each have a respective mirror (such as one of mirrors 570 or 580, as described further herein) or may share one large mirror. A storage area 550 may be positioned between each of the mirrors 570, 580 within the transition area 536, as described further herein.

As shown in FIGS. 28A-28B, the sink assembly 530 may also include a backsplash 531 that extends along the back of the sink assembly 530 (e.g., along the second side 66 of the second wall 64) and along the back of the counter 532. According, the backsplash 531 may extend along the entire length of the sink assembly 530. The backsplash 531 may be a portion of the sink assembly 530 that extends upward above the sink 540 and above the counter 532, which allows the sink assembly 530 to be wiped down and cleaned more easily and prevents water or debris accumulation in crevices. The backsplash 531 may extend through the wet area 534, the transition area 536, and the dry area 538.

As shown in FIG. 28A, seating 514, such as a chair, seat, or stool, may be positioned near and used with the sink assembly 530 in order to provide an area for the user to sit in while getting ready or using the sink assembly 530. Since the sink assembly 530 is directly attached to the wall and does not require legs for support, the seating 514 may be positioned anywhere along the length of the sink assembly 530.

As shown in FIGS. 29-33B, the sink assembly 530 includes the sink 540. The sink 540 may include an inset basin soap ledge 541 to hold various wet items 543 (such as soap and/or a razor) and isolate the wet items 543 from the rest of the sink assembly 530 (in particular any dry items on the counter 532). The soap ledge 541 is recessed within and positioned at least partially within the sink 540 in order to prevent the soap from leaving residue on portions of the sink assembly 530 that are outside of the sink 540. Furthermore, the soap ledge 541 provides a relatively larger area to hold the wet items 543.

As shown in FIGS. 29-32B, the sink assembly 530 also includes a wall-mounted faucet 542 with at least one control 544. According to one embodiment, the faucet 542 and the control 544 may function in a similar manner as the shower valve assembly 120. In order to turn on the faucet 542 and actuate the water flow, the control 544 may be pivoted or rotated relative to a wall of the sink 540.

Figure 30A:
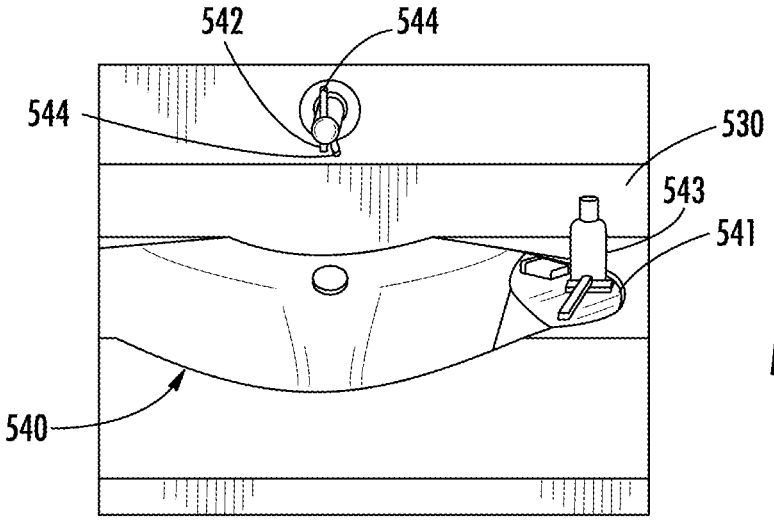
FIG. 30A is a front view of the sink of FIG. 29.
Figure 30B:
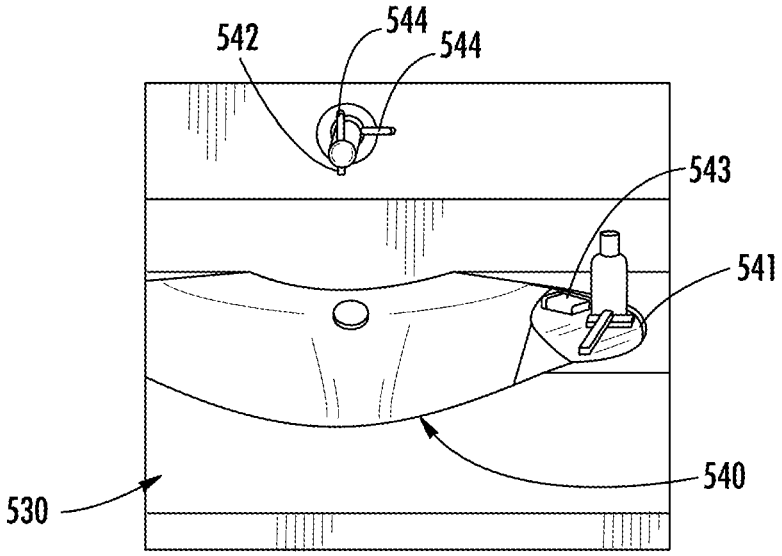
FIG. 30B is a front view of the sink of FIG. 29.
Figure 30C:
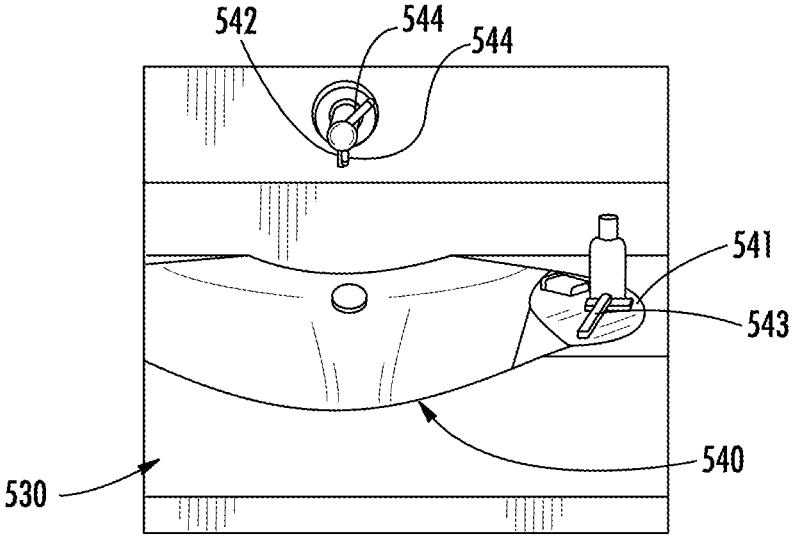
FIG. 30C is a front view of the sink of FIG. 29.
Figure 32A:
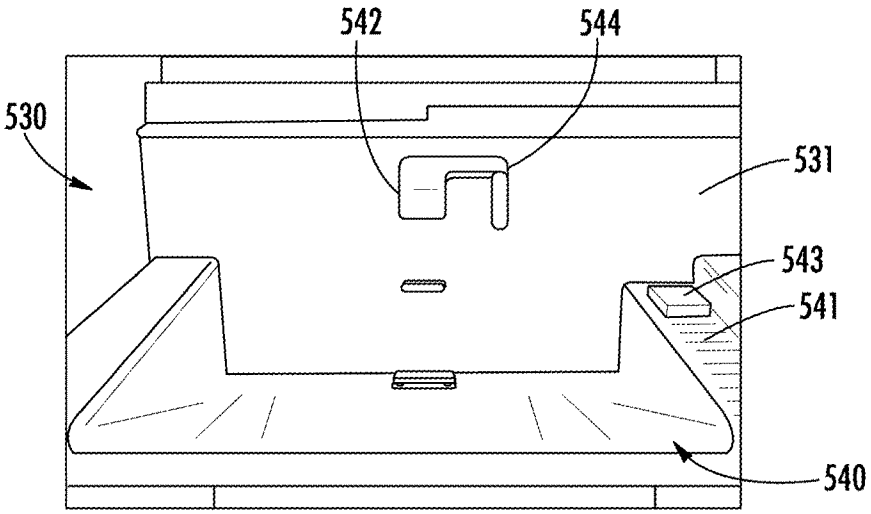
FIG. 32A is a front view of the sink of FIG. 31.
Figure 32B:
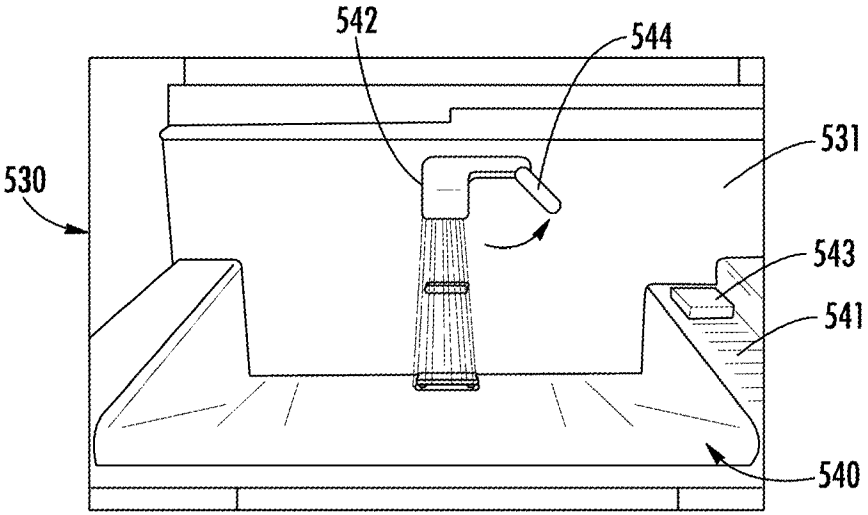
FIG. 32B is a front view of the sink of FIG. 31.

As shown in FIGS. 32A-32B, pivoting the control 544 may turn the faucet 542 onto full flow immediately. Further pivoting the control 544 may allow the temperature of the water to be changed. The faucet 542 may be a single-control faucet that operates with a 1.0 gallons per minute (gpm) flow rate. Alternatively, as shown in FIGS. 30A-30C, the sink assembly 530 may include two controls 544 to separately control the temperature and the flow rate.

It is understood that, according to one embodiment, the valve for the faucet 542 may have a ¼ inch turn valve that tempers water in a similar manner as the Rite-Temp® valve offered by Kohler Co. of Kohler, Wis., as described in U.S. Pat. Nos. 9,069,359, 9,334,971, 9,416,884, and 9,182,045, the entire disclosures of which are incorporated by reference herein in their entirety.

Figure 31:
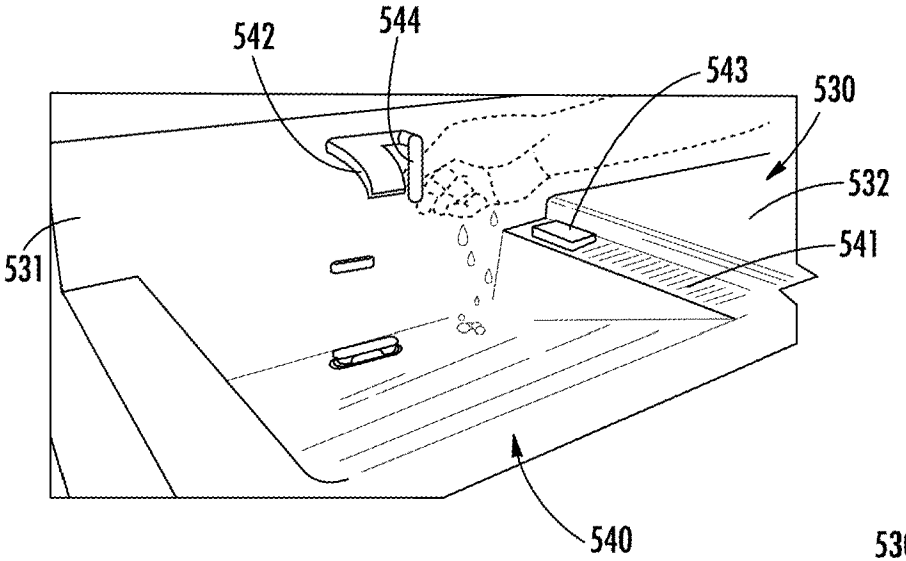
FIG. 31 is a perspective view of the sink of the sink assembly of FIG. 28A.

The faucet 542 and the control 544 may be positioned at least partially within the sink 540 in order to prevent water from being dripped outside of the sink 540 (e.g., onto the counter 532) when the control 544 is turned off, which keeps the sink assembly 530 more clean. For example, water dripping off of the user's hand while the control 544 is being moved to turn off the faucet 542 simply drops back into the sink, rather than on the top surface of the counter 532, as shown in FIG. 31.

Figure 33A:
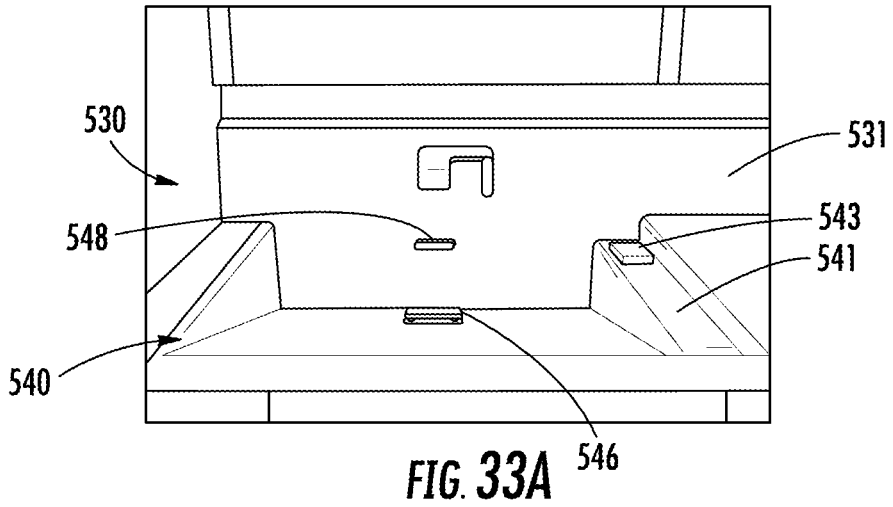
FIG. 33A is a front view of the sink of FIG. 31.
Figure 33B:
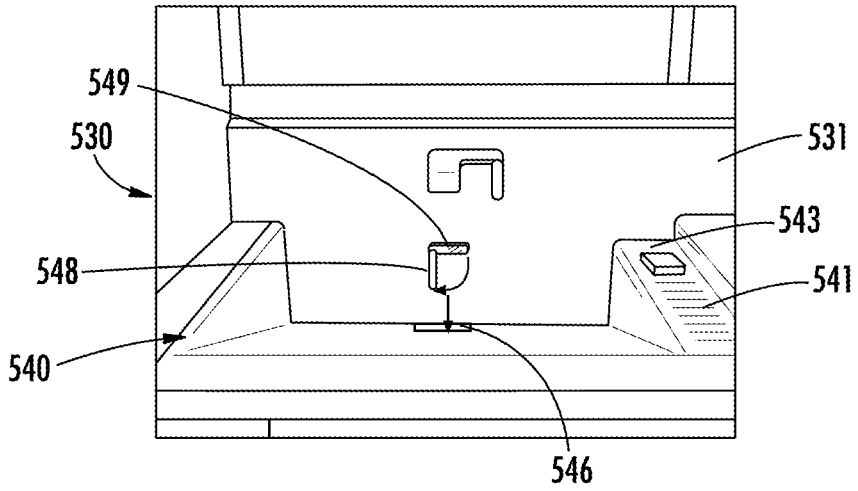
FIG. 33B is a front view of the sink of FIG. 31.

As shown in FIGS. 33A-33, the sink assembly 530 may also include a drain 546 and a drain actuator or lever 548 in order to allow the user to fill up the sink 540 with water. The drain 546 may be a simple pop-up style drain. By rotating the drain lever 548 relative to the sink 540, the cover of the drain 546 may be moved between an open state and a closed state to allow or prevent the water from flowing from the sink 540 and through the drain 546.

Additionally, the drain lever 548 may also act as a cover for sink overflow when the drain 546 is open. Accordingly, by rotating the drain lever 548 in a direction that closes the drain 546, the sink overflow 549 may be revealed.

The drain lever 548 may include a wall escutcheon that includes a quarter-turn actuation for opening and closing the drain 546.

Storage Area

Figure 34A:
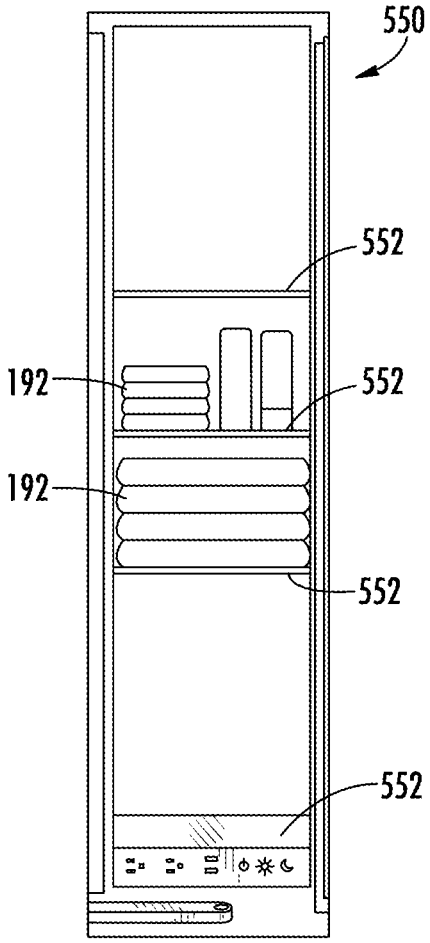
FIG. 34A is a front view of a storage area in the grooming area of FIG. 24 according to one embodiment.
Figure 34B:
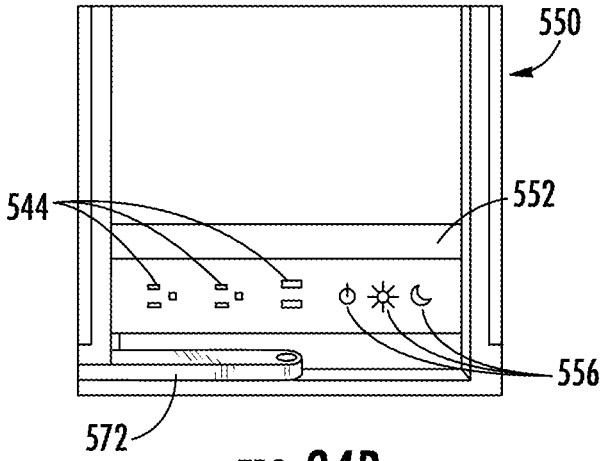
FIG. 34B is an enlarged portion of the storage area of FIG. 34A.
Figure 35:
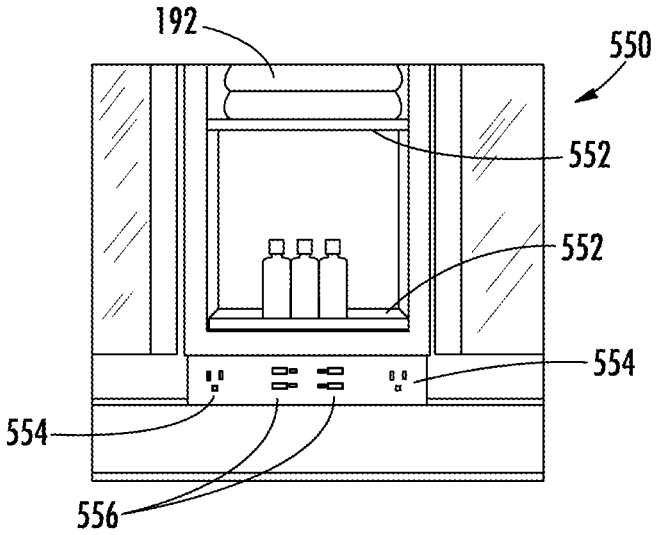
FIG. 35 is an enlarged portion of a storage area in the grooming area of FIG. 24 according to another embodiment.

As shown in FIGS. 34A-35, the grooming area 510 includes the storage area 550. As shown in FIGS. 24, 27, and 28A, the storage area 550 may be positioned above the sink assembly 530 and between the two mirrors 570, 580. Accordingly, the storage area 550 is within the transition area 536 (i.e., between the wet area 534 and the dry area 538) and divides the wet area 534 and the dry area 538 such that the items in the storage are 550 are accessible from both the wet area 534 and the dry area 538.

The storage area 550 may include shelves 552 for various items, products, and/or towels 192 (e.g., hand towels and/or washcloths) to be stored and/or displayed within easy reach. Although it is understood that the storage area 550 can have a variety of different sizes and numbers of shelves 552, FIG. 34A shows how the storage area 550 can have four shelves 552. If the storage area 550 is used within a hotel room, the hotel's products, for example, could be displayed and stored on the shelves. The storage area 550 may also provide sufficient room such that the other shelves 552 can be used to store the user's own personal belongings, toiletries, or products.

The shelves 552 may be higher than and recessed relative to the sink assembly 530 (and specifically the sink 540), which prevents the shelves 552 and the items on the shelves 552 from getting wet.

Since the shelves 552 are open and not enclosed, the various items stored on the shelves 552 are clearly visible to the user, allowing the user to easily access and see everything on the shelves 552. Therefore, if the storage area 550 is used within a hotel room, the user may be less likely to forget their belongings on the shelves 552 since the belongings are clearly visible on the shelves 552.

As shown in FIGS. 34B and 35, the storage area 550 may also include integrated electrical outlets 554 to power or charge various electronics, such as grooming tools, hair dryers, or phones, as the user is getting ready or using the grooming area 510. The storage area 550 may further include light and power switches or controls 556 next to the outlets 554 that may be used to control or adjust various lights. For example, the controls 556 may be used to turn the lights 560 on or off or adjust the brightness, temperature, or intensity of the lights 560. In order to be easily accessible, the outlets 554 and the controls 556 may be located within the storage area 550 and just below the lowest shelf 552 of the storage area 550 (as shown in FIG. 34B) or just outside of (e.g., underneath) the storage area 550 (as shown in FIG. 35).

As shown in FIG. 34B and FIG. 35, the storage area 550 may have a variety of different configurations, shapes, sizes, and designs in order to provide different aesthetics within the grooming area 510. It is understood that the various designs, configurations, shapes, and features can be integrated with each other.

Lights

Figure 36A:
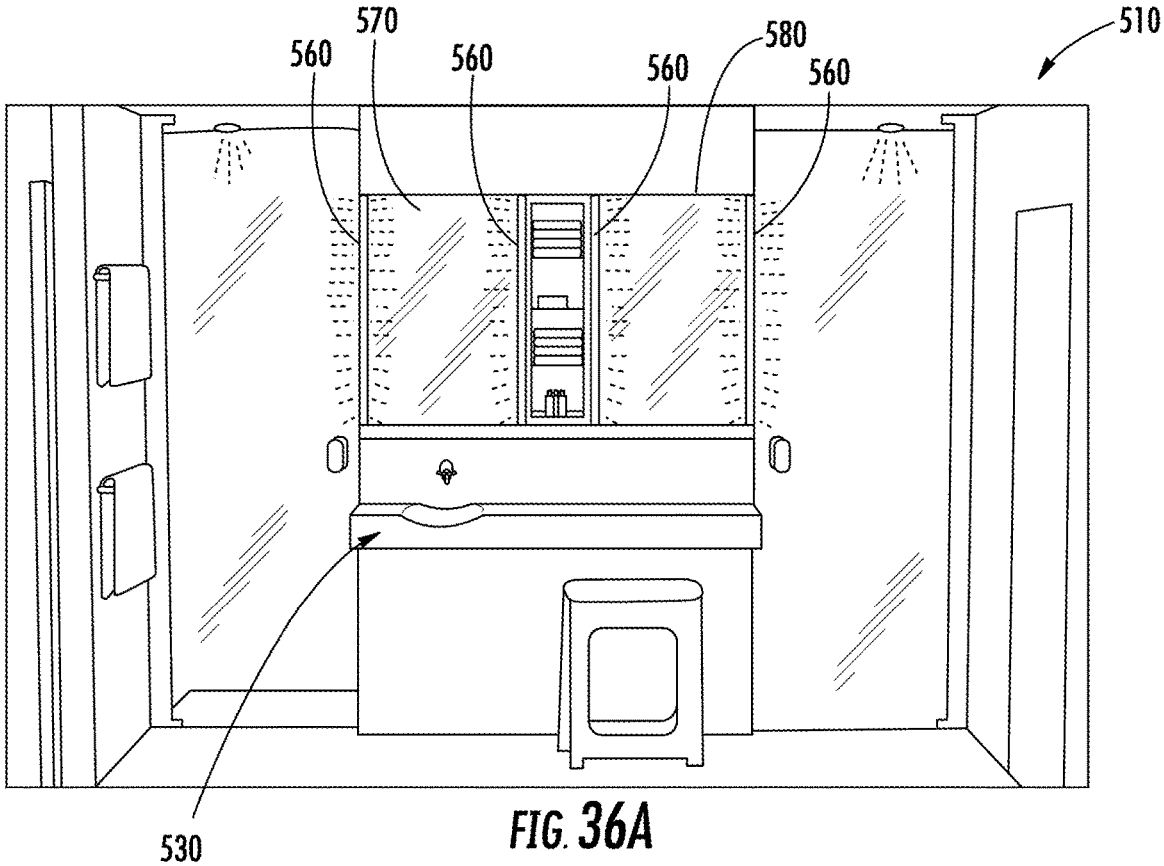
FIG. 36A is a front view of the grooming area of FIG. 24 with the lights turned up.
Figure 36B:
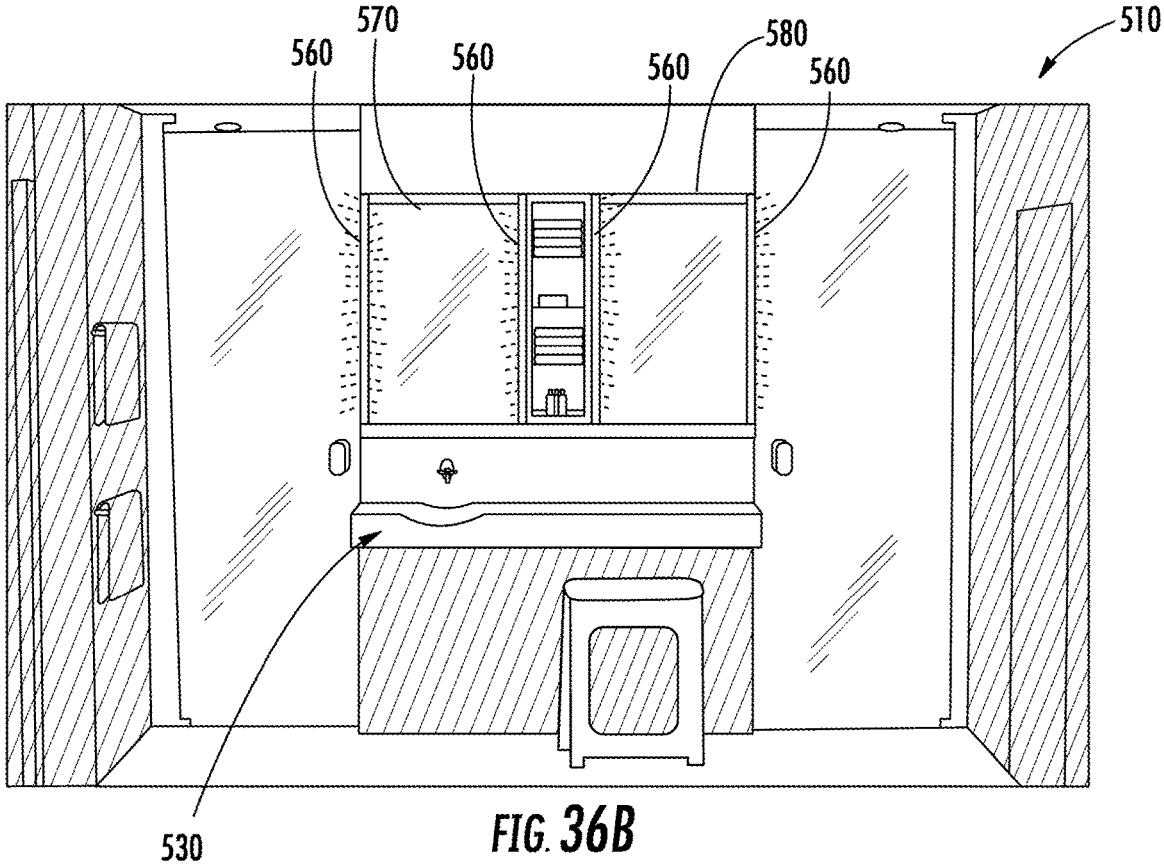
FIG. 36B is a front view of the grooming area of FIG. 24 with the lights turned down.

As shown in FIGS. 36A-36B, the light fixtures, lighting systems, or lights 560 in the grooming area 510 are positioned to illuminate at least the entire sink assembly 530 and mirrors 570, 580 and allow the user to easily see themselves in the mirrors 570, 580 without leaning toward the mirror to compensate for bad lighting. Accordingly, the lights 560 may surround at least a portion of the perimeter of the mirrors 570, 580.

Each of the mirrors 570, 580 may have at least one light 560. As shown in FIGS. 36A-36B, the lights 560 may extend on both sides of each of the mirrors 570, 580 and along the entire height of the mirrors 570, 580. However, it is understood that the lights 560 may also or alternatively be positioned in a variety of different places on the mirrors 570, 580 (such as the top and/or the bottom of the mirrors 570, 580). Alternatively or additionally, the lights 560 may be positioned in other areas within the grooming area 510 or to the sides of the mirrors 570, 580 on the second side 66 of the second wall 64.

The brightness, temperature, or intensity of the lights 560 may automatically adjust or transition throughout the day and according to the time of day to correlate to the user's circadian rhythm. For example, in the morning, the lights 560 may automatically be relatively bright in order to help the user get ready for the day (as shown in FIG. 36A). In the evening, however, the lights 560 may have a relatively warmer hue to help the user transition to sleep (as shown in FIG. 36B). In the nighttime, the brightness of the lights 560 may optionally be very low to function as nightlights. If the user prefers a different setting, the user may also have the option to manually control or adjust the brightness, temperature, or intensity of the lights 560 by using the controls 556 (as shown in FIGS. 34A-35, for example).

Adjustable Mirrors

As shown in FIGS. 37A-39D, the grooming area 510 may include adjustable mirrors 570, 580 to allow the user to easily see themselves when using the sink assembly 530 or simply when within the grooming area 510. Each of the mirrors 570, 580 may be moved or adjusted by the user in order to be positioned in the optimal location and distance relative to the user. For example, the mirrors 570, 580 can be moved in order to allow the user to obtain a closer look at themselves or to obtain a different viewing angle of themselves. Accordingly, the user does not have to strain their eyes or neck, lean toward the mirror, or bend over in order to obtain a close look at themselves in the mirrors 570, 580 or to obtain the optimal view of themselves in the mirror 570, 580. The mirrors 570, 580 may also be positioned such that the user can see the back of their head as they are putting the final touches on their hair, for example.

When the mirrors 570, 580 are not moved or adjusted, the adjustable mirror 570 is positioned within the wet area 534 and the adjustable mirror 580 is positioned within the dry area 538. However, it is understood that the adjustable mirror 580 may be positioned within the wet area 534 and/or the adjustable mirror 570 may be positioned within the dry area 538. It is also understood that only one of the mirrors 570, 580 may be used within the grooming area 510 and that a stationary mirror may be used instead. Furthermore, as shown in FIGS. 37A-37D and 39A-39D, the mirrors 570, 580 can be adjusted or moved at the same time or independently from each other.

As shown in FIGS. 37A-37D, the mirror 580 may be mounted on a rail system in order to move or adjust the mirror 580 straight forward and straight backward within the dry area 538 toward or away from the user. Accordingly, the user can position the mirror 580 directly closer to or further from their face to enhance close-up viewing and according to their desired position, which may be particularly beneficial while applying makeup. For example, the user may pull the mirror 580 forward out of its stored position, which causes the mirror 580 to float or slide forward away from the second wall 64. The rail system may be similar to cabinet rails that only allow a forward and backward sliding movement.

Figure 37A:
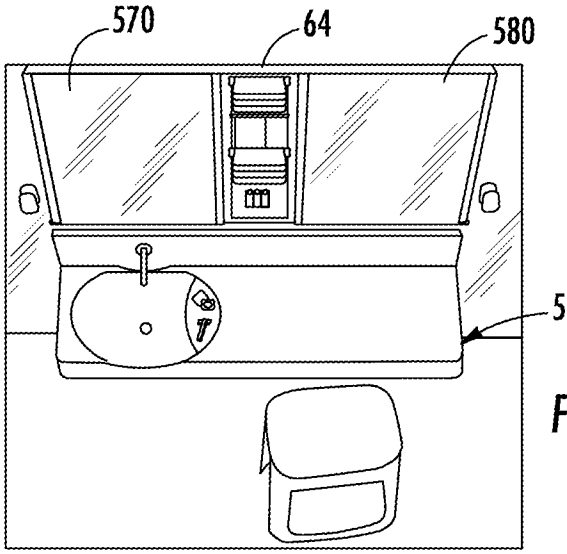
FIG. 37A is a top view of the grooming area of FIG. 24 with both the right and left mirrors in a first position.
Figure 37B:
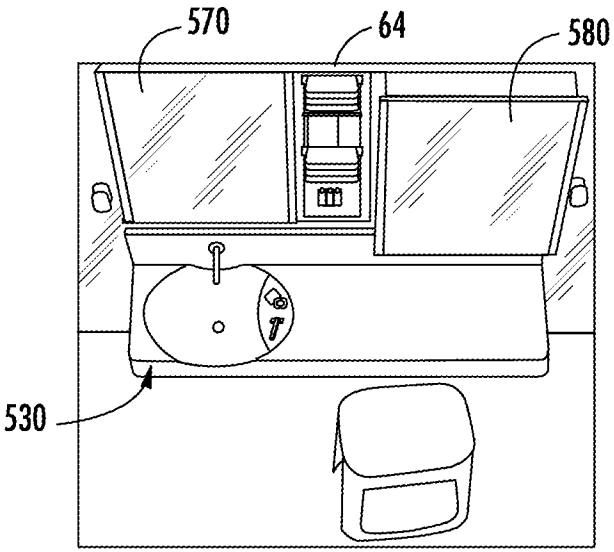
FIG. 37B is a top view of the grooming area of FIG. 24 with the left mirror in the first position and the right mirror in a second position.
Figure 37C:
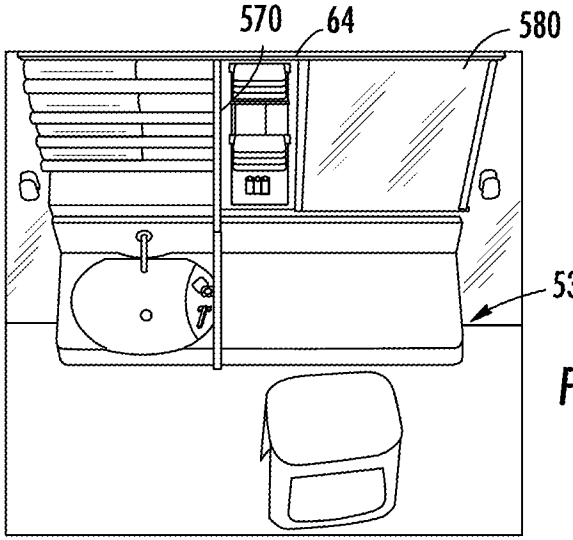
FIG. 37C is a top view of the grooming area of FIG. 24 with the left mirror in a second position and the right mirror in the first position.
Figure 37D:
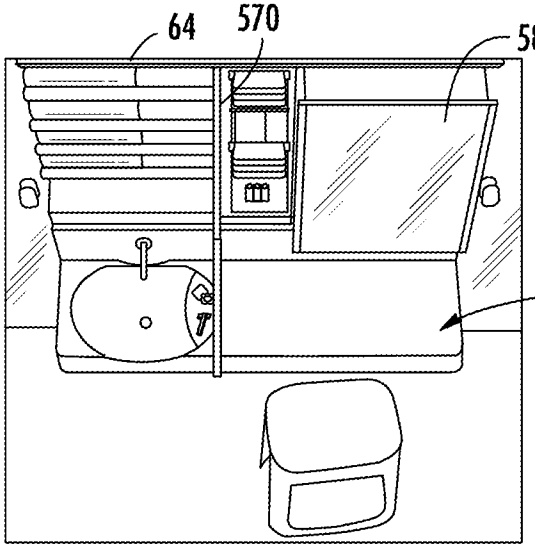
FIG. 37D is a top view of the grooming area of FIG. 24 with both the left and right mirrors in the second position.

As shown in FIGS. 37A-38, the mirror 570, which is stored within the wet area 534, can be pivoted relative to the second wall 64 in order to allow the user to obtain a different viewing angle of their face in the mirror 570, such as a side view or a back view (if used in conjunction with mirror 580). Accordingly, one side of the mirror 570 may be attached to the second wall 64 or to the storage area 550.

Figure 39B:
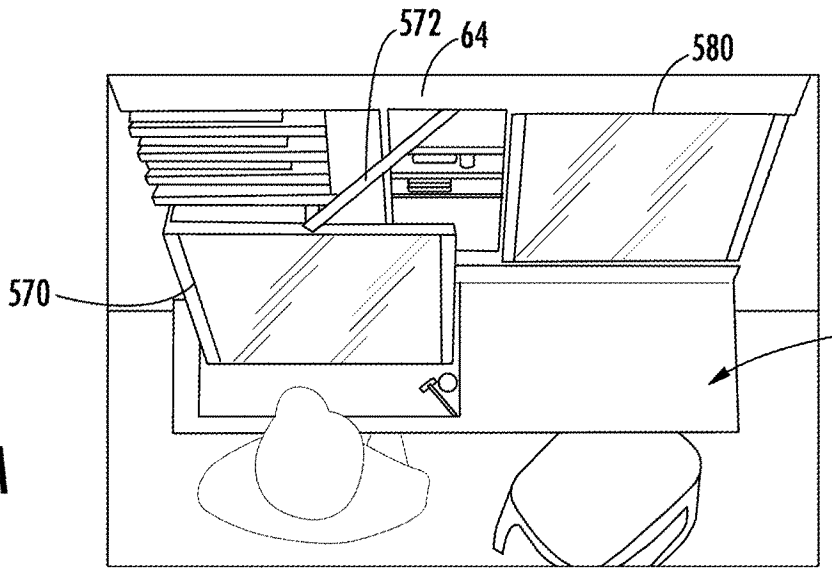
FIG. 39B is a top view of the grooming area with the left mirror in another second position.
Figure 39D:
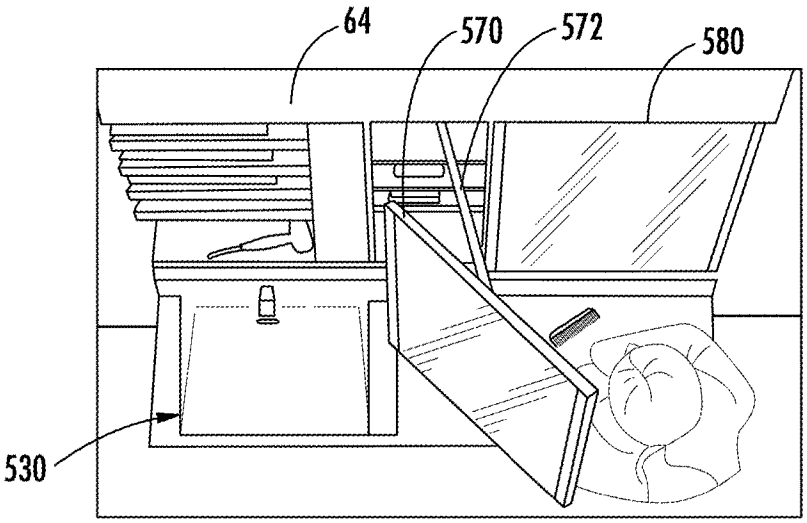
FIG. 39D is a top view of the grooming area with the left mirror in another second position.
Figure 39A:
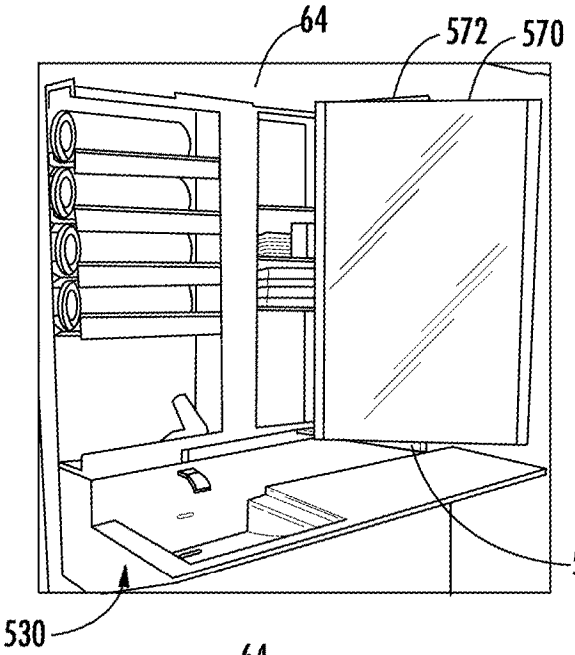
FIG. 39A is a perspective view of the grooming area with the left mirror in a second position.
Figure 39C:
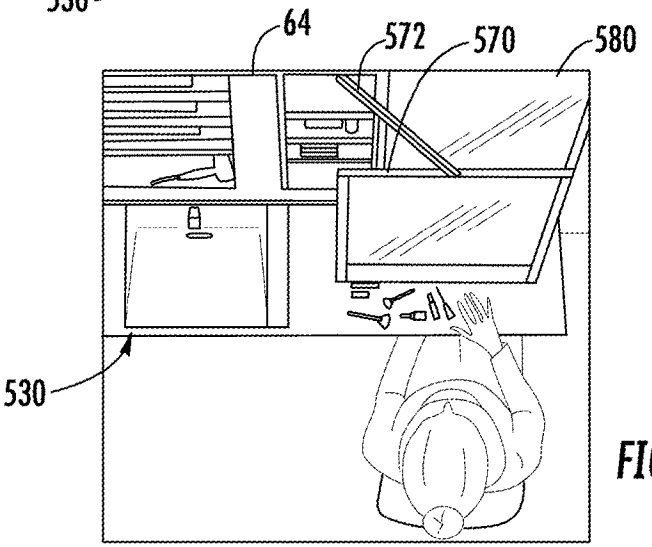
FIG. 39C is a top view of the grooming area with the left mirror in another second position.

According to another embodiment as shown in FIGS. 39A-39D, the mirror 570 can be both moved forward and pivoted. More specifically, the mirror 570 can be moved forward in order to allow the user to look more closely at themselves over the sink 540 in the wet area 534 (as shown in FIG. 39B). Alternatively or additionally, the mirror 570 can be swung over to the dry area 538 (as shown in FIG. 39C) or can be rotated relative to the arms 572 to allow the user to view the back of their head (as shown in FIG. 39D). When the mirror 570 is rotated relative to the arms 572, both sides of the mirror 570 can still be viewed if desired, as shown in FIGS. 39A and 39D.

In order to allow the position of the mirror 570 to be adjusted, the mirror 570 may be attached to at least two scissor bars, mirror pulls, or pivot arms 572. According to one embodiment, one end of each of the arms 572 is hingably or pivotably attached to a center point along each of the top and the bottom of the mirror 570. However, it is understood that the arms 572 may be attached to other areas of the mirror 570. The other end of each of the arms 572 may be hingably or pivotably attached to the second wall 64 and/or to a portion of the storage area 550 (such as an area just above and just below the storage are 550, as shown in FIG. 34B).

Pivoting the arms 572 relative to the second wall 64 allows the mirror 570 to move closer to or further from the second wall 64. From the stored position of the mirror 570 in the wet area 534, pivoting the arms 572 causes the entire mirror 570 move outward from the second wall 64 (as shown in FIG. 39B) and pivot away from the wet area 534 and into the dry area 538 (as shown in FIG. 39C).

Once the mirror 570 has moved at least partially away from the stored position, the mirror 570 can be folded, pivoted, or rotated relative to the arms 572 in order to provide a different view or angle, as shown in FIGS. 39A and 39D. Optionally, a second mirror may be positioned on the back of the mirror 570 which may provide additional viewing options to the user.

Storage Area

As shown in FIGS. 17-18 and 38, the grooming area 510 may have a towel rack or storage area or space 590 behind one or both of the mirrors 570, 580. Moving one of the mirrors 570, 580 may reveal and give access to the front of the storage space 590 and the contents stored within the storage space 590. The items in the storage space 590 are out of the way (and behind the mirror 570) when not needed, but are easily accessible when needed.

As shown in FIG. 38, the storage space 590 may be positioned on the second side 66 of the second wall 64 near the entrance into the shower area 110 (e.g., near the first end 67 of the second wall 64) in order to provide the occupant in the shower area 110 immediate access (without opening or moving the mirror 570) to the towels 192 in the storage space 590 through the side of the storage space 590 while the user is still in the shower area 110, as described further herein. By opening the mirror 570, the occupant may also easily access the front of the storage space 590 from the grooming area 510.

As shown in FIGS. 17-18, the storage space 590 may already be open along the side of the storage space 590, even when the mirror 570 is closed against the second wall 64. Accordingly, the user may access the towels 192, for example, from the side of the storage space 590 without moving the mirror 570.

The storage space 590 may have a variety of different configurations in order to store and hold various items (such as multiple towels 192 and/or a hair dryer 596) in an easily accessible manner. According to one embodiment, the storage space 590 may include multiple shelves 594 positioned in a vertical column in order to provide areas to store these items. The vertical column of towels 192, for example, allows each of the towels 192 to be stored on the storage space 590 and taking up minimal space within the grooming area 510 while still being accessible to the occupant while in the shower area 110 or when the mirror 570 is moved away from the second wall 64.

Layout of the Second Bathroom

As shown in FIGS. 40-65D, the second bathroom module or bathroom 1020 may include a variety of different bathroom fixtures, components, and features. A layout of the second bathroom 1020 (e.g., the "peninsula bathroom") is shown in FIGS. 40-45F. The second bathroom 1020 may connect to, for example, the room 22 (such a bedroom in a hotel or a home). The second bathroom 1020 may include many of the same or similar concepts, fixtures, components, features, and benefits described in regard to the first bathroom 20, but in a more compact space.

The second bathroom 1020 includes at least four spaces or areas: a shower space or area 1110, a transition space or area 1210, a toilet space or area 1310, and a grooming space or area 1510. The shower area 1110 may include (among other features) a shower valve assembly 1120 and a shower head assembly 1140 (that comprises a shower head 1148), a drain 1156, and an area for the occupant to use the shower valve assembly 1120 and the shower head assembly 1140 disposed therein. The transition area 1210 provides a space for the occupant to exit the shower area 1110 and may be used to get ready in. The transition area 1210 may be positioned or disposed between the shower area 1110 and the toilet area 1310 such that each of the shower area 1110 and the toilet area 1310 has an entrance directly into the transition area 1210 and the transition area 1210 has an entrance directly into the grooming area 1510 and the room 22 (and vice versa). The toilet area 1310 may include (among other features) a toilet assembly 1320 and an area for the occupant to use the toilet assembly 1320 disposed therein. The grooming area 1510 may include (among other features) a sink assembly 1530 (that comprises a faucet 1542) and other grooming area accessories, including but not limited to a towel bar 1520, cabinets, drawers, storage areas, electrical outlets 1554, lights 1560, mirrors 1570, 1580, and seating 1514 (e.g., a stool, a seat, or a chair) and designated space for the occupant to use these features. The second bathroom 1020 is configured such that the only entrance into the shower area 1110 is through the transition area 1510 and the only entrance into the toilet area 1310 is through the transition area 1510. The only entrance into the transition area 1510 (from an area aside from the shower area 1110 and the toilet area 1310) is from the grooming area 1510.

Figure 42:
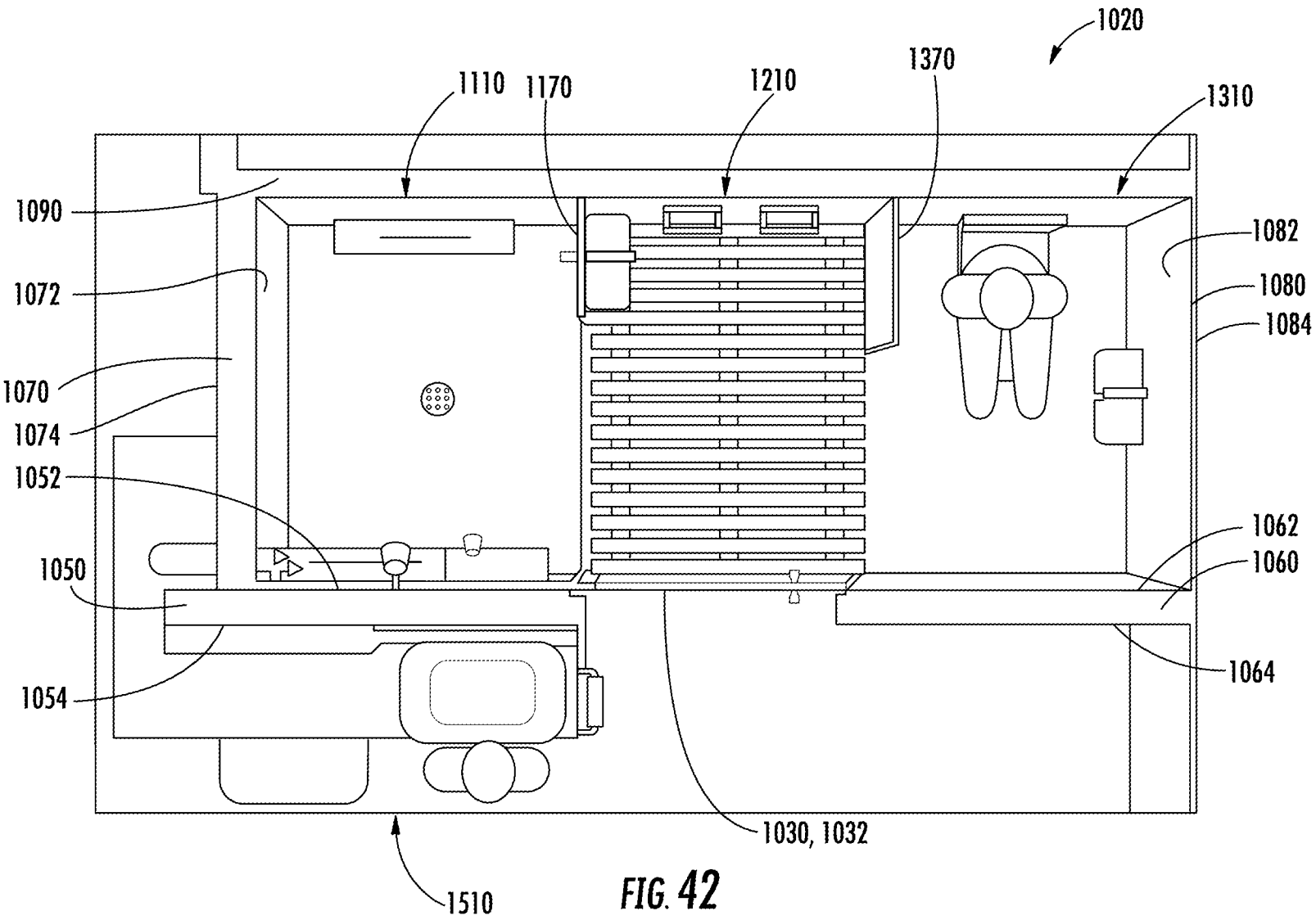
FIG. 42 is a top view of the second bathroom of FIG. 40 with occupants.

As shown in FIG. 42, the second bathroom 1020 comprises various walls in order to separate various portions of the second bathroom 1020. More specifically, the second bathroom 1020 comprises a shower area front wall 1050, a toilet area front wall 1060, a back wall 1090, a shower area side wall 1070, and a toilet area side wall 1080. The shower area front wall 1050, the toilet area front wall 1060, and the back wall 1090 may be substantially parallel to each other, and the shower area side wall 1070 and the toilet area side wall 1080 may be substantially parallel to each other such that the shower area front wall 1050, the toilet area front wall 1060, and the back wall 1090 and the shower area side wall 1070 and the toilet area side wall 1080 are substantially perpendicular to each other. As described further herein, the second bathroom 1020 further comprises a partial walls 1170 and 1370. The shower area front wall 1050 and the toilet area front wall 1060 may be aligned with each other along the lengths of the shower area front wall 1050 and the toilet area front wall 1060 such that the door 1030 creates a continuous wall with the shower area front wall 1050 and the toilet area front wall 1060 in the first position 1032.

The shower area 1110 is positioned between the shower area front wall 1050 and the back wall 1090 and between the shower area side wall 1070 and the transition area 1210 (and the shower area partial wall 1170). The toilet area 1310 is positioned between the toilet area front wall 1060 and the back wall 1090 and between the toilet area side wall 1080 and the transition area 1210 (and the toilet area partial wall 1370). The transition area 1210 is positioned between the back wall 1090 and the door 1030 (when the door 1030 is in the first position 1032) and between the shower area 1110 and the toilet area 1310 (and therefore between the partial walls 1170 and 1370). Accordingly, the back wall 1090 extends along the shower area 1110, the transition area 1210, and the toilet area 1310.

The shower area 1110 is positioned or disposed along a first side 1052 of the shower area front wall 1050 and a first side 1072 of the shower area side wall 1070. The toilet area 1310 is positioned or disposed along a first side 1062 of the toilet area front wall 1060 and a first side 1072 of the toilet area side wall 1080. According to one embodiment as shown in FIG. 42, the grooming area 1510 is positioned along a second side 1054 of the shower area front wall 1050 and a second side 1074 of the shower area side wall 1070. However, it is understood that, according to various embodiments, the grooming area 1510 may positioned along the second side 1054 of the shower area front wall 1050 and/or the second side 1074 of the shower area side wall 1070. Alternatively, the grooming area 1510 may positioned along a second side 1064 of the toilet area front wall 1060 and/or the second side 1084 of the toilet area side wall 1080.

Figure 40:
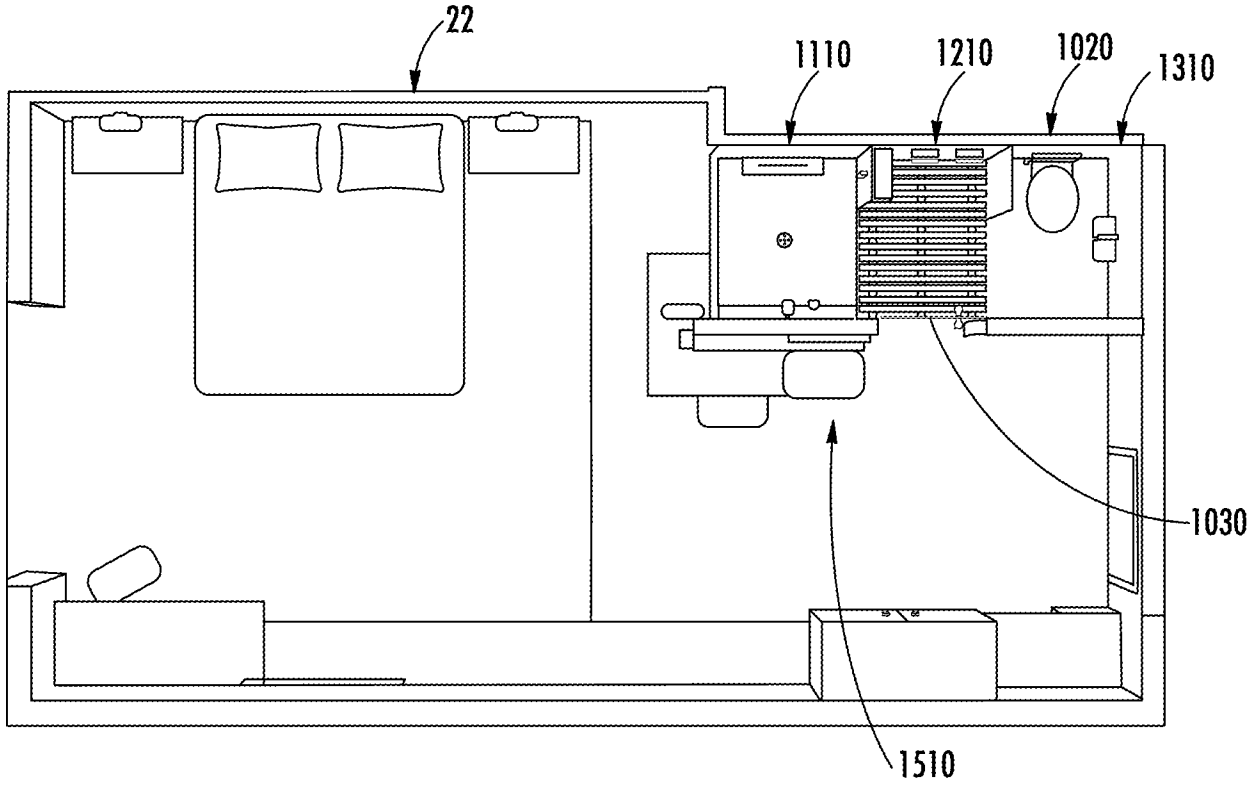
FIG. 40 is a top view of a layout of a second bathroom and a room.
Figure 41:
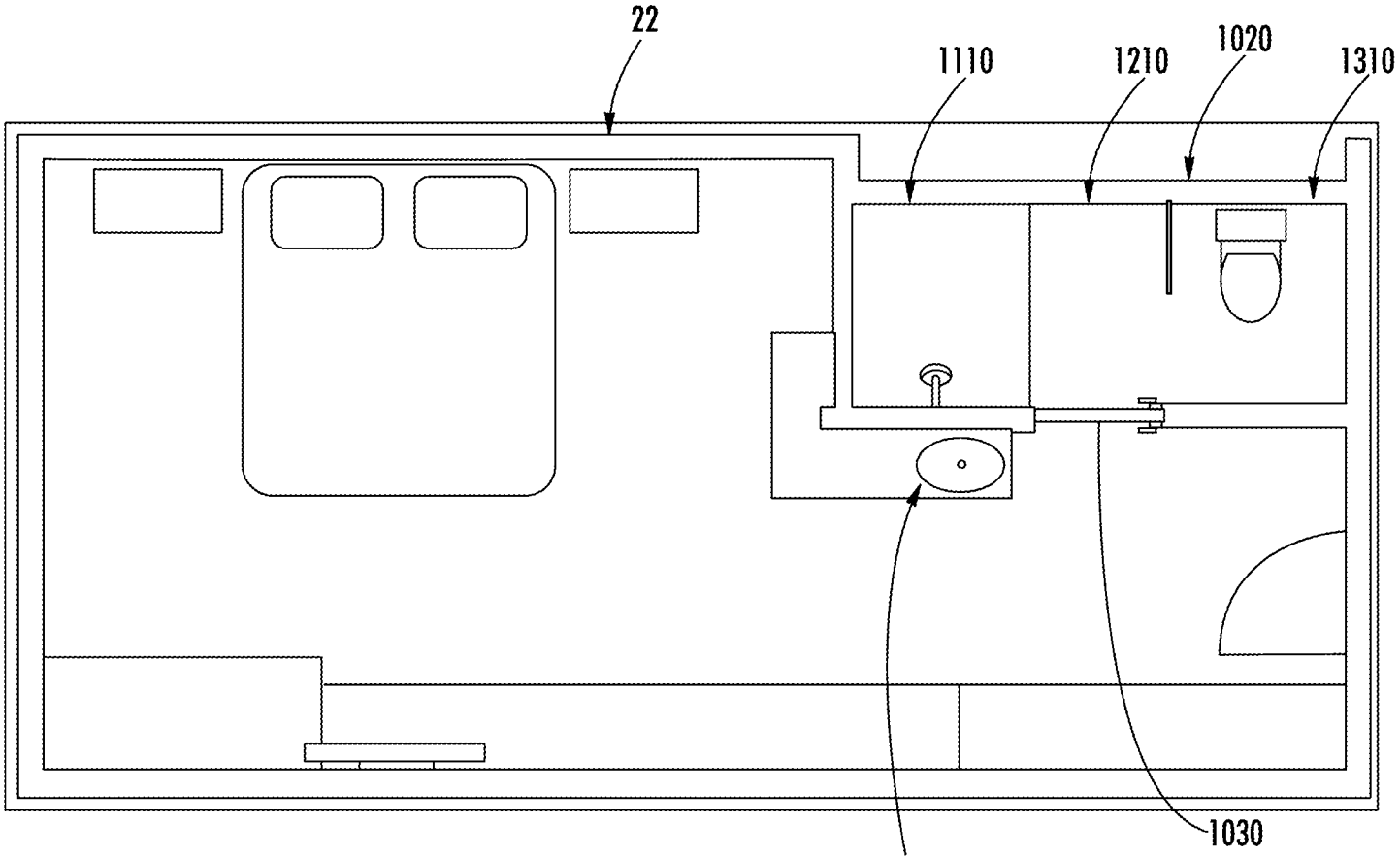
FIG. 41 is a top schematic view of the layout of the second bathroom of FIG. 40 and the room.

In the second bathroom 1020, the grooming area 1510 is separated from the shower area 1110, the transition area 1210, and the toilet area 1310 and instead is open to and at least partially shares space with the room 22, as shown in FIGS. 40-41. According to one embodiment, there are no walls between the grooming area 1510 and the room 22. This layout allows the grooming area 1510 to be used not only for, for example, grooming, washing hands, and getting ready, but also for, for example, entertaining, making coffee, and checking email.

The shower area 1110, the transition area 1210, and the toilet area 1310 are separate and private from the grooming area 1510 and the room 22, which creates a private zone, as shown in FIG. 42. The private zone may facilitate time efficiency, in particular if there is more than one person within the second bathroom 1020 and the room 22.

As shown in FIG. 42, the layout of the second bathroom 1020 (which includes the door 1030) provides privacy and personal space for the shower area 1110 (and optionally the transition area 1210 and the toilet area 1310, depending on the position of the door 1030) from the rest of the second bathroom 1020 and the room 22, even if they are simultaneously being used. For example, the door 1030 may conceal sights, smells, and sounds, provide visual privacy, and contain humidity. Accordingly, occupants may simultaneously use different areas of the second bathroom 1020 without invading each other's personal space.

Furthermore, the toilet assembly 1320 is no longer positioned in a central area within the second bathroom 1020 (compared to traditional bathrooms) in order to provide more privacy and a layout that is easier for the user to navigate.

According to one embodiment, the room 22 may be approximately 295 feet$^2$ and the second bathroom 1020 may be approximately 54 feet$^2$.

According to one embodiment, the second bathroom 1020 is a prefabricated as a transportable bathroom module that can be used within a variety of different spaces and next to a variety of different rooms.

Door

Figure 43B:
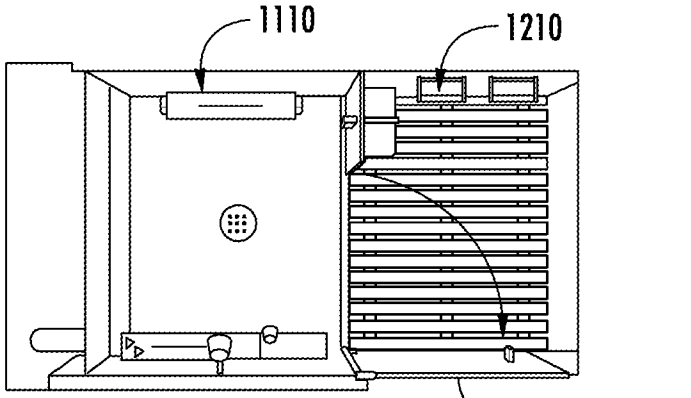
FIG. 43B is a top view of the second bathroom of FIG. 40 with the door in a first position.
Figure 43D:
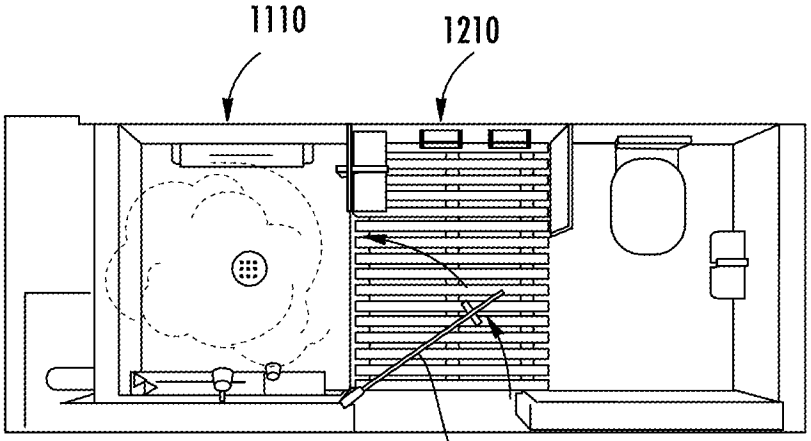
FIG. 43D is a top view of the second bathroom of FIG. 40 with the door moving into a second position.
Figure 43A:
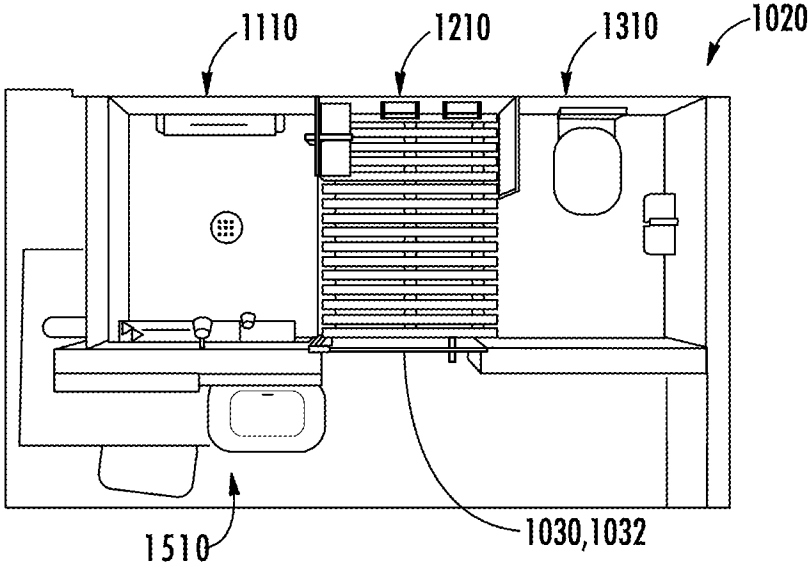
FIG. 43A is a top view of the second bathroom of FIG. 40 with the door in a first position.
Figure 43C:
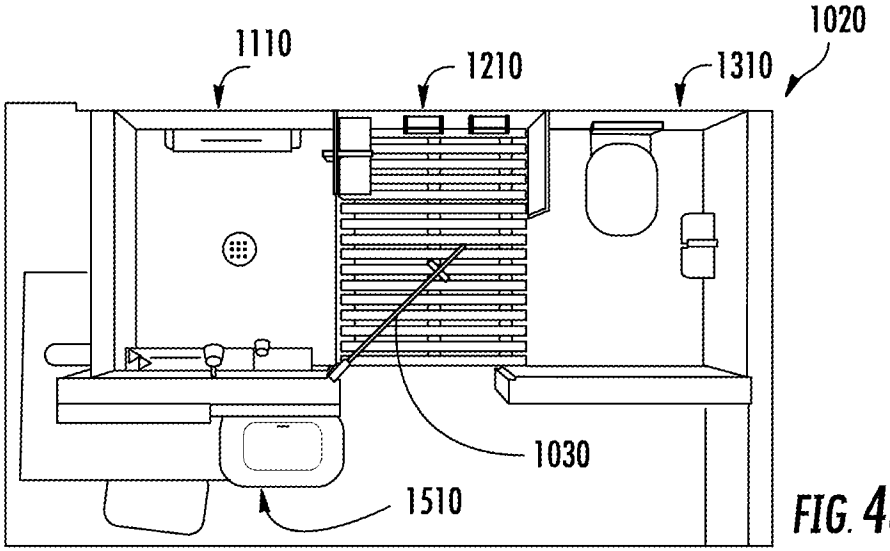
FIG. 43C is a top view of the second bathroom of FIG. 40 with the door moving into a second position.

In order to provide privacy to the shower area 1110, the transition area 1210, and the toilet area 1310 from the grooming area 1510 and the room 22, the second bathroom 1020 further comprises a movable door 1030 may be positioned within the second bathroom 1020, as shown in FIGS. 43A-43D. The door 1030 is movable, rotatable, or pivotable through a portion of the transition area 1210 between a first position 1032 and a second position 1034. Depending on the position of the door 1030, the door 1030 can enclose two different spaces or areas. For example, in the first position 1032 (as shown in FIGS. 43A-43B), the door 1030 may separate and divide the shower area 1110, the transition area 1210, and the toilet area 1310 from the grooming area 1510 and the room 22. Alternatively, in the second position 1034 (as shown in FIGS. 45F and 57A and the door 1030 is transitioning into the second position 1034 in FIGS. 43C-43D), the door 1030 may separate and divide the shower area 1110 from the transition area 1210, the toilet area 1310, the grooming area 1510, and the room 22. Accordingly, the door 1030 is "closed" in two different positions, enclosing either the "privacy zone" (i.e., the shower area 1110, the transition area 1210, and the toilet area 1310) or only the shower area 1110.

A first end of the door 1030 is hingably attached to an end of the shower area front wall 1050. In the first position 1032, the door 1030 is aligned with and substantially parallel to the shower area front wall 1050 and the toilet area front wall 1060. Additionally, a second end of the door 1030 is directly abutting or very close to an end of the toilet area front wall 1060 such that the door 1030 extends between the shower area front wall 1050 and the toilet area front wall 1060 in the first position 1032. In the second position 1034, the door 1030 is aligned with and substantially parallel to the shower area partial wall 1070 and therefore substantially perpendicular to the shower area front wall 1050 and the toilet area front wall 1060. Additionally, the second end of the door 1030 is directly abutting or very close to an end of the shower area partial wall 1070 such that the door 1030 extends between the shower area front wall 1050 and the shower area partial wall 1070 in the second position 1034.

As described further herein, by enclosing the shower area 1110, the transition area 1210, and the toilet area 1310 when the door 1030 is in the first position 1032, the occupant can move between and use each of the shower area 1110, the transition area 1210, and the toilet area 1310 with privacy. In the first position 1032, there are no doors separating the shower area 1110, the transition area 1210, and the toilet area 1310. By enclosing only the shower area 1110 when the door 1030 is in the second position 1034, the occupant can privately use the shower area 1110 while keeping in warmth and humidity and preventing the warmth and humidity from diffusing into the rest of the second bathroom 1020 or water from leaking or splashing out of the shower area 1110.

According to one embodiment, the door 1030 may be a hinged door that can move in either direction between the first position 1032 and the second position 1034. In the first position 1032 (as shown in FIGS. 43A-43B and 45A), the door 1030 encloses the shower area 1110, the transition area 1210, and the toilet area 1310 from the grooming area 1510 and the room 22 by directly closing off the entrance to the transition area 1210. In the second position 1034 (as shown in FIGS. 45F and 57A and the door 1030 is transitioning into the second position 1034 in FIG. 43D), the door 1030 encloses the shower area 1110 from the rest of the second bathroom 1020 and the room 22 by directly closing off the entrance to the shower area 1110. The movement of the door 1030 from the first position 1032 to the second position 1034 is shown in FIGS. 45A-45F. The door 1030 may follow the reverse movement of FIGS. 45A-45F to move from the second position 1034 back to the first position 1032.

Figure 44:
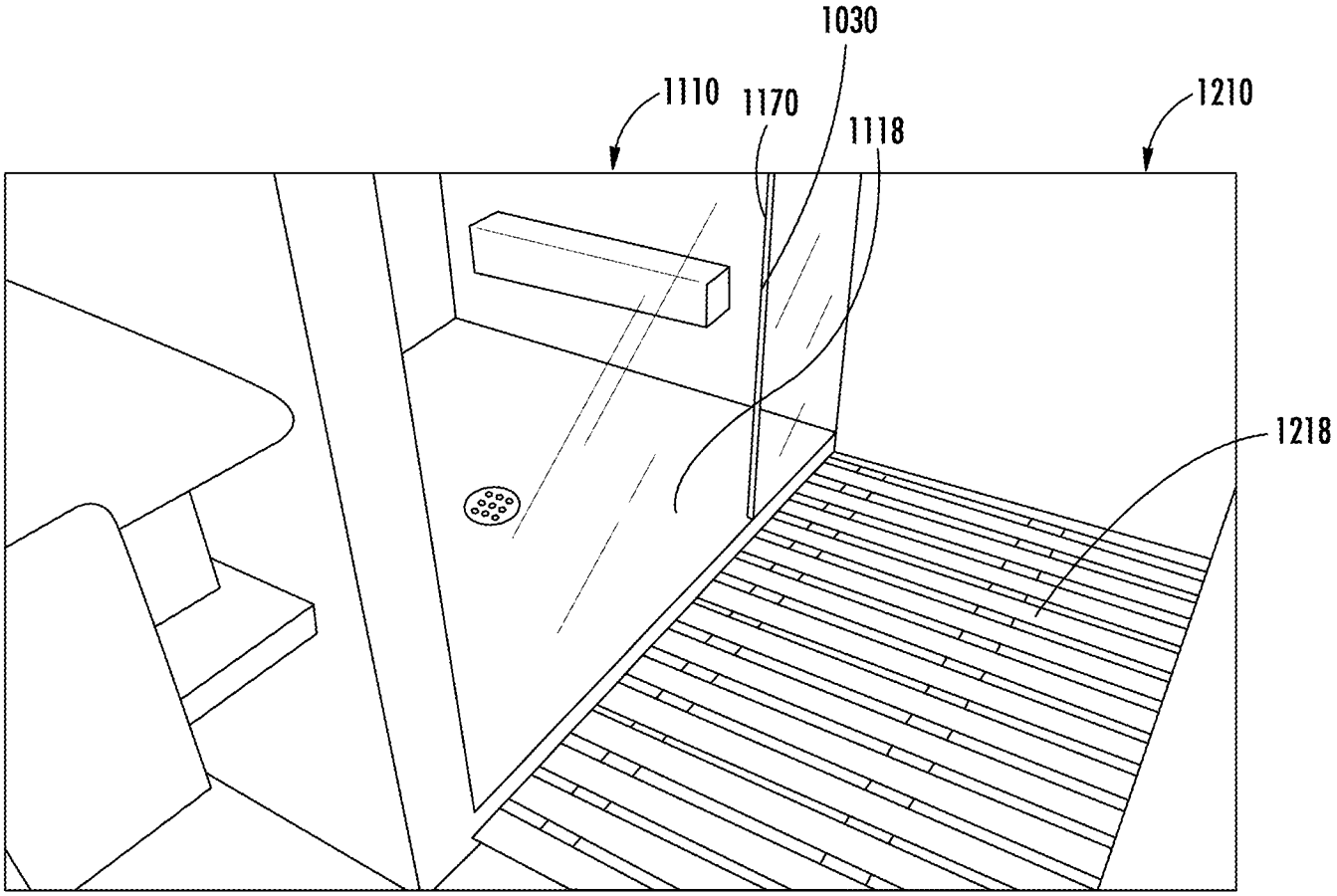
FIG. 44 is a perspective view of a portion of a transition area and a shower area of the second bathroom of FIG. 40.

The transition area floor 1218 of the transition area 1210 and the shower area floor 1118 of the shower area 1110 may be at two different vertical levels. For example, as shown in FIGS. 44-45F, the transition area floor 1218 is lower than the shower area floor 1118. Accordingly, in order to either seal with or come into close contact with the transition area floor 1218 in the first position 1032 and the shower area floor 1118 in the second position 1034 (to ensure privacy and/or prevent water leakage), the door 1030 may move vertically as the door 1030 transitions or is rotated between the first position 1032 and the second position 1034 to change the elevation of the door 1030 between at least two different levels, as shown in FIGS. 45A-45F.

Accordingly, the door 1030 may include or be attached to an elevating hinge that moves (e.g., lifts and lowers) the door 1030 vertically as the door 1030 is pivoted or rotated. The elevating hinge lifts the door 1030 as the door 1030 moves from the first position 1032 to the second position 1034 to accommodate the elevated shower area threshold and shower area floor 1118 and to provide privacy and contain humidity as the user uses the shower area 1110, for example. The elevating hinge also lowers the door 1030 as the door 1030 moves from the second position 1034 to the first position 1032 to accommodate the lowered transition area threshold and transition area floor 1218 and to provide privacy as the user uses the toilet area 1310, for example.

The door 1030 may be attached to a pole, cylinder, or rod 1040 that includes a slot 1042. Tabs 1046 may hold onto or be attached onto one end area or side of the door 1030 and may move within the slot 1042 of the rod 1040 as the door 1030 is pivoted between the first position 1032 and the second position 1034.

A seal, such as a rubber seal or an adhesive vinyl strip, may be attached to the door 1030 in order to allow the door 1030 to seal with a point of contact at each of the entrances to the transition area 1210 and the shower area 1110, thus further ensuring privacy and/or prevent water leakage. Alternatively or additionally, the seal may be positioned at each of the entrances to the transition area 1210 and the shower area 1110.

The door 1030 may be a variety of different materials according to the desired look of the second bathroom 1020. According to one embodiment, the door 1030 may be glass, such as a frosted, opaque, or etched glass, in order to allow some light through while still providing privacy.

Shower Area #2

As shown in FIGS. 46-51, the shower area 1110 is shown in greater detail. The shower area 1110 may include (among other features) a shower valve assembly 1120, a shower head assembly 1140, a drain 1156, a handle bar 1160, and a shower ledge 1180.

As shown in FIGS. 42, 46, 47, 49B, and 51, the second bathroom 1020 may include a shower area partial wall 1170 that extends along and encloses a portion of the entrance into the shower area 1110. The partial wall 1170 may be positioned between the shower area 1110 and the transition area 1210 and partially separates the shower area 1110 from the transition area 1210. The partial wall 1170 is substantially parallel to and spaced apart from the shower area side wall 1070 and the toilet area side wall 1080 and is substantially perpendicular to the back wall 1090. The door 1030 is aligned with (and parallel to) the partial wall 1170 and a free end of the door 1030 directly abuts or is very close to a free end of the partial wall 1170 when the door 1030 is in the second position 1034. As shown in FIG. 45F, the door 1030 may seal with an edge of the partial wall 1170 when the door 1030 is in the second position 1034. The partial wall 1170 may optionally be opaque glass.

As shown in FIGS. 41 and 56, the shower area 1110 may include a drain 1156 to drain water out from the shower area 1110. The drain 1156 may be out in the open in a middle area of the shower area 1110 in order to be easily accessed for cleaning and inspection.

Handle Bar and Towel Holder

In order to enter into the shower area 1110 from the transition area 1210 (or to exit the shower area 1110 into the transition area 1210), the occupant may utilize a vertical assist or handle bar 1160, as shown in FIGS. 46, 47, 52B, and 53B. The occupant may grab or grasp the handle bar 1160 as the occupant is moving or for stability while in the shower area 1110. Accordingly, the handle bar 1160 provides stability for the occupant and increases the safety within the second bathroom 1020. The handle bar 1160 may protrude out from the partial wall 1170 and into the shower area 1110.

Figure 46:
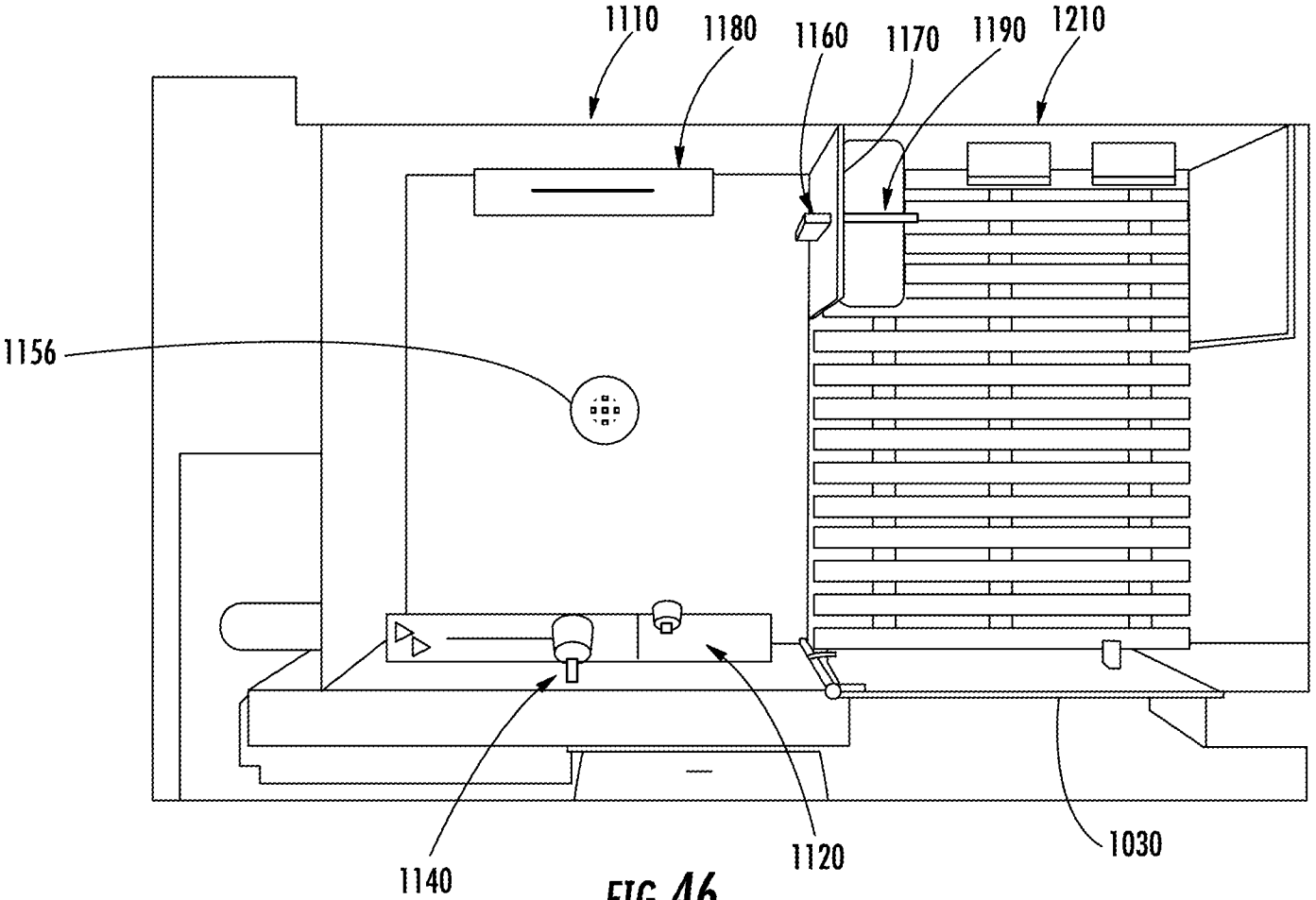
FIG. 46 is a top view of the shower area and the transition area of the second bathroom of FIG. 40.
Figure 47:
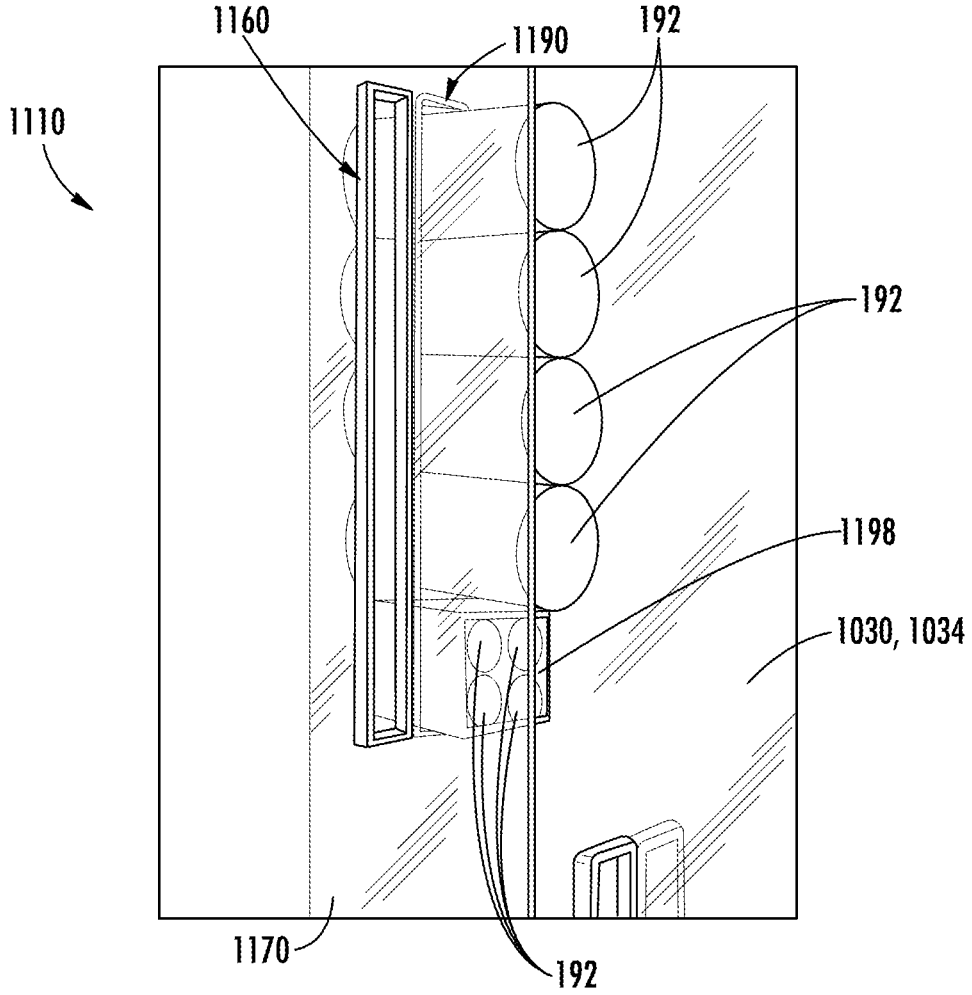
FIG. 47 is a perspective view of a handle bar in the shower area and a towel holder in the transition area of FIG. 46.
Figure 49A:
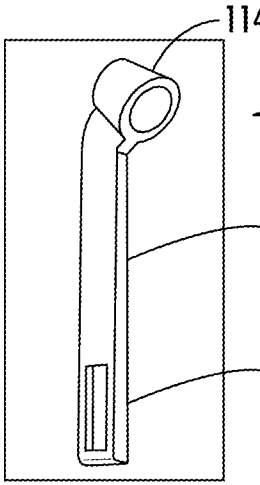
FIG. 49A is a perspective view of the shower head assembly in the shower area of FIG. 46.
Figure 49B:
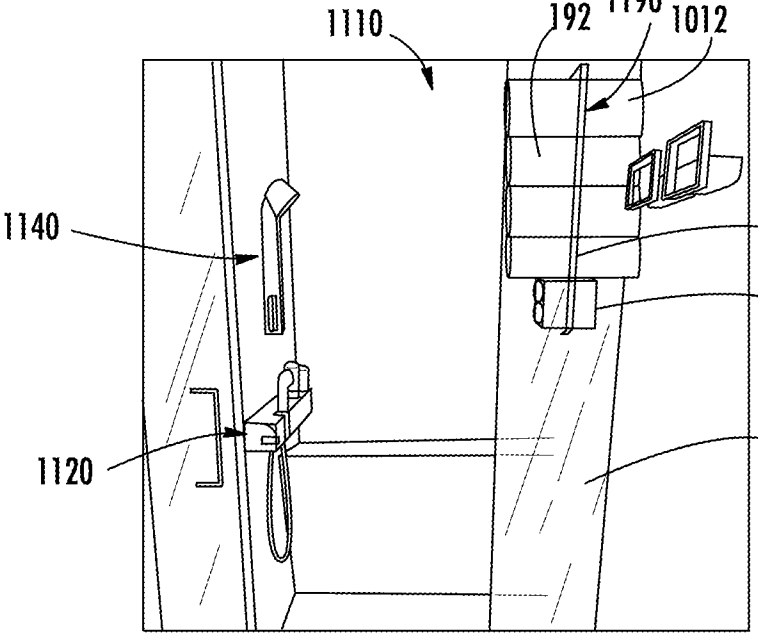
FIG. 49B is a side view of the shower area of FIG. 46.

The handle bar 1160 may be integrated as a part of or positioned with a fixture or towel holder 1190 that is on the opposite side of the partial wall 1170. For example, as shown in FIGS. 46, 47, and 49B, the handle bar 1160 may be positioned within the shower area 1110 and the towel holder 1190 may be positioned within the transition area 1210. The handle bar 1160 and the towel holder 1190 may be attached to opposite sides of the partial wall 1170 and may optionally be attached to each other through the partial wall 1170. The handle bar 1160 and the towel holder 1190 may be aligned with each other and directly opposite each other through the partial wall 1170. The handle bar 1160 may be at least partially spaced apart from the partial wall 1170 in order to allow the user to fully grasp the handle bar 1160.

As shown in FIGS. 47 and 49B, the towel holder 1190 is configured to hold and store towels 192 and is positioned just outside of the shower area 1110 and near the entrance and exit of the shower area 1110 in order to provide the occupant in the shower area 1110 immediate access to the towels 192 on the towel holder 1190 after showering. Accordingly, the occupant may easily reach or access and obtain a towel 192 on the towel holder 1190 without exiting or leaving the shower area 1110 by slightly opening the door 1030 (assuming the door 1030 is in the second position 1034) and reaching through the gap between the door 1030 and the partial wall 1170. The door 1030 may be slightly opened away from the shower area 1110 and into the transition area 1210. The user does not have to exit the shower area 1110 in order to obtain a dry towel 192 and therefore does not have to get cold while obtaining the towel 192 when the occupant is ready to dry off after showering, for example. Since the towel holder 1190 is behind the partial wall 1170 and within the transition area 1210, the towel holder 1190 prevents the towels 192 from getting wet while the occupant is taking a shower while still being conveniently located and accessible to the occupant in the shower area 1110.

The towel holder 1190 may have a variety of different configurations in order to store and hold towels 192 to be easily accessible. According to one embodiment as shown in FIG. 49B, the towel holder 1190 may include at least one vertical bar 1196 that helps hold a stack of multiple towels 192 in a vertical column. The towels 192 may be stored in a vertical column between two vertical bars 1196 or between a vertical bar 1196 and the partial wall 1170. The vertical column of towels 192 allows each of the towels 192 to be accessible to the occupant within the shower area 1110 while being stored on the towel holder 1190 and taking up minimal space within the transition area 1210.

Alternatively or additionally, the towel holder 1190 may also include a horizontal shelves or lower box 1198 to help organize and store multiple towels 192 of different sizes on the towel holder 1190. For example, the lower box 1198 may also be secured by a lower end of the at least one vertical bar 1196. The larger towels 192 may be positioned on top of the lower box 1198 and smaller towels 192 may be positioned within the lower box 1198.

Shower Valve Assembly

Figure 48A:
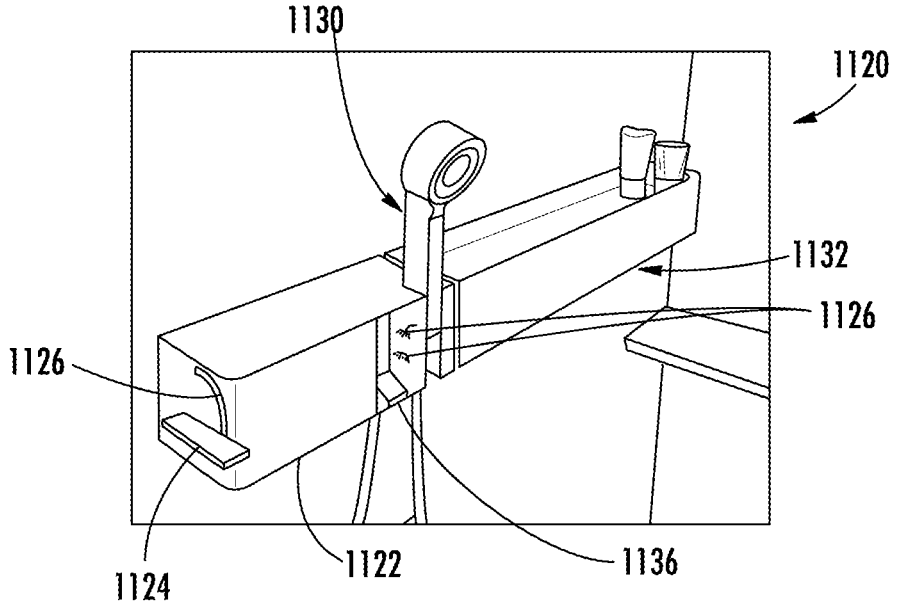
FIG. 48A is a perspective view of a shower valve assembly in the shower area of FIG. 46.
Figure 48B:
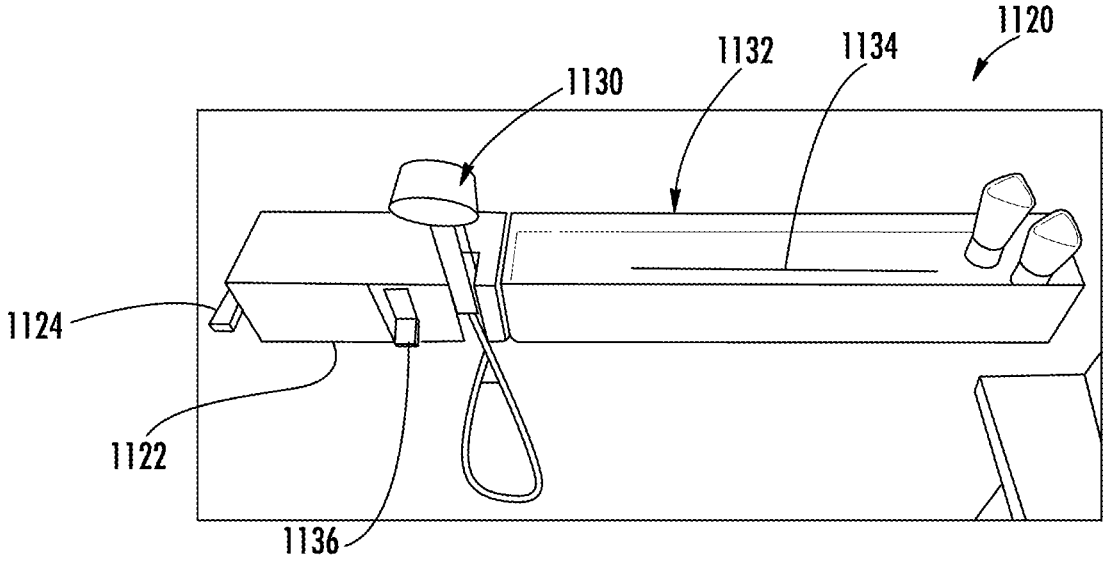
FIG. 48B is a perspective view of the shower valve assembly of FIG. 48A.

As shown in FIGS. 48A-48B, a shower control valve assembly 1120 may be used within the shower area 1110 in order to control the water flowing from the hand shower 1130 and/or the shower head assembly 1140. For example, the shower valve assembly 1120 controls whether or not water flows through the hand shower 1130 and/or the shower head assembly 1140 and the temperature of the water.

The shower valve assembly 1120 may include a base 1122 that is statically attached to a wall around the shower area 1110 and holds various components of the shower valve assembly 1120. The base 1122 can be attached to the wall through a variety of different mechanisms, including but not limited to magnets or bolts. According to one embodiment, the base 1122 (and therefore the rest of the components of the shower valve assembly 1120) may be positioned near the entrance to the shower area 1110 (e.g., close to the opening for the door 1030). The user does not have to enter into the shower area 1110 to control the shower valve assembly 1120 and therefore does not have to get wet while controlling the shower valve assembly 1120 or while the water is warming up.

The handle, valve control, or lever 1124 is movably or rotatably attached to the base 1122 of the shower valve assembly 1120 in order to control the water in the shower area 1110. By moving the lever 1124 relative to the base 1122, the hand shower 1130 and/or the shower head assembly 1140 are turned on and water is released (or turned off and the water is stopped). According to one embodiment, the flow rate of the water is uniform or consistent when the shower valve assembly 1120 is turned on, regardless of the position of the lever 1124 or the temperature of the water. However, it is understood that the shower valve assembly 1120 could also control the flow rate of the water.

The lever 1124 is rotatable a certain number of degrees relative to the base 1122. The lever 1124 may optionally be rotatable beyond the graphics 1126 in order to turn on or off the water flow. By further moving the lever 1124 relative to the base 1122, the temperature of the water can be controlled. To control or change the temperature, the lever 1124 can be moved relative to graphics 1126 on the base 1122 that indicate temperature level. The graphics 1126 can be positioned on the base 1122 in order to be clearly visible to the occupant from the transition area 1210 and from the shower area 1110 and may be easy to understand.

According to one embodiment, the graphics 1126 may include blue and red markings to indicate the hot and cold temperature settings for the water. The graphics 1126 may be immediately visible from the entrance to the shower area 1110 to allow the user to easily use and control the shower valve assembly 1120 without being in the shower area 1110.

The shower valve assembly 1120 may also include and hold a hand shower 1130 that sprays water and is removably attached to the base 1122. For example, the user may use the hand shower 1130 and then secure the hand shower 1130 back onto the base 1122 for storage. The hand shower 1130 may include a variety of different feature or settings, including but not limited to a muscle-relaxing massage feature to enhance the shower experience of the user. The spray face of the hand shower 1130 concentrates the flow of the water for a massaging effect.

The hand shower 1130 and the lever 1124 are positioned with each other as one unit on the base 1122. Since the hand shower 1130 is positioned on the base 1122 of the shower valve assembly 1120, and therefore near the lever 1124 of the shower valve assembly 1120, the user has direct access to the water at the point of control. Accordingly, the user can easily test or feel the actual temperature of the water and adjust the lever 1124 accordingly without moving their hand far.

The shower valve assembly 1120 may also include a knob, switch, or diverter 1136 to change whether the water is being expelled through the hand shower 1130 or through the shower head assembly 1140. By moving the diverter 1136, the user may change where the water is being diverted to. Graphics 1126 may also be included near the diverter 1136 to indicate whether water will be expelled through the hand shower 1130 or the shower head 1148.

However, it is understood that the shower valve assembly 1120 may not include the hand shower 1130 and instead may only control the shower head assembly 1140. It is also understood that the shower area 1110 may not include the shower head assembly 1140 and instead the shower valve assembly 1120 may only control the hand shower 1130.

The shower valve assembly 1120 may also include a storage tray 1132 to hold and store various shower items. The storage tray 1132 may provide sufficient room in order to display and hold both hotel products and the user's own personal belongings, toiletries, or products. The storage tray 1132 may be positioned next to the base 1122 of the shower valve assembly 1120. However, it is understood that the storage tray 1132 may be positioned apart from the shower valve assembly 1120 within the shower area 1110.

The storage tray 1132 may include an opening or slot 1134 that allows any excess or accumulated water in the storage tray 1132 to drain through the storage tray 1132. The slot 1134 may extend longitudinally along at least a portion of the length of the storage tray 1132. According to one embodiment, the slot 1134 may be positioned in the center of the storage tray 1132 (relative to the front and back of the storage tray 1132).

Shower Head Assembly

As shown in FIGS. 49A-50B, the shower area 1110 may include a shower head assembly 1140 that can be easily vertically adjusted to accommodate different user heights. The shower head assembly 1140 may optionally be positioned above the shower valve assembly 1120 along a wall around the shower area 1110.

Figure 49C:
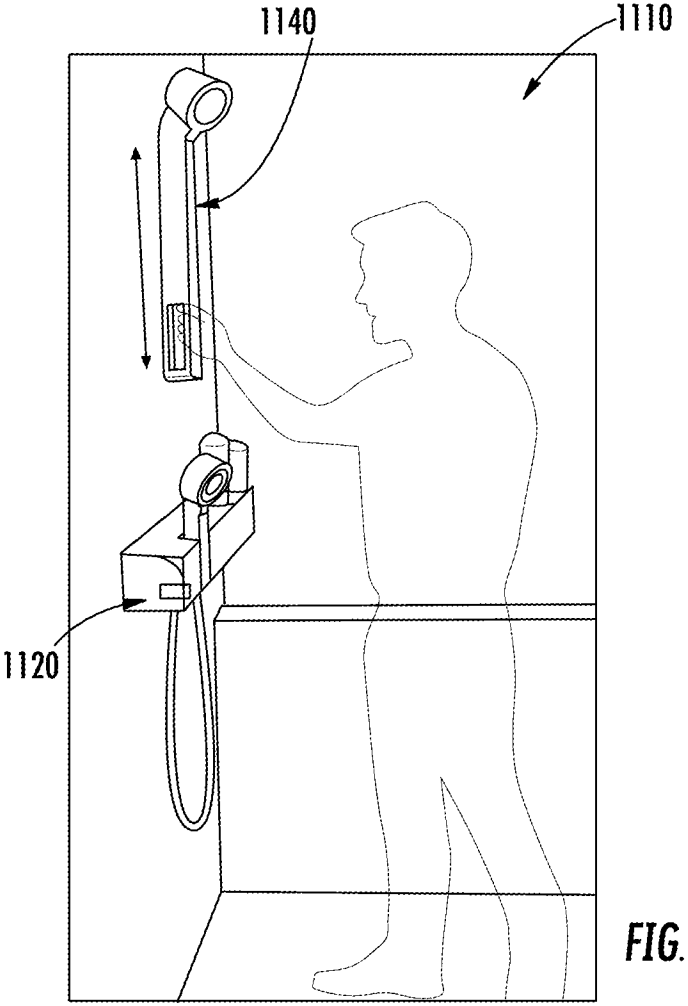
FIG. 49C is a side view of the shower area of FIG. 46 with an occupant.
Figure 50B:
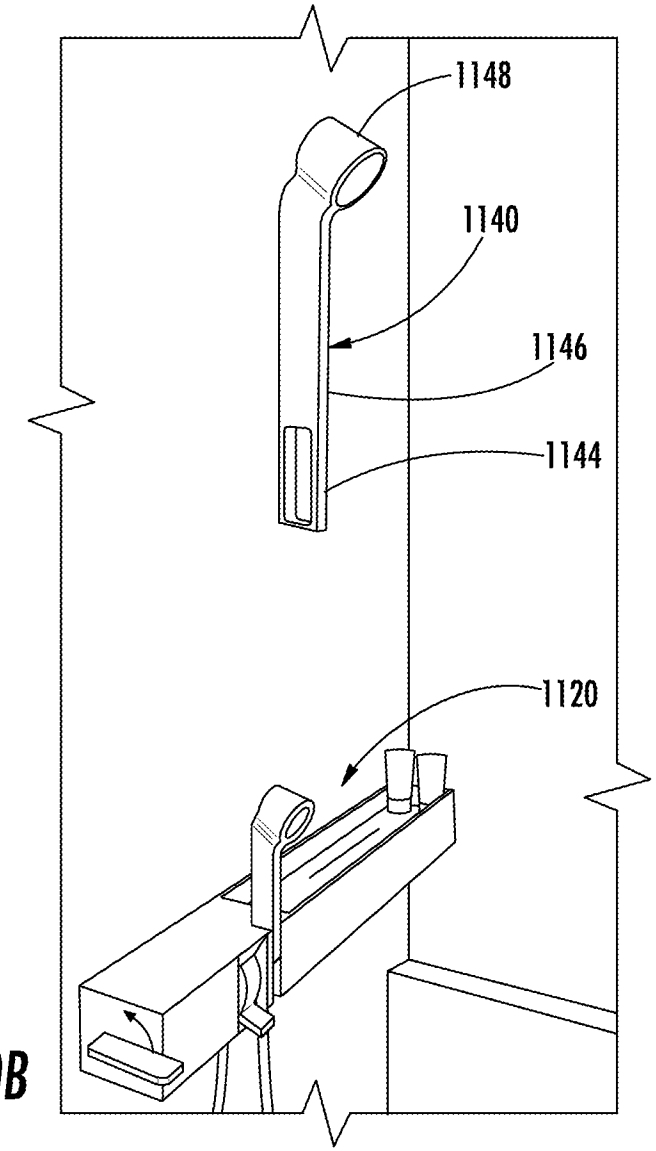
FIG. 50B is a perspective view of the shower head assembly of FIG. 49A in a higher position.
Figure 50A:
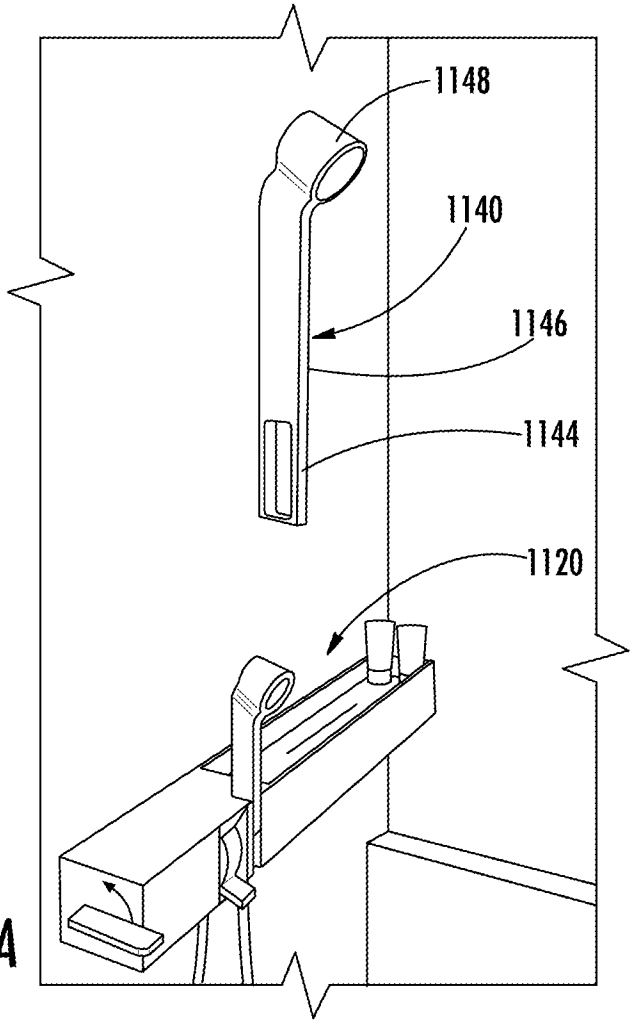
FIG. 50A is a perspective view of the shower head assembly of FIG. 49A in a lower position.

The shower head assembly 1140 may include a shower head 1148 that expels the water, a handle 1144, a shower column 1146, and a vertical track. As shown in FIG. 49C, in order to adjust the height of the shower head 1148, the user may grab and move the handle 1144 up and down, which causes the shower column 1146 and the shower head 1148 to move up and down along the track, thereby changing the height of the shower head 1148 (as shown in FIGS. 50A-50B).

The shower column 1146 may be the portion of the shower head assembly 1140 that connects the shower head 1148 and the handle 1144. The track may be concealed by the shower column 1146 in order to provide a seamless look within the shower area 1110. Furthermore, the shower head assembly 1140 does not include an external hose that may get in the way while the user is adjusting or using the shower head assembly 1140.

The height of the shower head 1148 may be infinitely adjustable. Accordingly, the shower head assembly 1140 may include a friction fit system between the track and the rest of the shower head assembly 1140. Alternatively, the shower head assembly 1140 may include a counterbalance cable system to maintain the position of the shower head 1148.

Shower Ledge

Figure 51:
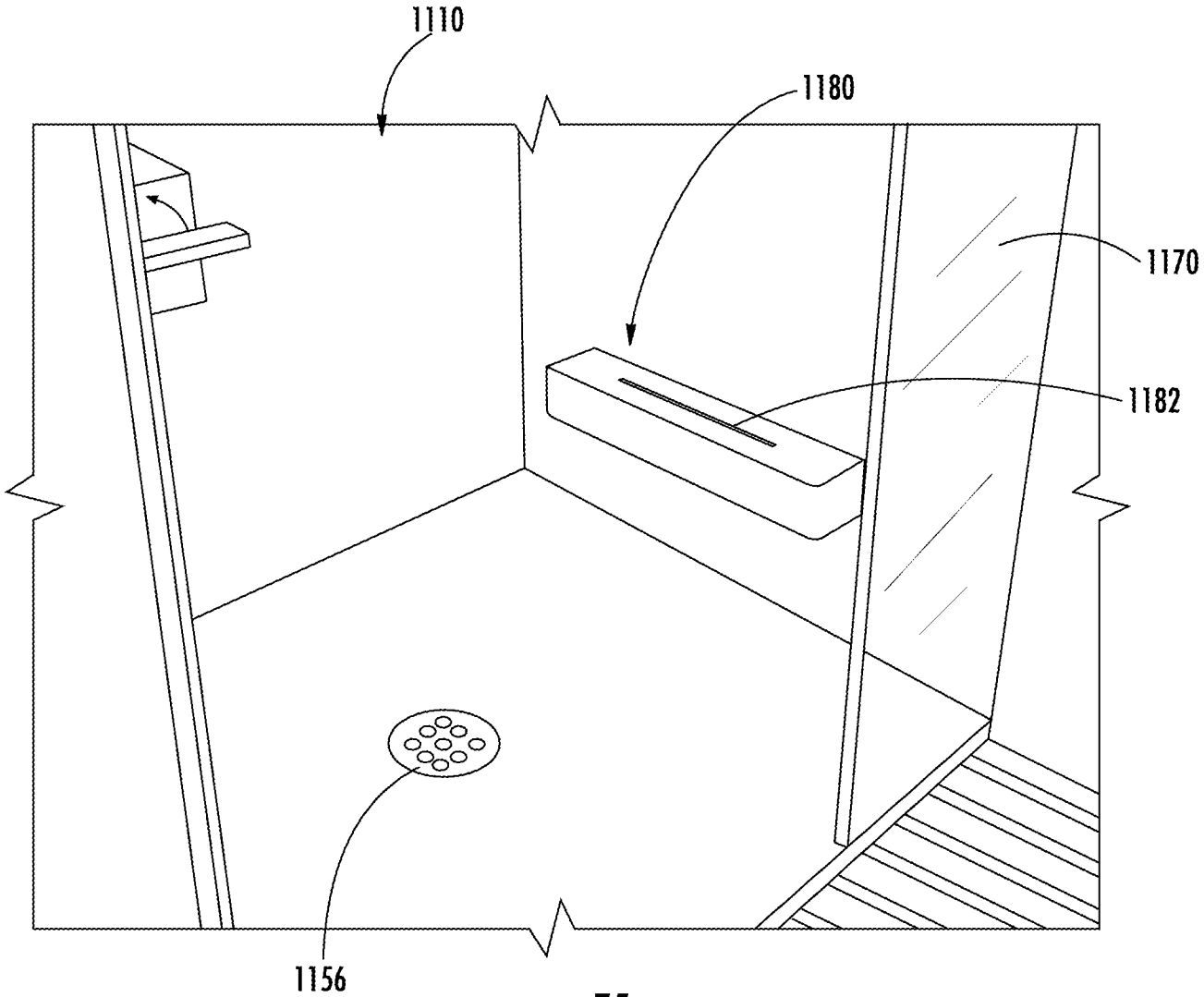
FIG. 51 is a perspective view of a foot ledge in the shower area of FIG. 46.

As shown in FIG. 51, the shower area 1110 may include a foot ledge or shower ledge 1180 that provides a substantially horizontal ledge or platform within the shower area 1110 for the occupant to use while in the shower area 1110. The occupant may use the shower ledge 1180 to care for their lower extremities with more stability and comfort, for example.

The occupant may use the shower ledge 1180 as a comfortable, stable, and secure spot or area to place or prop up their foot while in the shower area 1110 in order to, for example, shave their legs, wash between their toes, and dry their legs after showering more easily and safely. Accordingly, the occupant may more easily and safely balance with one foot on the floor and one foot positioned on the shower ledge 1180 while in the shower area 1110.

The shower ledge 1180 may be positioned relatively near the floor of the shower area 1110. The shower ledge 1180 may have a relatively wide and long platform in order to provide amble area for the occupant to rest their foot.

The shower ledge 1180 may also include an opening or slot 1182 that allows any excess or accumulated water to drain through. The slot 1182 may extend longitudinally along at least a portion of the length of the shower ledge 1180. According to one embodiment, the slot 1182 may be positioned in the center of the shower ledge 1180 (relative to the front and back of the shower ledge 1180).

Transition Area

As shown in FIGS. 43A-46 and 52A-53C, the transition zone or area 1210 is shown in greater detail. As described further herein, the transition area 1210 is positioned between the shower area 1110 and the toilet area 1310. The transition area 1210 may provide a private area for the occupant to get ready within while having privacy.

The occupant may use the transition area 1210 before and after showering in the shower area 1110. For example, the occupant may enter into the transition area 1210 while moving the door 1030 from the second position 1034 into the first position 1032 to close off the transition area 1210, the shower area 1110, and the toilet area 1310 from the rest of the second bathroom (e.g., the grooming area 1510) and the room 22 (as shown in FIGS. 43A-43B).

More specifically, before showering in the shower area 1110 and entering into the shower area 1110, the occupant may use the transition area 1210 to stage their clothes and prepare themselves (while the door 1030 is in the first position 1032). Once the occupant is ready to shower, the occupant may enter into the shower area 1110 and move the door 1030 from the first position 1032 into the second position 1034 to close off the shower area 1110 from the transition area 1210, the toilet area 1310, and the grooming area 1510 (thus containing humidity and preventing water leakage) (as shown in FIGS. 45F and 57A and the door 1030 is being moved into the second position 1034 in FIG. 43D). After showering, the occupant exits the shower area 1110 (thus entering into the transition area 1210) while moving the door 1030 from the second position 1034 back into the first position 1032 in order to use the transition area 1210 and to take advantage of privacy within the transition area 1210 to dry off and/or get dressed (as shown in FIGS. 43A-43B).

The transition area floor 1218 may include a porcelain tile mosaic that looks and feels warm in order to provide a comfortable and warm area for the occupant to stand on before and after showering.

Towel Hook

Figure 52A:
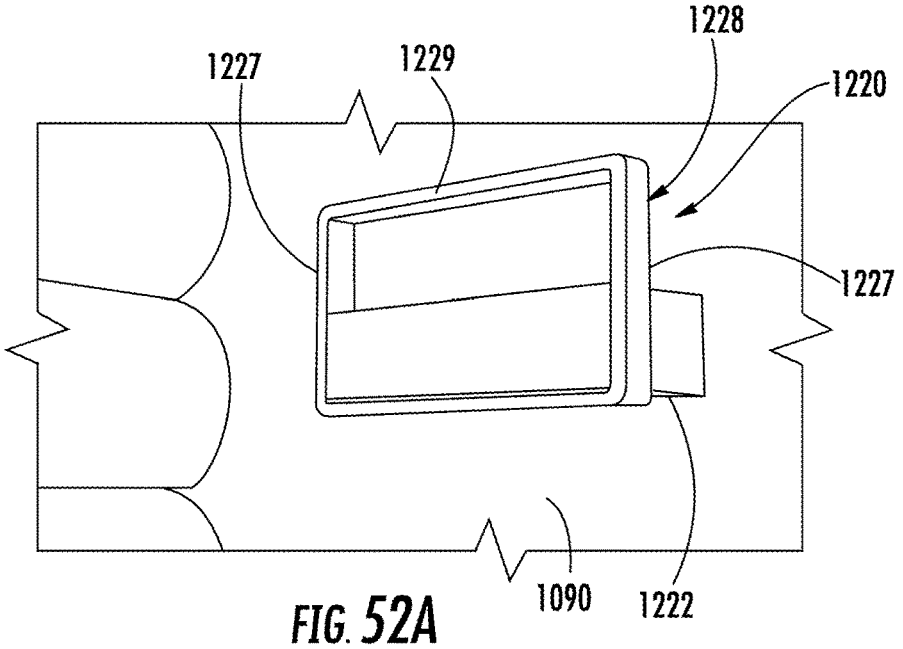
FIG. 52A is a perspective view of a towel hook in the transition area of FIG. 46 according to one embodiment.
Figure 52B:
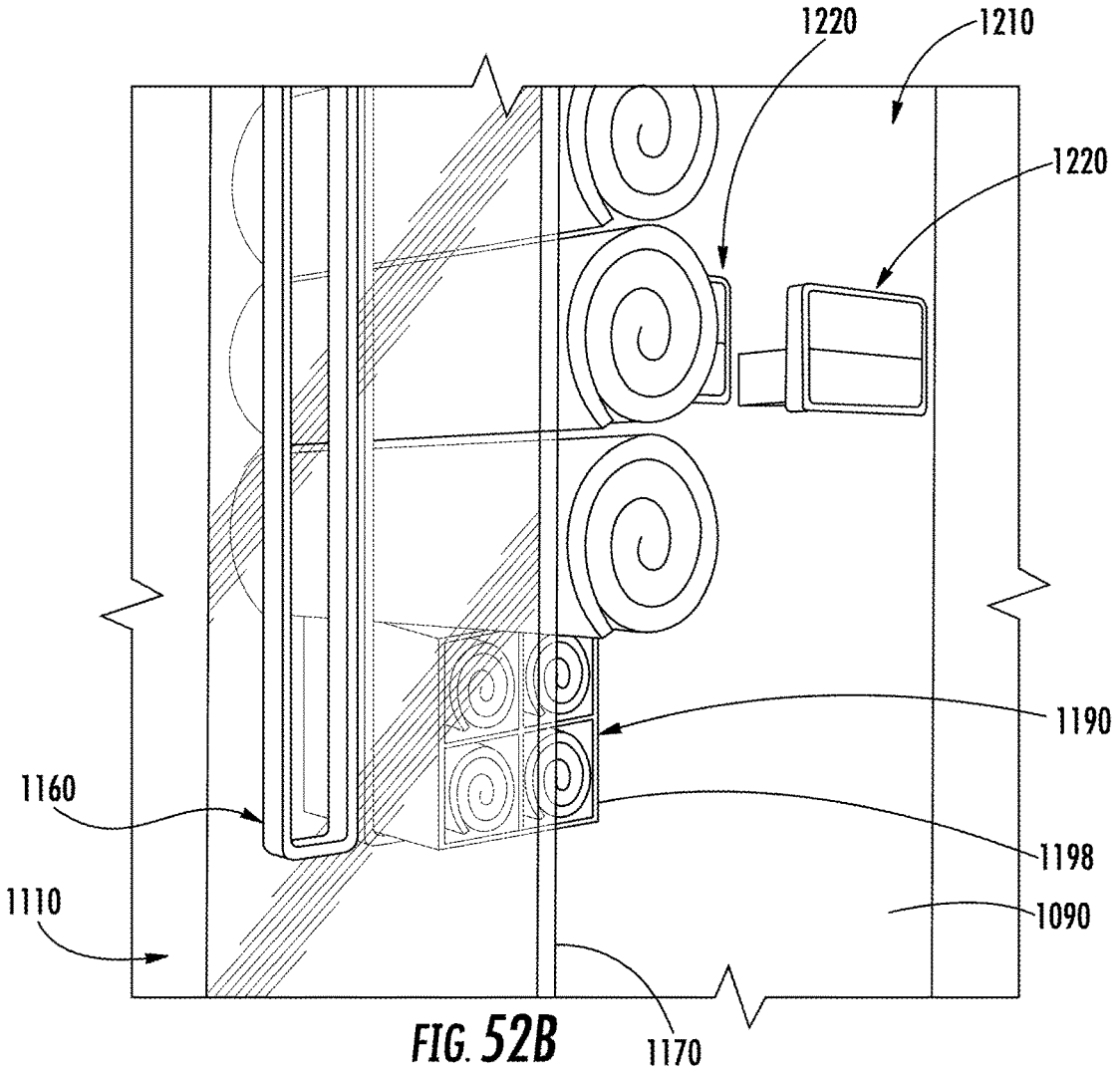
FIG. 52B is a perspective view of the towel hook of FIG. 52A.
Figure 53A:
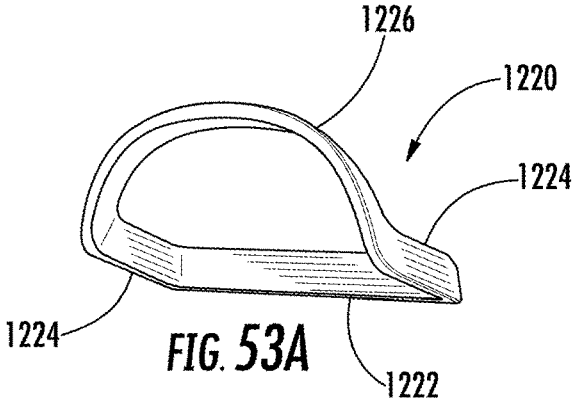
FIG. 53A is a perspective view of a towel hook in the transition area of FIG. 46 according to another embodiment.
Figure 53B:
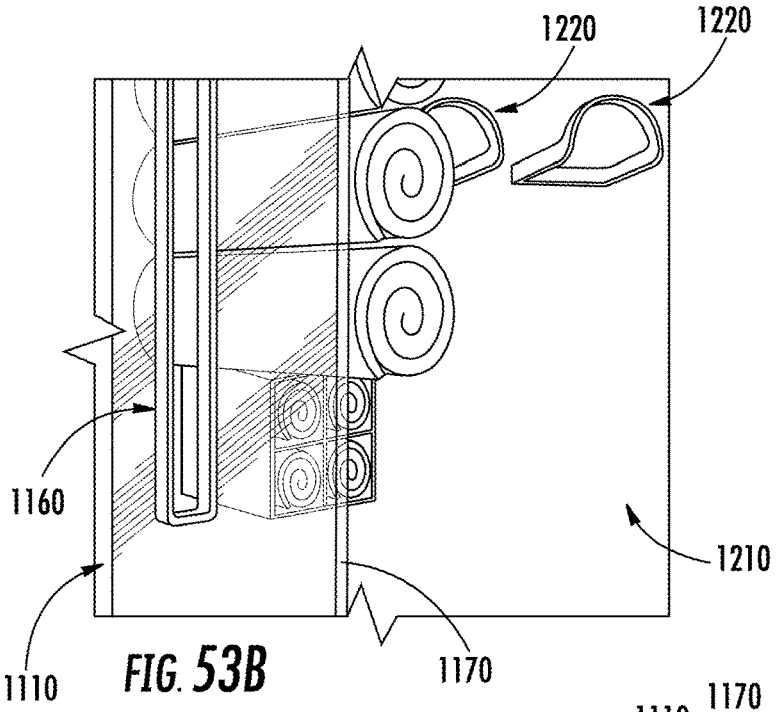
FIG. 53B is a perspective view of the towel hook of FIG. 53A.
Figure 53C:
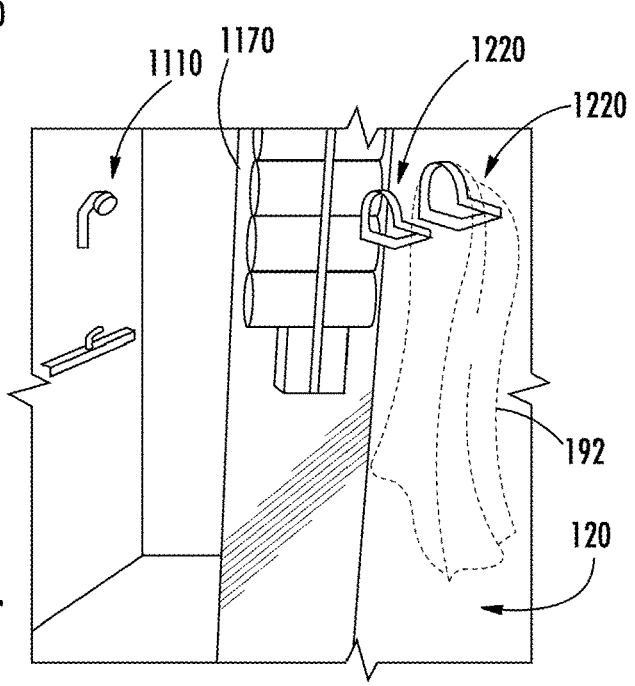
FIG. 53C is a perspective view of the towel hook of FIG. 53A with a towel.

As shown in FIGS. 52A-53C, the transition area 1210 may include at least one towel hook 1220 that is configured to hold and dry a towel 192 after (or before) use. Alternatively or additionally, the user may hang other items, such as clean clothes to change into after showering, on the towel hooks 1220. As shown in FIGS. 52B, 53B, and 53C, the towel hooks 1220 may be conveniently located just outside of the shower area 1110 in order for the occupant to easily access the towel hooks 1220 after showering or drying off.

The base 1222 of the towel hooks 1220 may be relatively wider than conventional towel hooks in order to automatically spread the towel 192 out more and provide more air flow compared to a conventional towel hook to facilitate and encourage faster drying.

As shown in FIGS. 52A-52B and FIGS. 53A-53C, the towel hook 1220 may have a variety of different configurations, shapes, sizes, and designs in order to provide different aesthetics within the transition area 1210. It is understood that the various designs, configurations, shapes, and features can be integrated with each other. Optionally, two towel hooks 1220 may be positioned next to each other along the back wall 1090 and within the transition area 1210.

According to one embodiment as shown in FIGS. 52A-52B, the base 1222 may extend out from the back wall 1090 along the transition area 1210 to provide a ledge or shelf to rest at least a portion of the towel 192 on. The towel hooks 1220 may also include an outer edge 1228 that includes at least one substantially vertical portion 1227 that extends upward from an end region of the base 1222 and a substantially horizontal portion 1229 that connects the top of the at least one vertical portions 1227 and extends along at least the length of the base 1222. The outer edge 1228 may also extend around the sides and the bottom of the base 1222.

According to another embodiment as shown in FIGS. 53A-53C, the towel hooks 1220 may include two side portions 1224 and a front portion 1226 that hold or secure the towel 192 on the towel hooks 1220. For example, the two side portions 1224 may extend substantially perpendicularly from the base 1222 and relative to the back wall 1090 along the transition area 1210. The towel 192 may rest directly on the side portions 1224. The front portion 1226 may be an arched or rounded portion that connects the two side portions 1224 and extends above the two side portions 1224. The towel 192 may optionally rest on top of the front portion 1226 (as shown in FIG. 53C) or between the front portion 1226 and the back wall 1090 along the transition area 1210.

Toilet Area #2

As shown in FIGS. 54A-56C, the toilet area 1310 is shown in greater detail. The toilet area 1310 may include (among other features) a toilet assembly 1320 and a toilet paper holder 1350.

The toilet area 1310 may be conveniently located to the shower area 1110 and the transition area 1210 such that the occupant can easily go between the shower area 1110, the transition area 1210, and the toilet area 1310 when the door 1030 is in the first position 1032 (as shown in FIGS. 43A-43B).

As shown in FIGS. 42, 54A, 55A-55B, and 56B, the second bathroom 1020 may include a toilet area partial wall 1370 that extends along and encloses a portion of the entrance into the toilet area 1310 to provide more privacy and a more isolated toilet area 1310. The partial wall 1370 may be positioned between the toilet area 1310 and the transition area 1210 and partially separates the toilet area 1310 from the transition area 1210. The partial wall 1370 is substantially parallel to and spaced apart from the shower area side wall 1070, the toilet area side wall 1080, and the partial wall 1170 and is substantially perpendicular to the back wall 1090. The partial wall 1370 may optionally be opaque glass.

Toilet Assembly

Figure 55A:
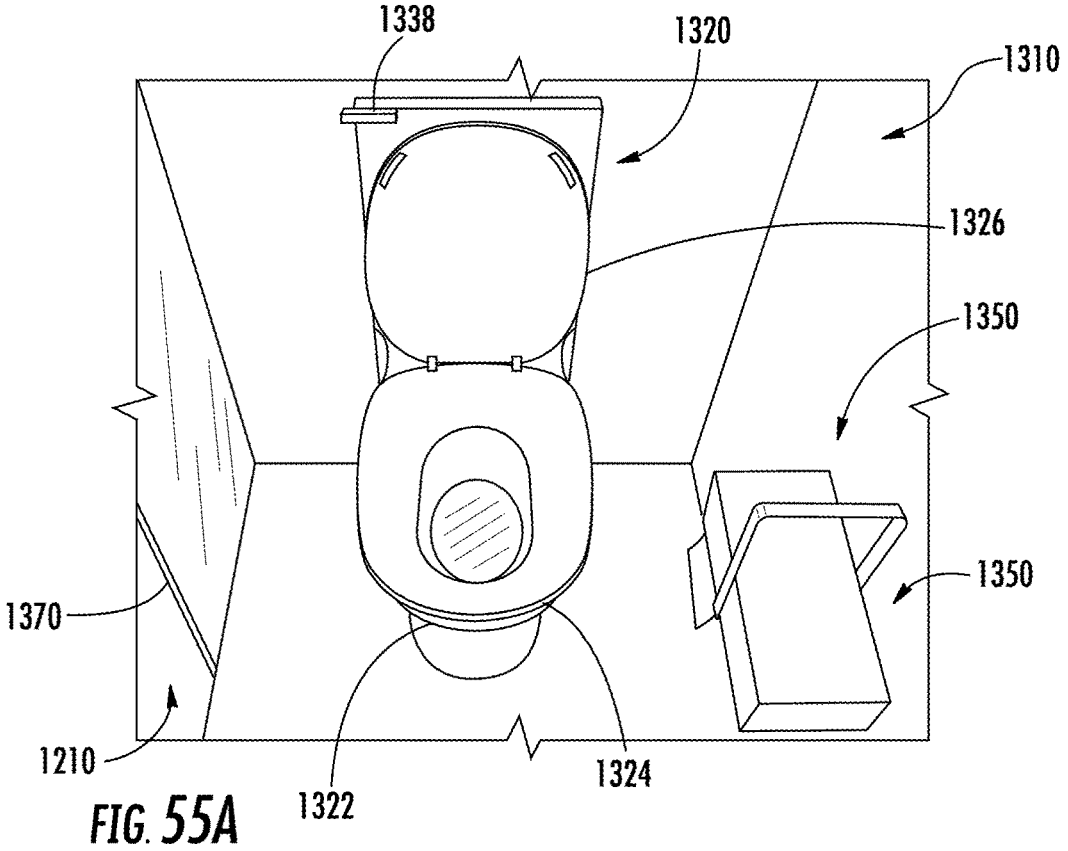
FIG. 55A is a perspective view of the toilet area of FIG. 54A with the toilet lid open.
Figure 55B:
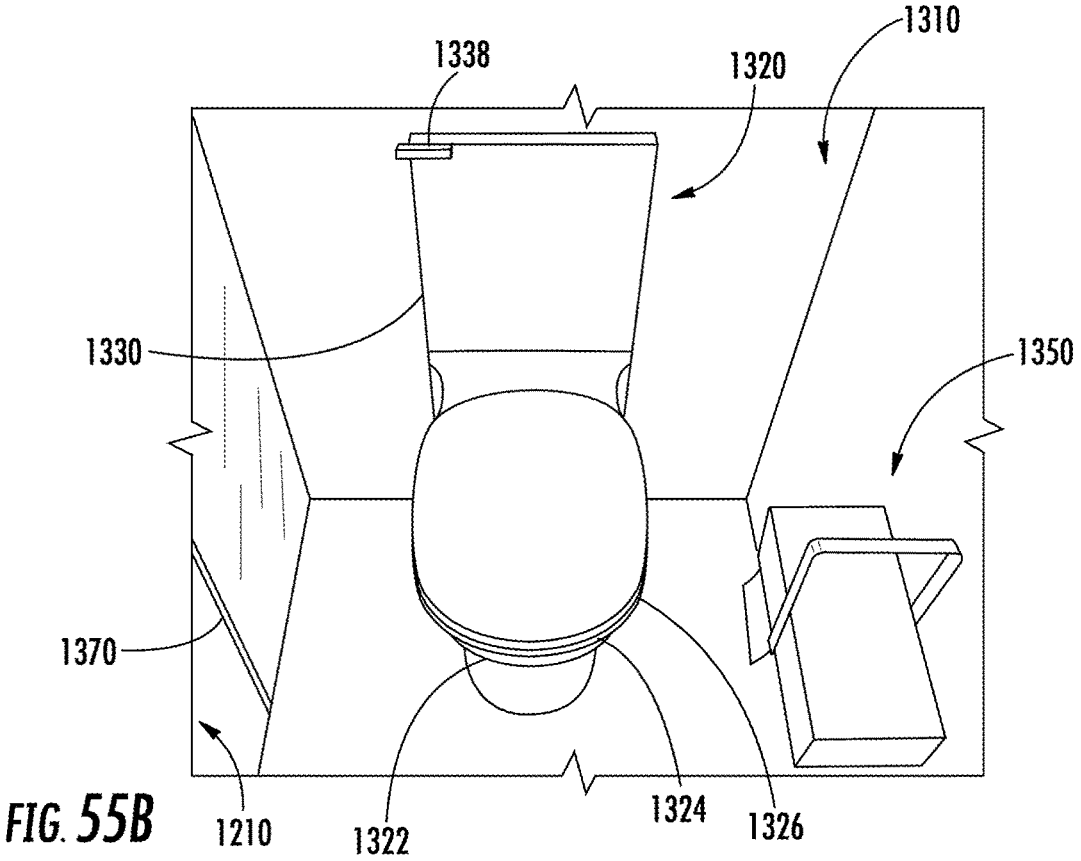
FIG. 55B is a perspective view of the toilet area of FIG. 54A with the toilet lid closed.

As shown in 54A-55B, the toilet area 1310 may include the toilet assembly 1320 that includes a toilet bowl 1322 in order to provide an area to hold water and receive and discard waste. The toilet assembly 1320 may also include a toilet seat 1324 to provide an area for the user to sit on in order to use the toilet assembly 1320 (as shown in FIG. 55A) and a toilet lid 1326 to cover the toilet seat 1324 while the toilet assembly 1320 is not in use (as shown in FIG. 55B). The toilet seat 1324 may be positioned on and pivotably attached to the toilet bowl 1322. The toilet lid 1326 may be positioned on the toilet seat 1324 and pivotably attached to both the toilet seat 1324 and the toilet bowl 1322. The toilet assembly 1320 may also include a trip lever 1338 that is conveniently located, recognizable, and is used to flush the water tank 1330, thereby discarding of any waste.

Due to the design of the toilet assembly 1320, the toilet assembly 1320 looks clean (even when the toilet lid 1326 or the toilet seat 1324 is up and the toilet bowl 1322 is open, as shown in FIG. 55A) and there are no "shadowy" places for dirt, dust, and grime to hide around the toilet assembly 1320. The toilet assembly 1320 may also be comfortable. For example, the toilet bowl 1322 may be relatively long or elongated. The toilet bowl 1322 can be at any height, depending on the desired design.

The toilet assembly 1320 may also include a water tank 1330 that is used to contain water for flushing the toilet bowl 1322. As shown in FIG. 54B, the water tank 1330 may be positioned at least partially within the wall around the toilet area 1310 to take advantage of the wall space, thereby reducing the amount of space the toilet assembly 1320 requires within the toilet area 1310 and increasing the amount of free space within the toilet area 1310. For example, a portion of the wall around the toilet area 1310 may be removed to accommodate a portion of the water tank 1330 and approximately 6 inches of the width of the water tank 1330 may be pushed into the wall around the toilet area 1310. With more space within the toilet area 1310, the user may have more room for their knees, more leg room, and/or more room to move around within the toilet area 1310.

By positioning the water tank 1330 at least partially within the wall around the toilet area 1310, there is no gap between the toilet assembly 1320 and the wall as shown in FIG. 54B. Accordingly, dirty areas behind the toilet assembly 1320 within the toilet area 1310 are prevented and the toilet assembly 1320 is easier to clean and access for cleaning.

In order to access the inside of the water tank 1330, the front cover of the water tank 1330 may be removed (instead of the top of the water tank of a conventional toilet). Alternatively, the back of the water tank 1330 may be opened.

As shown in FIG. 54B, the toilet assembly 1320, in particular the toilet bowl 1322, may still be shaped and sized in order to fit a standard 12-inch rough-in. Accordingly, the toilet assembly 1320 fits with conventional plumbing, is easily installed, and does not require relocating the rough-in. The toilet assembly 1320 can be retro-fit into an existing standard rough-in.

Toilet Paper Holder

As shown in FIGS. 54A-56B, the toilet area 1310 may include a toilet paper holder 1350 that may hold, store, and at least partially cover the toilet paper 352. The toilet paper holder 1350 may be positioned on a wall around the toilet area 1310 such that the user can conveniently reach the toilet paper 352 from the toilet paper holder 1350 while sitting on the toilet seat 1324.

Figure 56A:
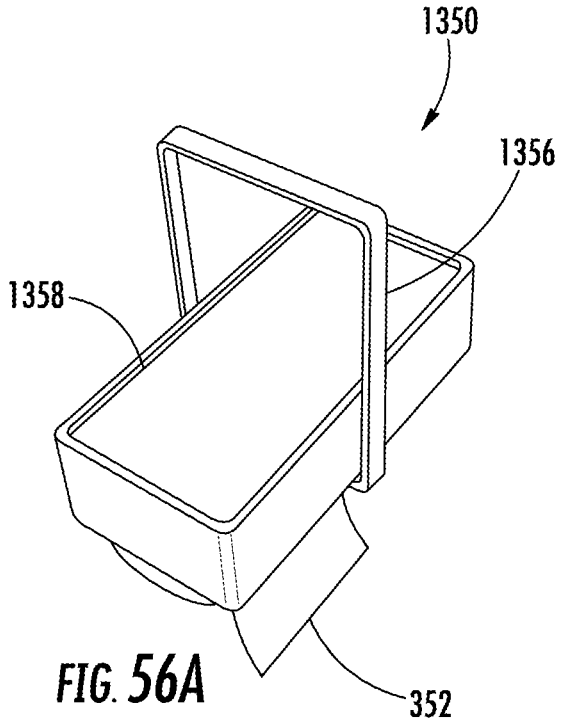
FIG. 56A is a perspective view of a toilet paper holder in the toilet area of FIG. 54A.
Figure 56B:
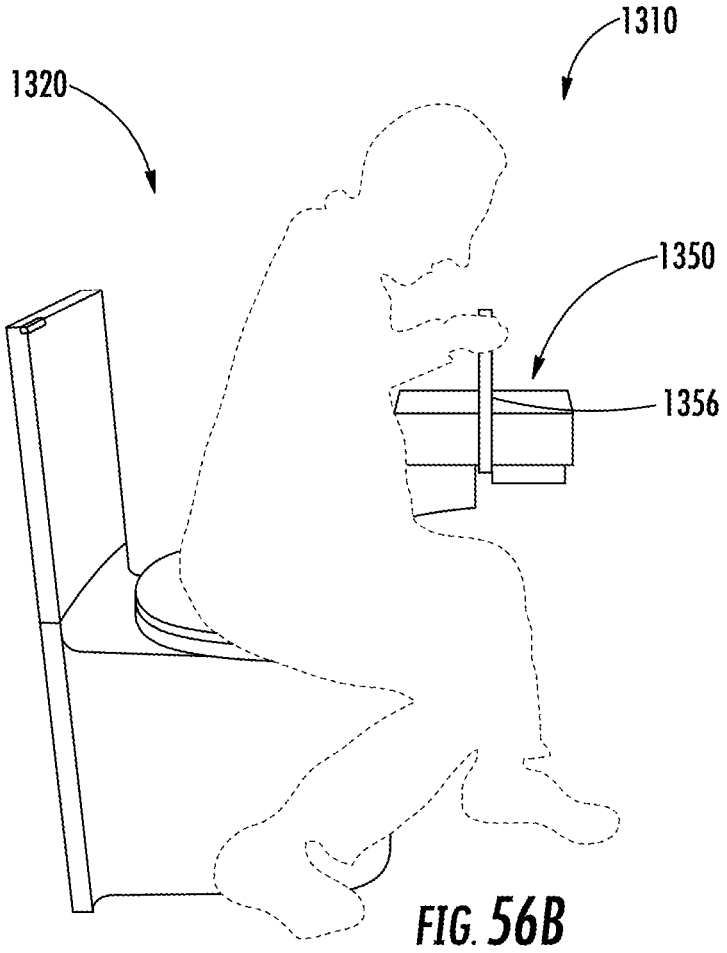
FIG. 56B is a side view of the toilet area of FIG. 54A with an occupant grasping the grasp point of the toilet paper holder.

As shown in FIG. 56A, the toilet paper holder 1350 may also include a handle, bar, integrated grab point, or grasp point 1356 for the user to firmly grasp for support, stability, safety, assistance, and security while raising and/or lowering themselves (e.g., sitting down and/or standing up) from the toilet seat 1324. The grasp point 1356 may be particularly beneficial for users who have difficulty getting on or off of the toilet assembly 1320. The grasp point 1356 may be positioned close to the toilet assembly 1320 and extend out from the wall such that the user can easily hold onto the grasp point 1356 while seated on the toilet assembly 1320, as shown in FIG. 56B, and while raising and lowering themselves onto the toilet assembly 1320.

As shown in FIG. 56A, the toilet paper holder 1350 may also include a shelf 1358 in order to provide an area to securely and conveniently hold any items, such as a phone, tablet, or a book, that the user happens to bring into the toilet area 1310. The shelf 1358 may be positioned directly above the toilet paper 352 within the toilet paper holder 1350 such that the shelf 1358 can be easily and conveniently accessed while the user is using and sitting on the toilet assembly 1320. The grasp point 1356 may be positioned above the shelf 1358 such that the occupant can grab the grasp point 1356 while an item is being stored undisturbed on the shelf 1358.

Figure 54A:
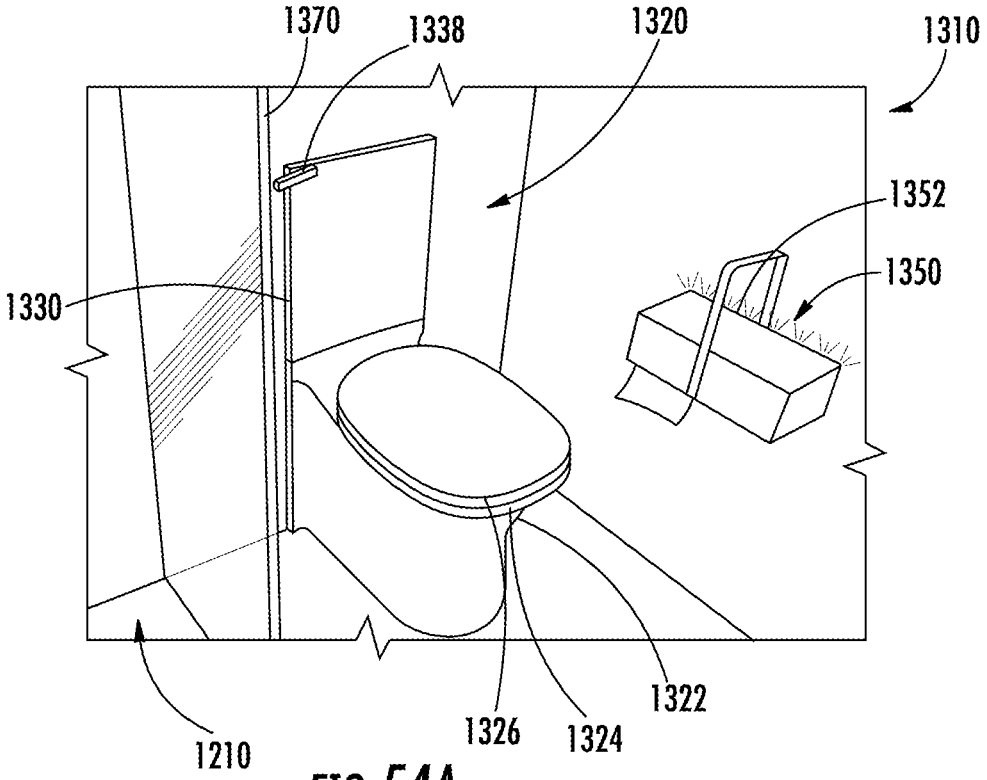
FIG. 54A is a perspective view of a toilet area of the second bathroom of FIG. 40.
Figure 54B:
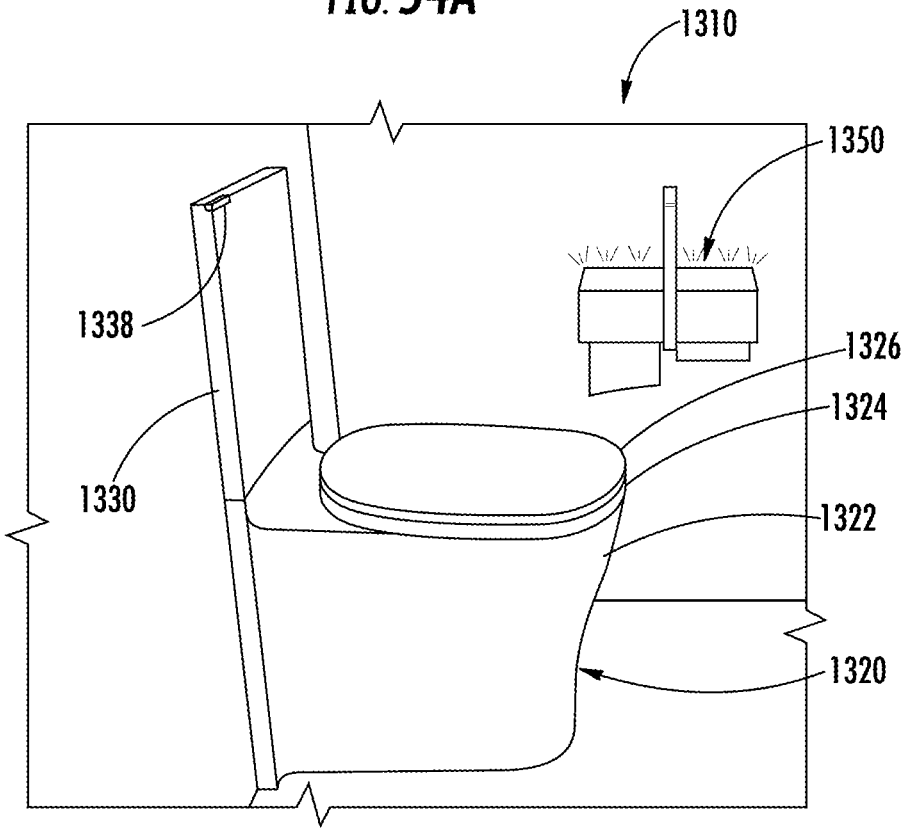
FIG. 54B is a side view of the toilet area of FIG. 54A.

As shown in FIG. 54A, the toilet paper holder 1350 may include a warm backlight or ambient light 1352 around at least a portion of the perimeter to provide a "glow" or lighting around at least a portion of the toilet paper holder 1350. The light 1352 may provide ambiance within the toilet area 1310 and also improve the safety of the toilet area 1310 by allowing the user to easily navigate the toilet area 1310 and use the toilet assembly 1320 (and, specifically, the toilet paper holder 1350) at night. The light 1352 may provide sufficient lighting such that the user can easily and safety navigate the toilet area 1310 and use the toilet assembly 1320 without bumping into anything or turning on any other additional lights (e.g., in the dark in the middle of the night) and without providing too much light to allow the user's eyes to easily adjust to the light 1352 and to prevent fully waking up the user when being used in the dark at night.

According to one embodiment, the light 1352 may extend around the entire perimeter of the back side of the toilet paper holder 1350 such that the top, sides, and bottom of the toilet paper holder 1350 are illuminated. The light 1352 may be directed toward the wall around the toilet area 1310 in order to provide indirect light. Accordingly, the portion of the perimeter of the toilet paper holder 1350 that includes the light 1352 may be at least partially spaced from the wall. Other portions of the back side of the toilet paper holder 1350 may, however, directly abut the wall. The light 1352 may optionally turn on automatically when the user enters into the toilet area 1310.

Grooming Area #2

As shown in FIGS. 57A-65D, the dressing space or grooming area 1510 is shown in greater detail. The grooming area 1510 may include (among other features), a towel bar 1520, a sink assembly 1530, storage areas, lights 1560, and mirrors 1570, 1580.

As shown in FIGS. 40-41 and 57A-59B, the grooming area 1510 may share some space with the room 22. For example, the counter 1532 may extend at least partially into the room 22 and may be used as, for example, a coffee center and/or entertainment center, as well as a bathroom counter (to, for example, get ready for the day).

Figure 57B:
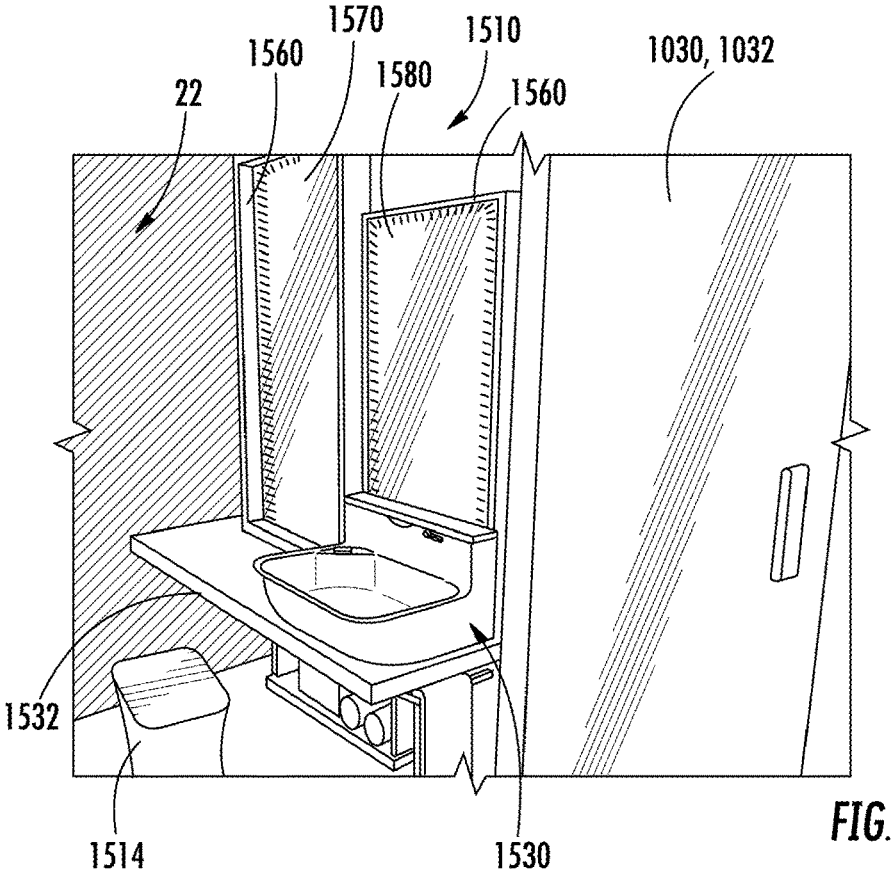
FIG. 57B is a perspective view of the grooming area of FIG. 57A with the lights turned down.
Figure 58A:
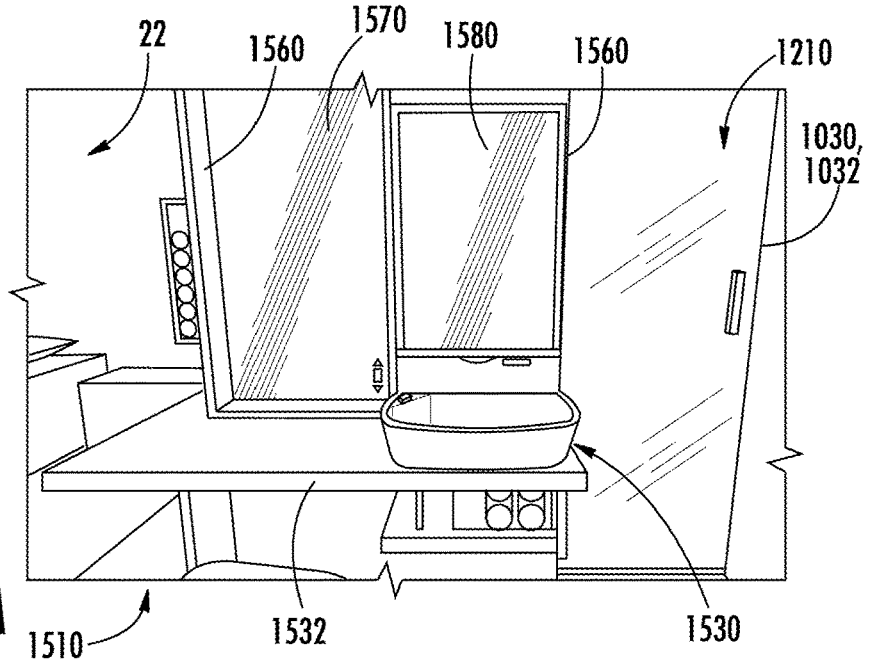
FIG. 58A is a front view of the grooming area of FIG. 57A.
Figure 58B:
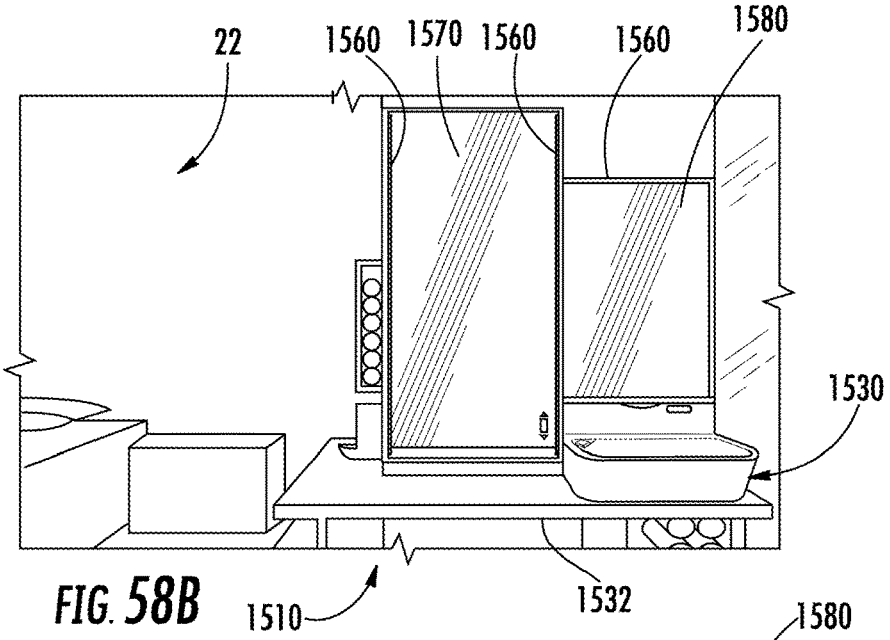
FIG. 58B is a front view of the grooming area of FIG. 57A.
Figure 58C:
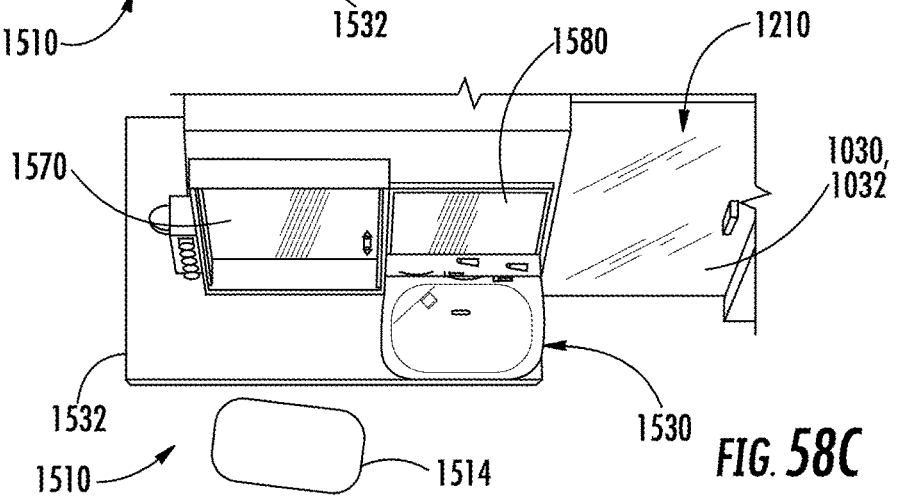
FIG. 58C is a top view of the grooming area of FIG. 57A.
Figure 59A:
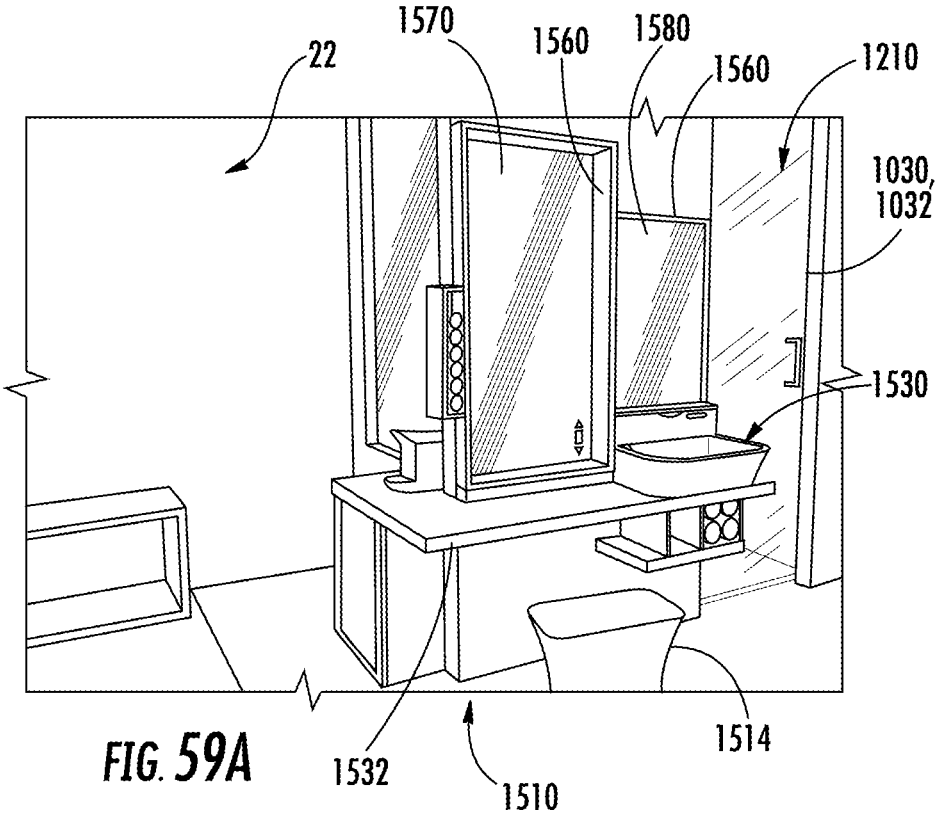
FIG. 59A is a perspective view of the grooming area of FIG. 57A.
Figure 59B:
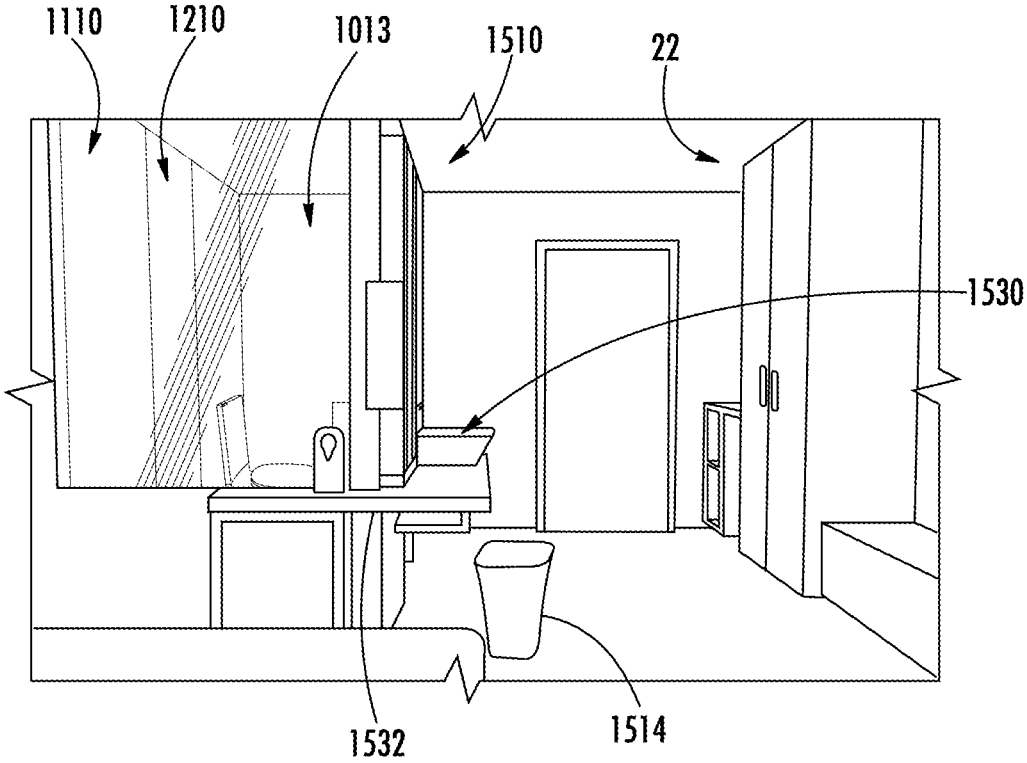
FIG. 59B is a side view of the grooming area of FIG. 57A.

As shown in FIGS. 57A-57B, the grooming area 1510 may be used throughout the day. Accordingly, the ambiance of the grooming area 1510, which may be at least partially controlled by the lights 1560, may be changed according to the time of day, as described further herein.

Sink Assembly

As shown in FIGS. 60A-62D, the vanity or sink assembly 1530 may include a deck, surface, or counter 1532 and a basin or sink 1540.

Figure 60A:
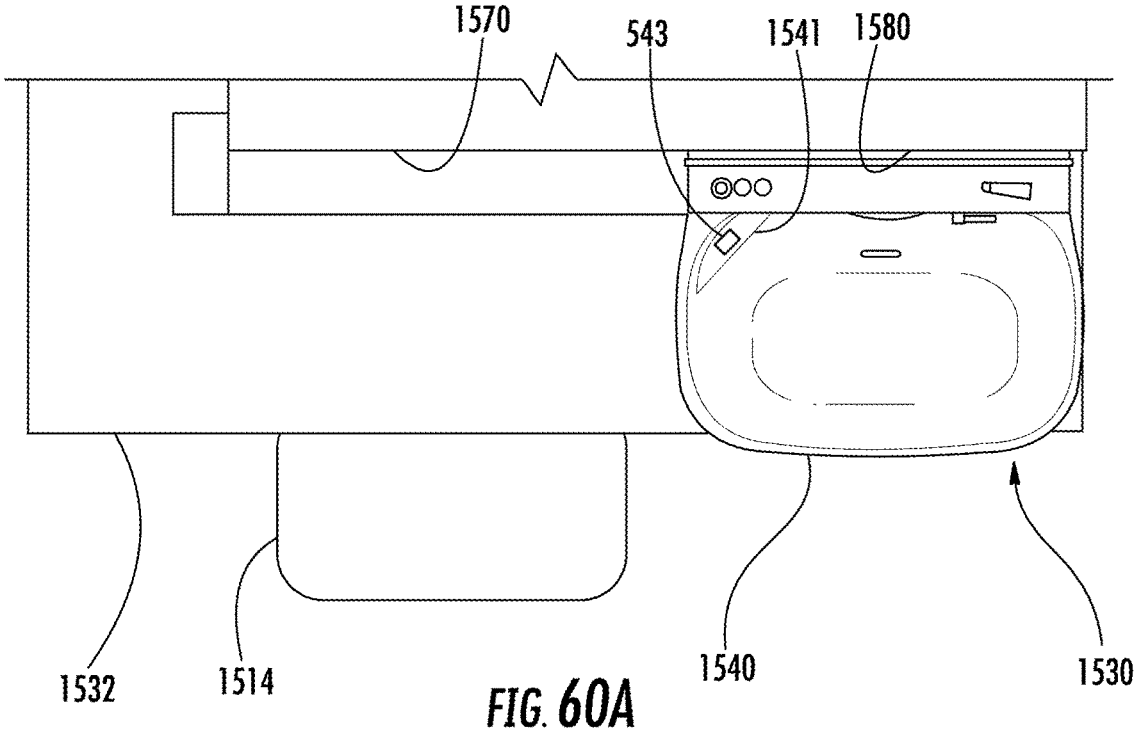
FIG. 60A is a top view of the grooming area of FIG. 57A.
Figure 60B:
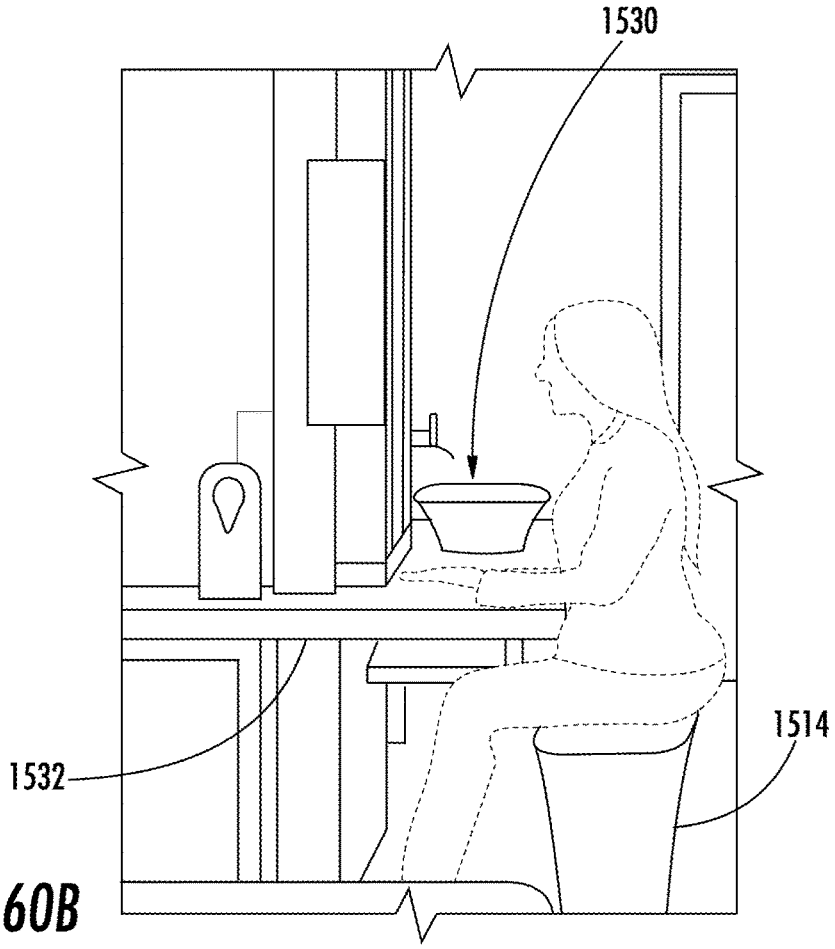
FIG. 60B is a side view of the grooming area of FIG. 57A with an occupant.

As shown in FIGS. 60A-60B, the counter 1532 may be relatively shallow or less deep in order to minimize how much the user has to lean if the user wants to obtain a close look at themselves in the mirror 1570 or easily move their face closer to the mirror 1570. The user may even comfortably sit on the seating 1514 and easily see themselves in the mirror 1570 in front of the counter 1532 without straining their eyes or neck, without leaning or bending toward the mirror 1570, and still with sufficient lighting.

As shown in FIGS. 61A-61D and FIGS. 62A-62D, the sink assembly 1530 (and its various components) may have a variety of different configurations, shapes, sizes, and designs in order to provide different aesthetics within the grooming area 1510. It is understood that the various designs, configurations, shapes, and features can be integrated with each other.

Figure 61A:
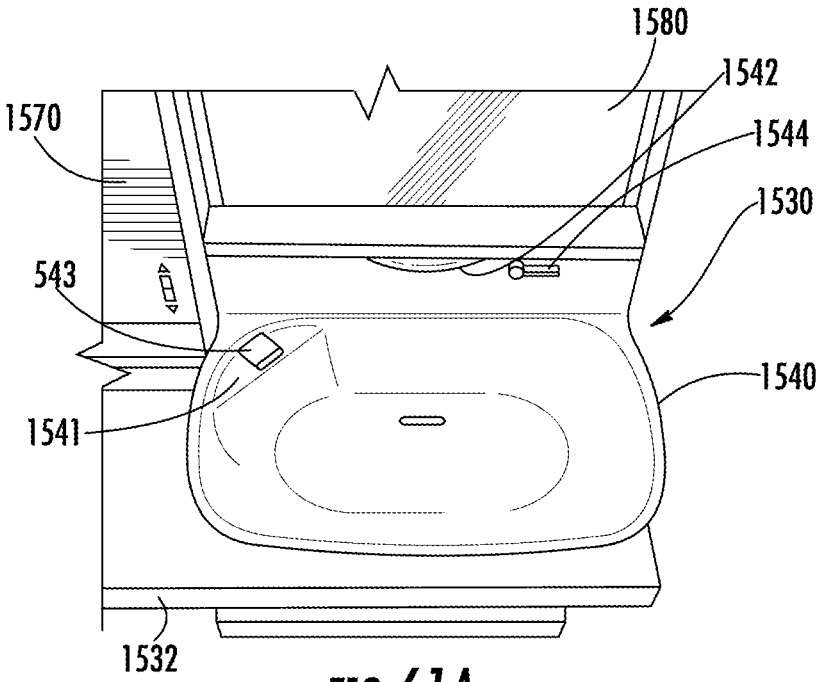
Figure 61B:
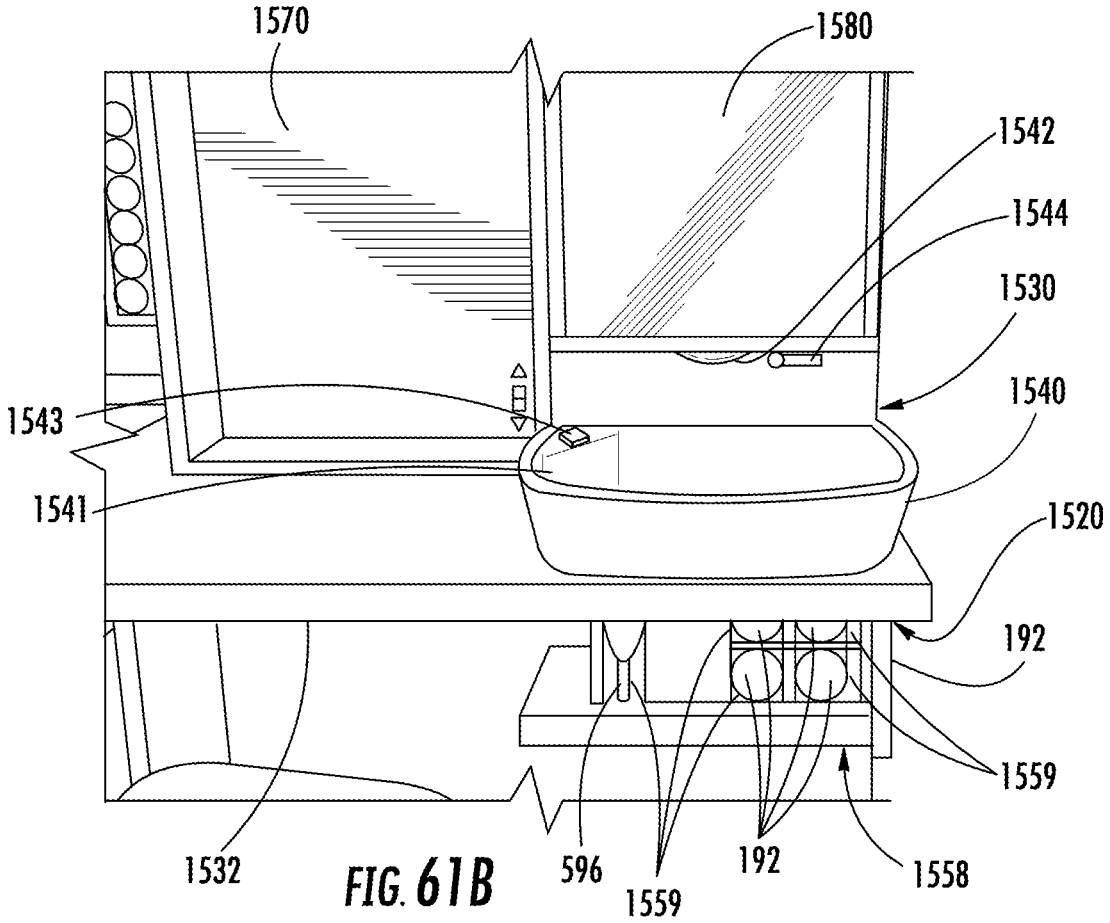
Figure 61C:
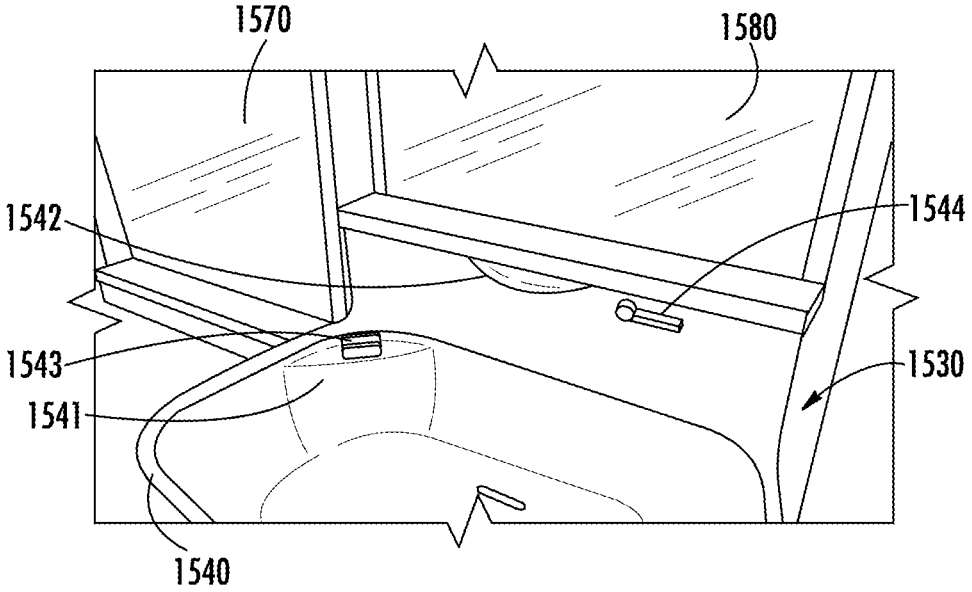
Figure 61D:
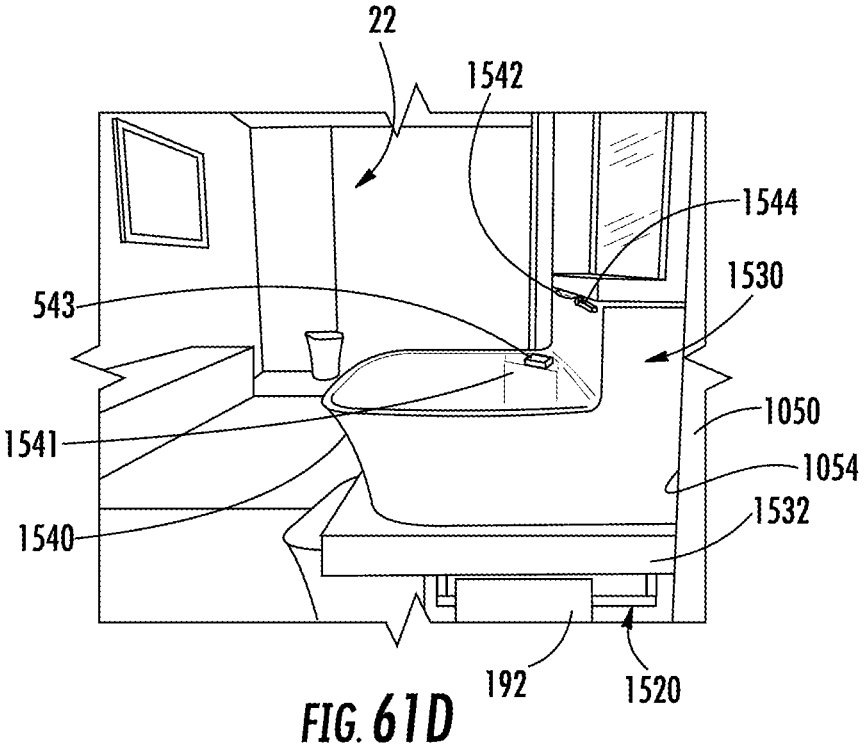

According to one embodiment as shown in FIGS. 61A-61D, the sink 1540 may be at least partially underneath a portion of the mirror 1580. As shown in FIG. 61D, the back of the sink 1540 may be flush against or abut the second side 1054 of the shower area front wall 1050 such that there is no gap between the sink 1540 and the second side 1054 of the shower area front wall 1050. Accordingly, dirty areas behind the sink 1540 within the grooming area 1510 are prevented and the sink assembly 1530 is easier to clean.

Figure 62A:
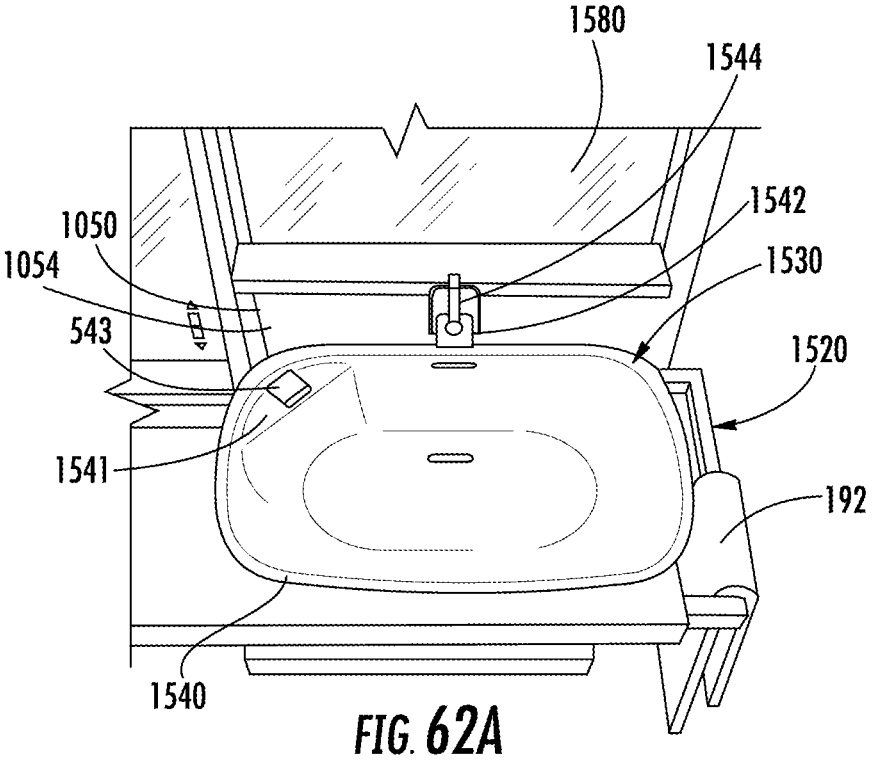
Figure 62B:
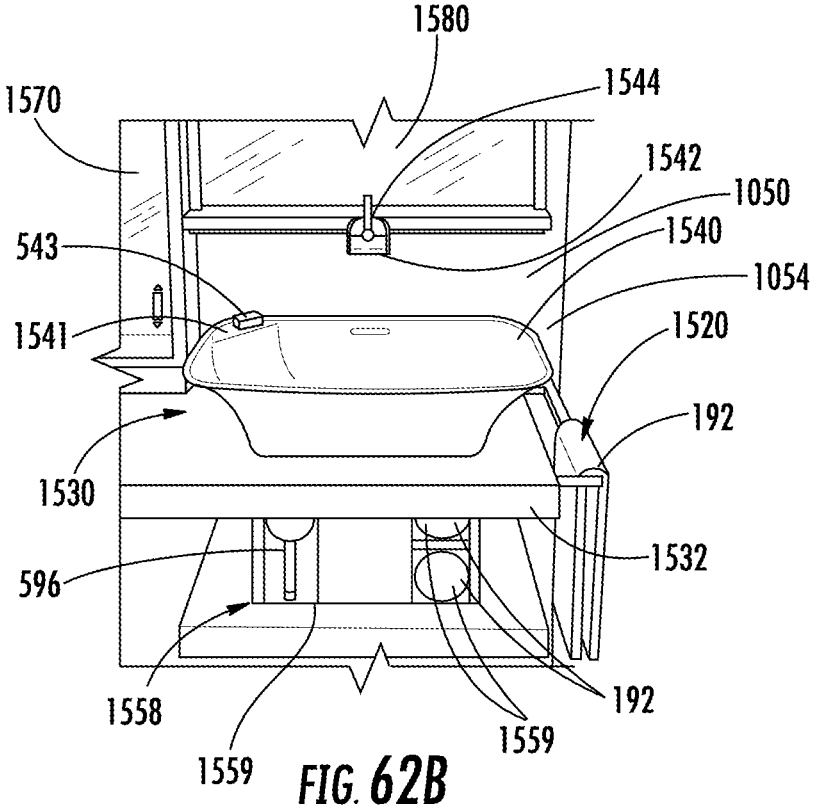
Figure 62C:
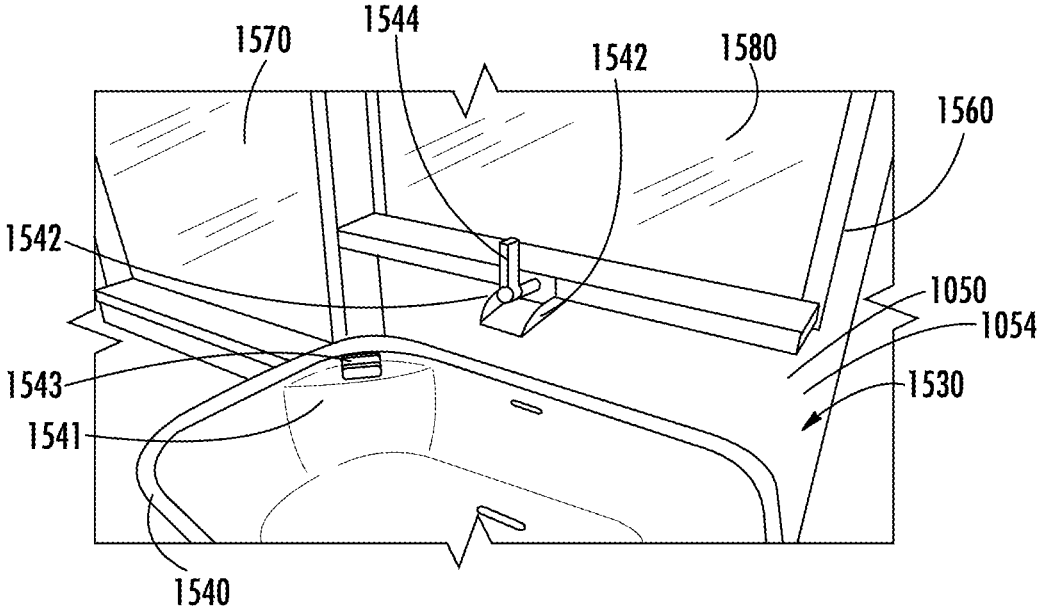
Figure 62D:
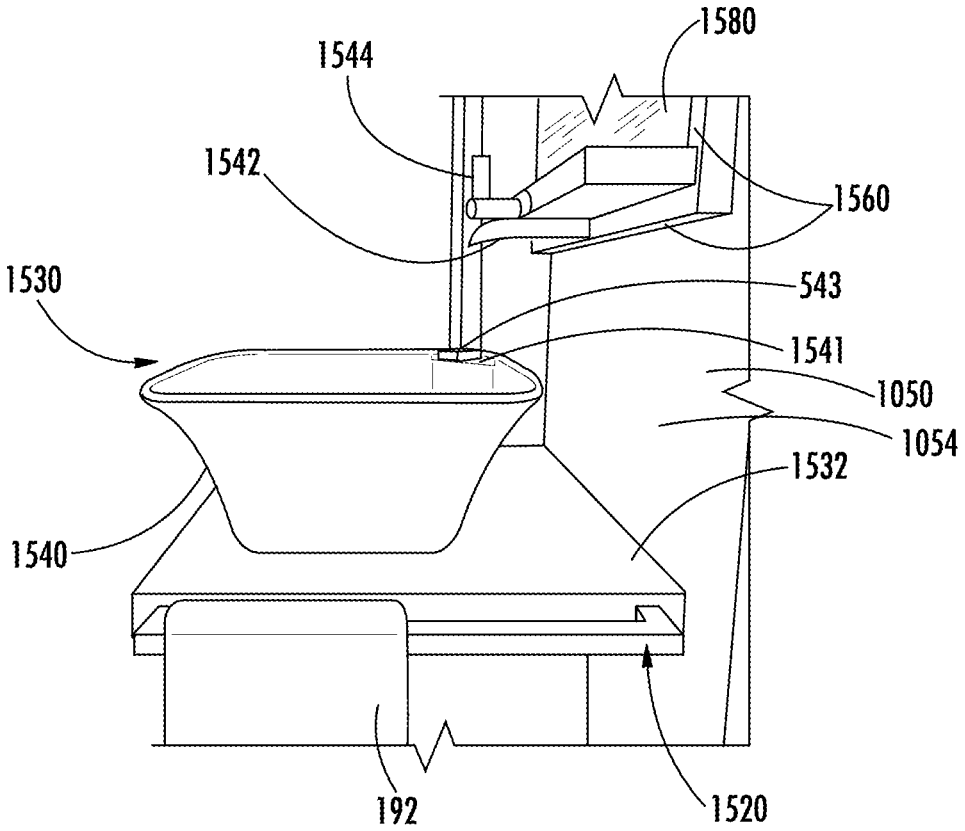

According to another embodiment as shown in FIGS. 62A-62D, the sides of the sink 1540 may be flared, angled, or curved outward toward the top of the sink 1540 (as shown in FIGS. 62B and 62D). Accordingly, the sink 1540 may be a relatively wide vessel to keep the water within the sink 1540 and to prevent any dry items outside of the sink 1540 from getting wet. Accordingly, the different areas of the sink assembly 1530 can be more easily and comfortably shared at the same time by two people in different areas of the sink assembly 1530 without accidently getting one of the people wet. As shown in FIG. 62D, the sink 1540 does not extend to the second side 1054 of the shower area front wall 1050 and instead may be spaced away from the shower area front wall 1050, which allows the area behind the sink 1540 to be cleaned more easily. For example, there is sufficient space between the back of the sink 1540 and the shower area front wall 1050 for a person to easily reach their hand behind the sink 1540 to wipe away any dust or mess.

Additionally, the sink 1540 may include a soap ledge 1541 to hold the wet items 543 (e.g., soap) and isolate the wet items 543 from the rest of the sink assembly 1530 (in particular any dry items on the counter 1532). Accordingly, the soap ledge 1541 positioned at least partially within the perimeter of the sink 1540 in order to prevent the soap from leaving residue on portions of the sink assembly 1530 that are outside of the sink 1540.

The sink assembly 1530 also includes a wall-mounted faucet 1542 with a control 1544 that are directly above the sink 1540 in order to prevent water from being dripped or splashed outside of the sink 1540 (e.g., onto the counter 1532) when the control 1544 is turned off, which keeps the sink assembly 1530 more clean. For example, water dripping off of the user's hand while the control 1544 is being moved to turn off the faucet 1542 simply drops back into the sink, rather than on the top surface of the counter 1532. According to one embodiment as shown in FIGS. 61A-61D, the faucet 1542 and the control 1544 may be mounted to the top back of the sink 1540 and below the mirror 1580 or directly to a lower portion of the mirror 1580. According to another embodiment as shown in FIGS. 62A-62D, the faucet 1542 and the control 1544 may be mounted to the second side 1054 of the shower area front wall 1050 below the mirror 1580 or directly to a lower portion of the mirror 1580.

It is understood that, according to one embodiment, the valve for the faucet 1542 may have a ¼ inch turn valve that tempers water in a similar manner as the Rite-Temp® valve offered by Kohler Co. of Kohler, Wis., as described in U.S. Pat. Nos. 9,069,359, 9,334,971, 9,416,884, and 9,182,045, the entire disclosures of which are incorporated by reference herein in their entirety.

As shown in FIGS. 61B, 61D, 62B, and 62D, the sink assembly 1530 may also include a towel bar 1520 positioned near or under the sink 1540 in order to allow the user to quickly and easily grab a hand towel or washcloth to dry off their face and hands after using the sink 1540. According to one embodiment as shown in FIGS. 61B and 61D, the towel bar 1520 may be attached to and extend downward from the bottom side of the counter 1532 near or underneath the sink 1540. According to another embodiment as shown in FIGS. 62B and 62D, the towel bar 1520 may attached to and extend outward from an end of the counter 1532 next to the sink 1540.

As shown in FIGS. 57A, 58C, 59A-59B, 60A-60B, and 63A-63C, seating 1514, such as a chair, seat, or stool, may be positioned near and used with the sink assembly 1530 in order to provide a comfortable area for the user to sit in while getting ready or using the sink assembly 1530. The seating 1514 may be positioned anywhere along the length of the sink assembly 1530.

At least one mirror 1570, 1580 may be positioned above the sink assembly 1530 to allow the user to easily see themselves when using the sink assembly 1530 or simply when within the grooming area 1510. According to one embodiment, a mirror 1580 may be positioned above the sink 1540 and a mirror 1570 may be positioned above the portion of the counter 1532 that does not include the sink 1540. However, it is understood that the mirror 1580 may be positioned above the portion of the counter 1532 that does not include the sink 1540 and the mirror 1570 may be positioned above the sink 1540 or that the grooming area 1510 may include two mirrors 1570 or two mirrors 1580.

As shown in FIGS. 64A-64B, mirrors 1570, 1580 and/or the sink assembly 1530 may include integrated electrical outlets 1554 to power or charge various electronics, such as grooming tools, hair dryers, or phones, as the user is getting ready or using the grooming area 1510. In order to be easily accessible, the outlets 1554 may be positioned beneath the mirror 1570 and just above the counter 1532.

Lights

As shown in FIGS. 57A-57B, 58A, 62D, 63A-63C, and 64A-64B, the light fixtures, lighting systems, or lights 1560 in the grooming area 1510 are positioned to illuminate at least the sink assembly 1530 and mirrors 1570, 1580 and to allow the user to more easily see themselves in the mirrors 1570, 1580. For example, the lights 1560 may allow the user to more easily and accurately shave their face or put on makeup.

The lights 1560 may surround at least a portion of the perimeters of each of the mirrors 1570, 1580. Each of the mirrors 1570, 1580 may have at least one light 1560. As shown in FIGS. 57A-57B, 58A, and 62D, the lights 1560 may extend along the entire height of both sides of each of the mirrors 1570, 1580, the top of the mirrors 1570, 1580, and/or the bottom of the mirror 1570, 1580. Alternatively or additionally, the lights 1560 may be positioned in other areas within the grooming area 1510. As shown in FIG. 62D, the light 1560 on the bottom of or below the mirror 1580 (e.g., on the lower edge of the mirror 1580) may help the user and housekeeping inspect and/or clean behind the sink 1540. For example, this light 1560 may help expose dirt that housekeeping can wipe away.

Figure 63A:
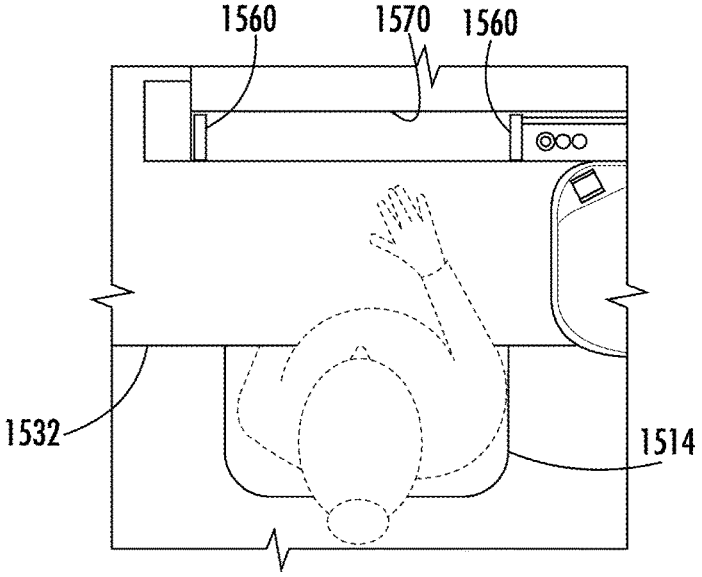
Figure 63B:
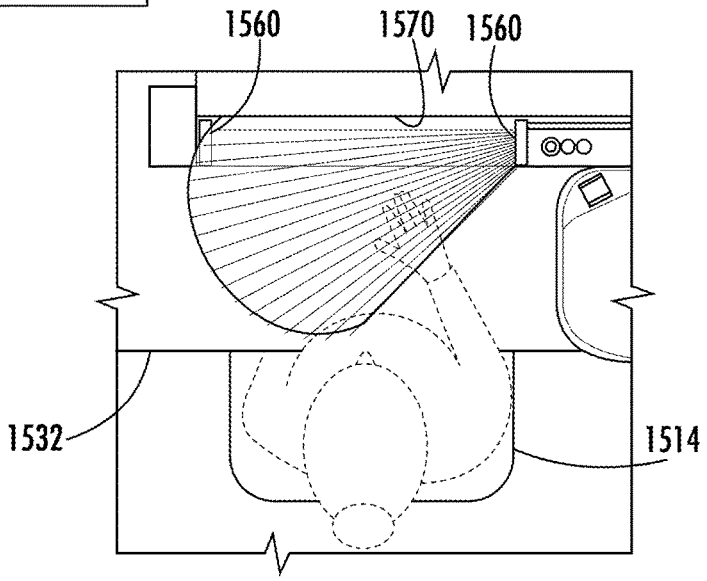
Figure 63C:
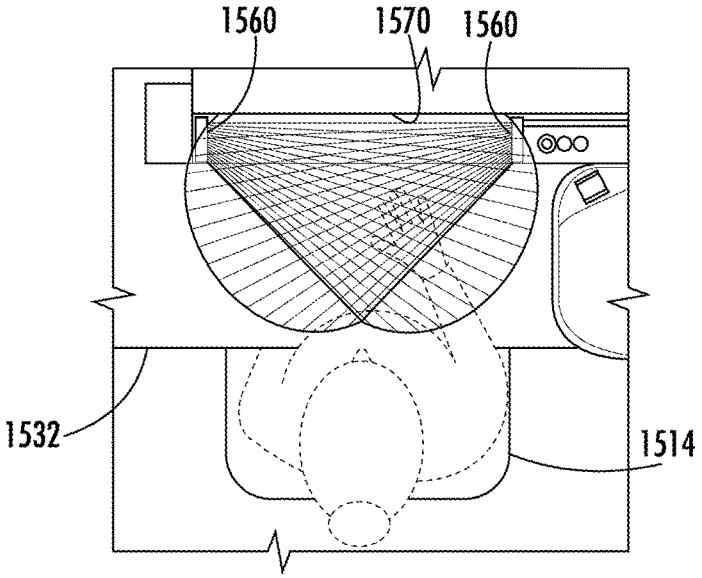

The lights 1560 may optionally be parallel to the mirror 1580 (as shown in FIG. 57A) or perpendicular to the mirror 1570 (as shown in FIGS. 63A-63C and 64A). As shown in FIG. 63A, the lights 1560 may be perpendicular to the mirror 1570 and within the frame of the mirror 1570. By being perpendicular to the mirror 1570, the lights 1560 face each other on either side of the mirror 1570 rather than facing out toward the user, thus creating ambient light (as shown in FIGS. 63B-63C). Accordingly, the user does not have to stare directly into the lights 1570, but their face is still illuminated and easily seen in the mirror 1570. Due to the mirror 1570, the lights 1560 create a brightening effect on the user's face as they bring their face closer to the mirror 1570, without blinding the user's eyes, as shown in FIG. 63C. Accordingly, to see themselves better, the user may slightly lean in toward the mirror 1570, which illuminates both sides and the front of their face. Accordingly, shadows on the user's face are avoided, which are often caused by lighting above and below their face.

As shown in FIGS. 57A-57B, the brightness, temperature, or intensity of the lights 1560 may automatically adjust or transition throughout the day and according to the time of day to correlate to the user's circadian rhythm. For example, in the morning, the lights 1560 may automatically be relatively bright in order to help the user get ready for the day, as shown in FIG. 57A. In the evening, however, the lights 1560 may have a relatively warmer hue to help the user transition to sleep, as shown in FIG. 57B. In the nighttime, the lights 1560 may optionally be very low light to function as nightlights.

If the user prefers a different setting, the user may also have the option to override the automatic light adjustments and manually control or adjust the brightness, temperature, or intensity of the lights 1560 by using the light and power switches or controls 1556 to control or adjust the lights 1560, as shown in FIGS. 64A-64B. The controls 1556 may be used to turn the lights 1560 on or off or adjust the brightness, temperature, or intensity of the lights 1560. As shown in FIGS. 64A-64B, the controls 1556 may be integrated into at least one of the mirrors 1570, 1580, such as a bottom portion of the mirror 1570 in order to be easily accessible.

Storage Areas

As shown in FIGS. 61B, 62B, and 65A-65D, the grooming area 1510 may include various storage spaces or areas for the user to store and organize their personal items, toiletries, and products (e.g., makeup, contacts, medications, toothpaste and toothbrush). The hotel may also display and store their products on or in the various storage areas.

For example, as shown in FIGS. 65A and 65C-65D, the bottom area of each of the mirrors 1570, 1580 may have a shelf 1552 that may optionally be integrated with the frame of each of the mirrors 1570, 1580. The faucet 1542 may be positioned just beneath the shelf 1552 to prevent any items on the shelf 1552 from getting wet. Additionally, as shown in FIG. 62D, the lights 1560 may also be positioned beneath the shelf 1552 to illuminate the area beneath the mirror 1580 (and behind the sink 1540).

As shown in FIG. 65A, the counter 1532 may also provide a large amount of area to store various items. As shown in FIG. 65B, since the sink 1540 may have flared or curved sides, there may be space next to the sink 1540 on the counter 1532 for various items, such as a toothbrush.

As shown in FIGS. 61B and 62B, a shelf assembly 1558 may be positioned beneath or below the counter 1532 (and optionally beneath and aligned with the sink 1540) in order to provide more storage space. The shelf assembly 1558 is out of the way, but visible and accessible when needed. The shelf assembly 1558 may provide storage for various personal items, toiletries, and products such as, for example, a hairdryer 596 and/or towels 192. According to one embodiment, the shelf assembly 1558 may have separate shelves or cubbies 1559 to hold the various personal items, toiletries, and products. For example, as shown in FIG. 61B, the shelf assembly 1558 may have four cubbies 1559 to hold the towels 192 and another cubby 1559 to hold a hairdryer 596. As shown in FIG. 62B, the shelf assembly 1558 may have two cubbies 1559 to hold the towels 192 and another cubby 1559 to hold a hairdryer 596.

It is anticipated that the various configurations and embodiments of each of the bathroom fixtures and components may be used in conjunction with each other and in a variety of different configurations.

The various bathroom fixtures and components and components may be constructed out of a variety of materials, according to the desired configuration. It is anticipated that the various configurations and embodiments of each of the first bathroom and the second bathroom may be used in conjunction with each other and in a variety of different configurations.

Although the various bathroom fixtures and components of each of the first bathroom 20 and the second bathroom 1020 are shown together or separately, it is understood that the various bathroom fixtures and components can be used in combination with each other, in conjunction with each other, or independently of each other, depending on the desired configuration.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower accessories as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to exemplary embodiments. Other substitutions, modifications, changes and omissions may also be made in the design, operating conditions and arrangement of the various exemplary embodiments without departing from the scope of the present disclosure.

What is claimed is:

1. A bathroom module, comprising:

a shower area comprising a shower head, a control valve assembly, and a drain;

a toilet area comprising a toilet assembly;

a transition area disposed between the shower area and the toilet area;

a shower area front wall;

a shower area side wall, the shower area disposed along a first side of the shower area front wall and a first side of the shower area side wall;

a toilet area front wall;

a toilet area side wall, the toilet area disposed along a first side of the toilet area front wall and a first side of the toilet area side wall;

a grooming area comprising a sink assembly that comprises a faucet, wherein the grooming area is disposed along a second side of at least one of the shower area front wall, the shower area side wall, the toilet area front wall, and the toilet area side wall; and a shower area partial wall and a toilet area partial wall, wherein the shower area partial wall partially separates the shower area from the transition area and the toilet area partial wall partially separates the toilet area from the transition area.

2. The bathroom module of claim 1, further comprising a door hingably attached to the shower area front wall.

3. The bathroom module of claim 2, wherein:

the door is movable between a first position and a second position;

in the first position, the door separates the shower area, the transition area, and the toilet area from the grooming area; and in the second position, the door separates the shower area from the transition area, the toilet area, and the grooming area.

4. The bathroom module of claim 3, wherein, in the first position, the door is substantially parallel to and aligned with the shower area front wall and the toilet area front wall.

5. The bathroom module of claim 3, wherein, in the second position, the door is substantially perpendicular to the shower area front wall and the toilet area front wall.

6. The bathroom module of claim 3, wherein the shower area front wall and the toilet area front wall are aligned with each other along their lengths such that the door creates a continuous wall with the shower area front wall and the toilet area front wall in the first position.

7. The bathroom module of claim 3, wherein, in the first position, there are no doors separating the shower area, the transition area, and the toilet area.

8. The bathroom module of claim 3, wherein, in the second position, the door only encloses the shower area and separates the shower area from the rest of the bathroom module.

9. The bathroom module of claim 3, wherein the transition area comprises a transition area floor and the shower area comprises a shower area floor, wherein the transition area floor and the shower area floor are at two different vertical levels.

10. The bathroom module of claim 9, wherein the door moves vertically as the door moves between the first position and the second position to change between the two different vertical levels of the transition area floor and the shower area floor.

11. The bathroom module of claim 2, wherein the door is movable through a portion of the transition area.

12. The bathroom module of claim 1, wherein the door is aligned with the shower area partial wall in the second position.

13. The bathroom module of claim 1, wherein the bathroom module is a prefabricated as a transportable module.

14. The bathroom module of claim 1, wherein the bathroom module is configured to connect to a room, wherein there are no walls between the grooming area and the room such that the grooming area is open to and at least partially shares a space with the room.

15. A bathroom module, comprising:

a shower area;

a toilet area;

a transition area disposed between the shower area and the toilet area;

a shower area front wall;

a shower area side wall, the shower area disposed along a first side of the shower area front wall and a first side of the shower area side wall;

a toilet area front wall;

a toilet area side wall, the toilet area disposed along a first side of the toilet area front wall and a first side of the toilet area side wall; and a grooming area disposed along a second side of at least one of the shower area front wall, the shower area side wall, the toilet area front wall, and the toilet area side wall;

wherein the bathroom module is configured to connect to a room, wherein there are no walls between the grooming area and the room such that the grooming area is open to and at least partially shares a space with the room.

16. The bathroom module of claim 15, further comprising a door hingably attached to the shower area front wall.

17. The bathroom module of claim 16, wherein:

the door is movable between a first position and a second position;

in the first position, the door separates the shower area, the transition area, and the toilet area from the grooming area; and in the second position, the door separates the shower area from the transition area, the toilet area, and the grooming area.

18. A bathroom module, comprising:

a shower area;

a toilet area;

a transition area disposed between the shower area and the toilet area;

a shower area front wall;

a shower area side wall, the shower area disposed along a first side of the shower area front wall and a first side of the shower area side wall;

a toilet area front wall;

a toilet area side wall, the toilet area disposed along a first side of the toilet area front wall and a first side of the toilet area side wall; and a grooming area disposed along a second side of at least one of the shower area front wall, the shower area side wall, the toilet area front wall, and the toilet area side wall;

wherein the grooming area is positioned along both the second side of the shower area front wall and the second side of the shower area side wall or along both the second side of the toilet area front wall and the second side of the toilet area side wall.

19. The bathroom module of claim 18, further comprising a door hingably attached to the shower area front wall.

20. The bathroom module of claim 19, wherein the bathroom module is configured to connect to a room, wherein there are no walls between the grooming area and the room such that the grooming area is open to and at least partially shares a space with the room.

* * * * *